US011458354B2

(12) United States Patent
Bissonnette et al.

(10) Patent No.: US 11,458,354 B2
(45) Date of Patent: Oct. 4, 2022

(54) MODULAR EXERCISE SYSTEM

(71) Applicant: Rehab2Fit Technologies, Inc., Longmont, CO (US)

(72) Inventors: Michael Bissonnette, Denver, CO (US); Philip Powers, Denver, CO (US); James D. Steidl, San Diego, CA (US)

(73) Assignee: Rehab2Fit Technologies, Inc., Longmont, CO (US)

( * ) Notice: Subject to any disclaimer, the term of this patent is extended or adjusted under 35 U.S.C. 154(b) by 0 days.

(21) Appl. No.: 16/887,688

(22) Filed: May 29, 2020

(65) Prior Publication Data

US 2020/0376327 A1 Dec. 3, 2020

Related U.S. Application Data

(60) Provisional application No. 62/859,500, filed on Jun. 10, 2019, provisional application No. 62/855,447, filed on May 31, 2019.

(51) Int. Cl.
*A63B 22/00* (2006.01)
*A63B 22/06* (2006.01)
(Continued)

(52) U.S. Cl.
CPC ..... *A63B 22/0046* (2013.01); *A63B 21/4029* (2015.10); *A63B 22/0605* (2013.01);
(Continued)

(58) Field of Classification Search
CPC ..... A63B 22/0046; A63B 22/0605; A63B 21/4029; A63B 23/03516;
(Continued)

(56) References Cited

U.S. PATENT DOCUMENTS 1,577,809 A * 3/1926 Randall ..... A63B 22/0076 482/72
4,768,775 A * 9/1988 Marshall ..... A63B 22/0076 482/133

(Continued)

OTHER PUBLICATIONS

U.S. Appl. No. 16/812,462, filed Mar. 9, 2020, and titled "System, Method and Apparatus for Adjustable Pedal Crank", by Peter Am, et al.

(Continued)

*Primary Examiner* — Andrew S Lo
*Assistant Examiner* — Andrew M Kobylarz
(74) *Attorney, Agent, or Firm* — Dickinson Wright, PLLC; Stephen A. Mason; Jonathan H. Harder

(57) ABSTRACT

An exercise system includes two or more exercise machines coupled together. Each exercise machine can include a modular exercise machine offering one or more unique exercise functions. To vary or change the exercise system, the exercise machines may decouple from each other and couple to a different exercise machine. Examples of the exercise machines include osteogenic, muscular hypertrophy and cardiovascular devices. These exercise systems enable modifications to the exercise machines for user rehabilitation. The exercise machines can monitor other exercise machines and provide feedback to a user through a computer display.

17 Claims, 49 Drawing Sheets

(51) Int. Cl.
*A63B 21/00* (2006.01)
*A63B 23/035* (2006.01)

(52) U.S. Cl.
CPC .. *A63B 23/03516* (2013.01); *A63B 23/03575* (2013.01); *A63B 2022/0611* (2013.01); *A63B 2225/093* (2013.01)

(58) Field of Classification Search
CPC ..... A63B 23/03575; A63B 2022/0611; A63B 2225/093; A63B 24/0087; A63B 2220/833; A63B 2024/0093; A63B 2071/0625; A63B 2225/09; A63B 2220/51; A63B 71/0622; A63B 2230/06; A63B 2225/20; A63B 2225/10; A63B 24/0062; A63B 2225/50; A63B 2071/065; A61H 2203/0245; A61H 2203/02; A61H 2203/0437; A61H 1/00; A61H 1/0214; A47C 9/002
See application file for complete search history.

(56) References Cited

U.S. PATENT DOCUMENTS

D355,942 S * 2/1995 Wu ..... D21/666
6,001,046 A * 12/1999 Chang ..... A63B 22/0605 482/57
6,652,425 B1 * 11/2003 Martin ..... A63B 21/154 482/57
7,513,855 B1 * 4/2009 Yeh ..... A63B 22/001 482/52
7,736,281 B2 * 6/2010 Corbalis ..... A63B 22/0605 482/57
7,837,604 B1 * 11/2010 Hsu ..... A63B 21/1609 482/137
9,802,076 B2 * 10/2017 Murray ..... A63B 21/0058
10,173,094 B2 1/2019 Gomberg et al.
10,173,095 B2 1/2019 Gomberg et al.
10,173,096 B2 1/2019 Gomberg et al.
10,173,097 B2 1/2019 Gomberg et al.
10,226,663 B2 3/2019 Gomberg et al.
10,646,746 B1 * 5/2020 Gomberg ..... A63B 23/0476
2002/0028733 A1 * 3/2002 Martens ..... A63B 21/0628 482/99
2003/0199363 A1 * 10/2003 Chen ..... A63B 22/0605 482/4
2006/0035755 A1 * 2/2006 Dalebout ..... A63B 24/00 482/52
2018/0228682 A1 * 8/2018 Bayerlein ..... A63B 71/0622
2018/0353812 A1 * 12/2018 Lannon ..... G16H 20/30
2019/0336815 A1 * 11/2019 Hsu ..... A63B 22/0046
2019/0336819 A1 * 11/2019 Hsu ..... A63B 22/001
2020/0151595 A1 * 5/2020 Jayalath ..... A63B 21/0442
2020/0289879 A1 * 9/2020 Hacking ..... A63B 22/0605

OTHER PUBLICATIONS

U.S. Appl. No. 16/813,158, filed Mar. 9, 2020, and titled "System, Method and Apparatus for a Rehabilitation Machine With a Simulated Flywheel", by S. Adam Hacking, et al.
U.S. Appl. No. 16/813,303, filed Mar. 9, 2020, and titled "Control System for a Rehabilitation and Exercise Electromechanical Device", by S. Adam Hacking, et al.
U.S. Appl. No. 16/813,224, filed Mar. 9, 2020, and titled "System, Method and Apparatus for Electrically Actuated Pedal for an Exercise or Rehabilitation Machine", by S. Adam Hacking, et al.

* cited by examiner

MODULAR EXERCISE SYSTEM

This application claims priority to and the benefit of U.S. Prov. Pat. App. No. 62/859,500, filed Jun. 10, 2019, and U.S. Prov. Pat. App. No. 62/855,447, filed May 31, 2019, each of which is incorporated herein by reference in its entirety.

FIELD OF USE

The following description relates to exercise equipment. In particular, the following description relates to exercise machines designed to couple to and decouple from other exercise machines. The coupling/decoupling ability offers users the ability to create various combinations of exercise equipment.

BACKGROUND

Traditional exercise systems, commonly known as "universal gyms," include multiple exercise stations on a single unit. Each exercise station can include a handle coupled to one end of a cable, and a stack of weights coupled to an opposing end of the cable. The cable is routed through a pulley system, allowing a user to pull the handle and subsequently displace the weights. Further, each station can be configured to work different muscle groups of the user.

These exercise systems have some drawbacks. For example, a traditional exercise system often includes an arrangement of exercise stations with a set number of exercise stations at set locations. Moreover, exercise systems known in the art have little or no interchangeability. As a result, traditional exercise systems typically offer fixed sets of exercise options.

SUMMARY

Exercise systems described herein can provide multiple exercise functions. In particular, an exercise system can include two or more exercise machines releasably coupled together to provide flexible sets of exercise functions. The exercise machines can be coupled together and decoupled from each other. The exercise machines can be mechanically coupled together, and they can be in electrical communication with each other as well. When decoupled from each other, the exercise machines can couple with one or more different exercise machines that offer other exercise functions.

As an example, an exercise system can include a first exercise machine coupled (e.g., mechanically, electrically) to a second exercise machine. In some embodiments, the first exercise machine can include an osteogenic device that provides one or more exercise functions that promote bone development. Other embodiments can include the second exercise machine having a muscular hypertrophy device that provides one or more exercise functions that promote muscular development. Accordingly, the first and second exercise machines, when coupled together, can provide a set of exercise functions designed to physically improve a user in different ways. Further, when the first and second exercise machines are decoupled from each other. The first and second exercise machines can couple with different exercise machines that offer other types of osteogenic and muscular development exercises.

Based on their coupling and decoupling ability, exercise systems described herein can include interchangeable and compatible exercise machines. Each exercise machine can promote development of different body parts (e.g., bone and/or muscle). For example, osteogenic devices can promote bone development of bones in the skeletal system of a user, while muscular hypertrophy devices can promote development of the muscles of the user.

Other systems, methods, features and advantages of the embodiments will be, or will become, apparent to one of ordinary skill in the art upon examination of the following figures and detailed description. It is intended that all such additional systems, methods, features and advantages included in this description and summary be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
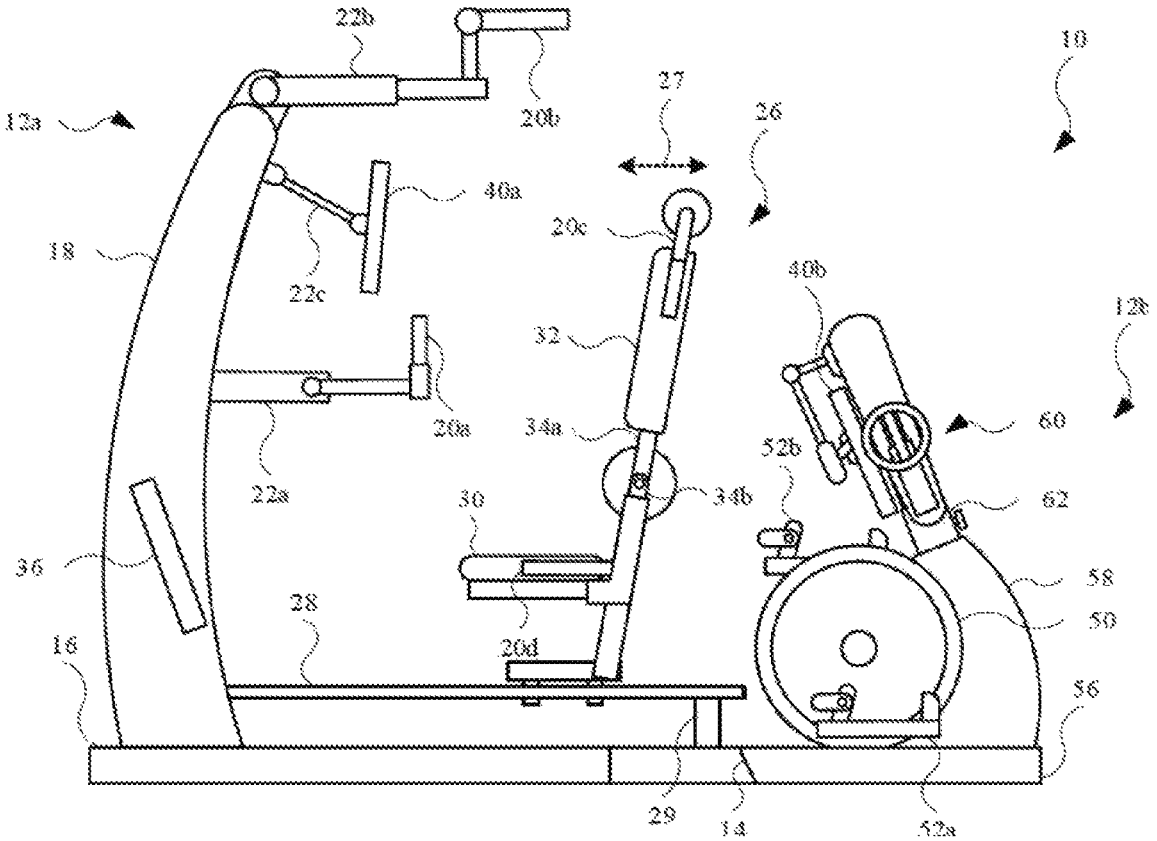
FIG. 1 illustrates a side view of an embodiment of an exercise system, in accordance with some embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments described herein.

DETAILED DESCRIPTION

The subject matter of each of U.S. Pat. No. 10,226,663, issued Mar. 12, 2019; U.S. Pat. No. 10,173,094, issued Jan. 8, 2019; U.S. Pat. No. 10,173,095, issued Jan. 8, 2019; U.S. Pat. No. 10,173,096, issued Jan. 8, 2019; U.S. Pat. No. 10,173,097, issued Jan. 8, 2019; and U.S. Pat. No. 10,646,746, issued May 12, 2020; and U.S. pending patent application Ser. No. 16/812,462 filed Mar. 9, 2020; Ser. No. 16/813,158 filed Mar. 9, 2020; Ser. No. 16/813,224 filed Mar. 9, 2020; and Ser. No. 16/813,303 filed Mar. 9, 2020, is incorporated herein by reference.

Various terms are used to refer to particular system components. Different entities may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

The terminology used herein is for the purpose of describing particular example embodiments only, and is not intended to be limiting. As used herein, the singular forms "a," "an," and "the" may be intended to include the plural forms as well, unless the context clearly indicates otherwise. The method steps, processes, and operations described herein are not to be construed as necessarily requiring their performance in the particular order discussed or illustrated, unless specifically identified as an order of performance. It is also to be understood that additional or alternative steps may be employed.

The terms first, second, third, etc. may be used herein to describe various elements, components, regions, layers and/or sections; however, these elements, components, regions, layers and/or sections should not be limited by these terms. These terms may be only used to distinguish one element, component, region, layer or section from another region, layer or section. Terms such as "first," "second," and other numerical terms, when used herein, do not imply a sequence or order unless clearly indicated by the context. Thus, a first element, component, region, layer or section discussed below could be termed a second element, component, region, layer or section without departing from the teachings of the example embodiments. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. In another example, the phrase "one or more" when used with a list of items means there may be one item or any suitable number of items exceeding one.

Spatially relative terms, such as "inner," "outer," "beneath," "below," "lower," "above," "upper," "top," "bottom," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

"Haptic feedback" may include, but is not limited to, any movement or activity that is electrically, mechanically, and/or electromechanically generated and capable of being perceived sensorially by a user.

The isometric exercise and rehabilitation equipment of the disclosure may separately measure forces exerted by both the left and right sides of the user to enhance osteogenesis, thereby enabling bone growth. Moreover, one or more haptic devices may be used in the isometric exercise and rehabilitation equipment to provide haptic feedback to the user during an exercise. In some embodiments, the haptic feedback may be provided by the haptic device based on a force measured by a load cell.

Osteogenesis

As typically healthy people grow from infants to children to adults, they experience bone growth. Such, growth, however, typically stops at approximately age 30. After that point, without interventions as described herein, bone loss (called osteoporosis), can start to occur. This does not mean that the body stops creating new bone. Rather, it means that the rate at which it creates new bone tends to slow, while the rate at which bone loss occurs tends to increase.

In addition, as people age and/or become less active than they once were, they may experience muscle loss. For example, muscles that are not used often may reduce in muscle mass. As a result, the muscles become weaker. In some instances, people may be affected by a disease, such as muscular dystrophy, that causes the muscles to become progressively weaker and to have reduced muscle mass. To increase the muscle mass and/or reduce the rate of muscle loss, people may exercise a muscle to cause muscular hypertrophy, thereby strengthening the muscle as the muscle grows. Muscular hypertrophy may refer to an increase in a size of skeletal muscle through a growth in size of its component cells. There are two factors that contribute to muscular hypertrophy, (i) sarcoplasmic hypertrophy (increase in muscle glycogen storage), and (ii) myofibrillar hypertrophy (increase in myofibril size). The growth in the cells may be caused by an adaptive response that serves to increase an ability to generate force or resist fatigue.

The rate at which such bone or muscle loss occurs generally accelerates as people age. A net growth in bone can ultimately become a net loss in bone, longitudinally across time. In an average case, but noting that significant individual variations in age do occur, by the time women are over 50 and men are over 70, net bone loss can reach a point where brittleness of the bones is so great that an increased risk of life-altering fractures can occur. Examples of such fractures include fractures of the hip and femur. Of course, fractures can also occur due to participation in athletics or due to accidents. In such cases, it is just as relevant to have a need for bone growth which heals or speeds the healing of the fracture.

To understand why such fractures occur, it is useful to recognize that bone is itself porous, with a somewhat-honeycomb like structure. This structure may be dense and therefore stronger or it may be variegated, spread out and/or sparse, such latter structure being incapable of continuously or continually supporting the weight (load) stresses experienced in everyday living. When such loads exceed the support capability of the structure at a stressor point or points, a fracture occurs. This is true whether the individual had a fragile bone structure or a strong one: it is a matter of physics, of the literal "breaking point."

Embodiments can provide a means of mitigating or ameliorating bone loss and of healing fractures; and, further, of encouraging new bone growth, thus increasing the density of the structure described hereinabove, thus increasing the load-bearing capacities of same, thus making first or subsequent fractures less likely to occur, and thus improving the individual's quality of life. The process of bone growth itself is referred to as osteogenesis, literally the creation of bone.

Versions can provide a means for mitigating or ameliorating muscle mass loss and weakening of the muscles. Further, embodiments can encourage muscle growth by increasing the muscle mass through exercise. The increased muscle mass may enable a person to exert more force with the muscle and/or to resist fatigue in the muscle for a longer period of time.

In order to create new bone, at least three factors are necessary. First, the individual should have a sufficient intake of calcium, but second, in order to absorb that calcium, the individual should have a sufficient intake and absorption of Vitamin D, a matter problematic for those who have cystic fibrosis, who have undergone gastric bypass surgery or have other absorption disorders or conditions which limit absorption. Separately, supplemental estrogen for women and supplemental testosterone for men can further ameliorate bone loss. On the other hand, abuse of alcohol and smoking can harm one's bone structure. Medical conditions such as, without limitation, rheumatoid arthritis, renal disease, overactive parathyroid glands, diabetes or organ transplants can also exacerbate osteoporosis. Ethical pharmaceuticals such as, without limitation, hormone blockers, seizure medications and glucocorticoids are also capable of inducing such exacerbations. But even in the absence of medical conditions as described hereinabove, Vitamin D and calcium taken together may not create osteogenesis to the degree necessary or possible; or ameliorate bone loss to the degree necessary or possible.

To achieve such a degree of osteogenesis, therefore, one should consider the third factor: exercise. Specifically, one should subject one's bones to a force at least equal to certain multiple of body weight, such multiples varying depending on the individual and the specific bone in question. As used herein, "MOB" means Multiples of Body Weight. It has been determined through research that subjecting a given bone to a certain threshold MOB (this may also be known as a "weight-bearing exercise"), even for an extremely short period of time, one simply sufficient to exceed the threshold MOB, encourages and fosters osteogenesis in that bone.

Further, a person can achieve muscular hypertrophy by exercising the muscles for which increased muscle mass is desired. Strength training and/or resistance exercise may cause muscle tissue to increase. For example, pushing against or pulling on a stationary object with a certain amount of force may trigger the cells in the associated muscle to change and cause the muscle mass to increase.

The subject matter disclosed herein relates to a machine and methods and apparatuses appurtenant thereto, not only capable of enabling an individual, such as an older, less mobile individual or an individual recovering from a fracture, to engage easily in osteogenic exercises, but capable of using predetermined thresholds or dynamically calculating them, such that the person using the machine can be immediately informed through visual and/or other sensorial feedback, that the osteogenic threshold has been exceeded, thus triggering osteogenesis for the subject bone (or bones) and further indicating that the then-present exercise may be terminated, enabling the person to move to a next machine-enabled exercise to enable osteogenesis in a different bone or bones. In some embodiments, the thresholds may pertain to measurements of grip strength that are obtained while the user is performing a grip-strengthening-style exercise.

For those with any or all of the osteoporosis-exacerbating medical conditions described herein, such a machine can slow the rate of net bone loss by enabling osteogenesis to occur without exertions which would not be possible for someone whose health is fragile, not robust. Another benefit of the disclosed techniques, therefore, is enhancing a rate of healing of fractures in athletically robust individuals.

Last, while this discussion has focused purely on osteogenesis, an additional benefit is that partaking in exercises which focus on osteogenesis may, in certain embodiments, also increase muscle strength and, as a physiological system, musculoskeletal strength.

Hypertrophy

Hypertrophy is defined as an increase in volume or bulk of a tissue or organ produced entirely by enlargement of existing cells. Hypertrophy as described herein specifically refers to muscle hypertrophy. The exercises performed using the disclosed apparatus may involve the following types of muscle contractions: concentric contractions (shorten), eccentric contractions (lengthen), and isometric contractions (remain the same).

Bone Exercises and their Benefits

The following exercises achieve bone strengthening results by exposing relevant parts of a user to isometric forces which are selected multiples of body weight (MOB) of the user, a threshold level above which bone mineral density increases. The specific MOB-multiple threshold necessary to effect such increases will naturally vary from individual to individual and may be more or less for any given individual. "Bone-strengthening," as used herein, specifically includes, without limitation, a process of osteogenesis, whether due to the creation of new bone as a result of an increase in the bone mineral density; or proximately to the introduction or causation of microfractures in the underlying bone. The exercises referred to are as follows.

Leg Press

An isometric leg-press-style exercise to improve muscular strength in the following key muscle groups: gluteals, hamstrings, quadriceps, spinal extensors and grip muscles, as well as to increase resistance to skeletal fractures in leg bones such as the femur. In one example, the leg-press-style exercise can be performed at approximately 4.2 MOB or more of the user.

Chest Press

An isometric chest-press-style exercise to improve muscular strength in the following key muscle groups: pectorals, deltoids, and tricep and grip muscles, as well as to increase resistance to skeletal fractures in the humerus, clavicle, radial, ulnar and rib pectoral regions. In one example, the chest-press-style exercise can be performed at approximately 2.5 MOB or more of the user.

Suitcase Lift

An isometric suitcase-lift-style exercise to improve muscular strength in the following key muscle groups: gluteals, hamstrings, quadriceps, spinal extensors, abdominals, and upper back and grip muscles, as well as to increase resistance to skeletal fractures in the femur and spine. In one example, the suitcase-lift-style exercise can be performed at approximately 2.5 MOB or more of the user.

Arm Curl

An isometric arm-curl-style exercise to improve muscular strength in the following key muscle groups: biceps, brachialis, brachioradialis, grip muscles and trunk, as well as to increase resistance to skeletal fractures in the humerus, ribs and spine. In one example, the arm-curl-style exercise can be performed at approximately 1.5 MOB or more of the user.

Core Pull

An isometric core-pull-style exercise to improve muscular strength in the following key muscle groups: elbow flexors, grip muscles, latissimus dorsi, hip flexors and trunk, as well as to increase resistance to skeletal fractures in the ribs and spine. In one example, the core-pull-style exercise can be performed at approximately 1.5 MOB or more of the user.

Grip Strength

A grip-strengthening-style exercise which may be situated around, or integrated with, a station in an exercise machine, in order to improve strength in the muscles of the hand, forearm, or other gripping extremity. Moreover, measurement of grip strength can be taken prior to, during, and/or after the grip-strengthening-style exercise is performed. Grip strength is medically salient because it has been positively correlated with a better state of health. Accordingly, measurements of grip strength can be used to in conjunction with and/or to guide, assist, or enhance the exercise and rehabilitation of a user. Furthermore, a measurement of grip strength during the grip-strengthening-style exercise can be used to provide real-time-feedback to the user. Such real-time-feedback during the grip-strengthening-style exercise can be used to challenge the user to increase a grip strength to further strengthen the muscles of the hand, forearm, or other gripping extremity.

In the following description, details are set forth to facilitate an understanding of the present disclosure. In some instances, certain structures and techniques have not been described or shown in detail in order not to obscure the disclosure.

The following discussion is directed to various embodiments of the present disclosure. Although these embodiments are given as examples, the embodiments disclosed should not be interpreted, or otherwise used, as limiting the scope of the disclosure, including the claims. In addition, one of ordinary skill in the art will understand that the following description has broad application. The discussion of any embodiment is meant only to be exemplary of that embodiment. Thus, the discussion is not intended to intimate that the scope of the disclosure, including the claims, is limited to that embodiment.

Exercise machines can provide isometric exercises to facilitate osteogenesis and muscle hypertrophy. Such exercise machines can include equipment in which there are no moving parts while the user is performing an isometric exercise. While there may be some flexing: (i) under load, (ii) incidental movement resulting from the tolerances of interlocking parts, and (iii) parts that can move while a user performs adjustments on the exercise machines, these flexions and movements can comprise, without limitation, exercise machines capable of isometric exercise and rehabilitation. In addition, such exercise machines may also include equipment or devices including moving parts to provide dynamic exercises to facilitate osteogenesis and muscle hypertrophy. A dynamic exercise can be, but is not limited to, an exercise where a user participates in an activity where the user moves and some resistance or load is provided against the movement of the user.

Reference will now be made in detail to representative embodiments illustrated in FIGS. 1-27. It should be understood that the following descriptions are not intended to limit the embodiments. To the contrary, it is intended to cover alternatives, modifications, and equivalents that can be included within the spirit and scope of the embodiments exemplified by the appended claims.

In the following detailed description, references are made to the accompanying drawings, which form a part of the description and in which are shown, by way of illustration, examples in accordance with the embodiments. Although these embodiments are described in sufficient detail to enable one skilled in the art to practice the embodiments, it is understood that these examples are not limiting such that still other embodiments may be used, and changes may be made without departing from the spirit and scope of the embodiments.

The following disclosure relates to an exercise system that can include exercise machines that can releasably couple together to provide a combination of exercise functions. To promote additional combinations of exercise functions, the exercise systems described herein may include at least two exercise machines that can decouple from each other and subsequently couple to still other exercise machines. In this regard, an "exercise system" may be referred to as "an exercise assembly" of two or more exercise machines that can be linked together. Further, an "exercise machine" may be described as a modular exercise unit, or simply an exercise unit, that includes one or more structural components, with each structural component providing an exercise function. A "structural component" may be referred to, for example, as a handle system or a base to engage a user.

Some exercise machines are designed for osteogenesis. Accordingly, some exercise machines are osteogenic devices designed to promote bone development, or bone growth, of a user. An osteogenic device may include a handle system for user interaction. As an example, the handle system can provide the user with a structure against which the user can apply force to promote bone growth or development. Some osteogenic devices can promote growth in a specific group of bones, while other osteogenic devices can promote growth in a different group of bones.

Some exercise machines are designed for muscle hypertrophy, or muscular growth or generation. Accordingly, some exercise machines are muscle development devices, or muscle-building devices. The muscle-building devices may include foot pedals designed for cardiovascular, or aerobic, conditioning. Other muscle-building devices may include hand pedals designed for cardiovascular, or aerobic, conditioning. Some muscle-building devices may include a combination of foot pedals and hand pedals. Alternatively, the muscle-building devices may include a handle system (or systems) designed for training muscle groups, such as the pectoralis ("chest") muscles, biceps brachii ("biceps") muscles, latissimus dorsi ("upper back") muscles, and/or quadriceps femoris ("quad") muscles.

When an osteogenic device is coupled to a muscle-building device, the exercise system advantageously provides a user with a variety of exercises capable of training/conditioning the user in different ways. Moreover, the osteogenic device can decouple from the muscle-building device and couple to another, different muscle-building device, thereby forming an exercise system with a different set of equipment. Similarly, when decoupled from the osteogenic device, the muscle-building device can couple to another, different osteogenic device to form an exercise system with still other equipment. As a result, exercise systems described herein can provide a user with various combinations of equipment.

In addition, at least one of the exercise machines may include a seat assembly that can be used with either exercise machine of the exercise system. Accordingly, while the seat assembly is mechanically integrated with one of the exercise machines, the seat assembly can be oriented in different manners. For example, the seat assembly can move along a rail, or track. Further, the seat assembly can rotate relative to the rail (and the exercise machines) so that the seat assembly can face either exercise machine. In addition to orienting the user with respect to equipment, the seat assembly can be used to perform exercise functions, such as muscle-building exercises that include exercising/training rectus abdominus ("abdominal") muscles, erector spinae ("lower back") muscles, and/or external oblique muscles, as non-limiting examples.

Also, at least one of the exercise machines may include a computing system. The computing system may include a display that provides the user with information. When two exercise machines of an exercise system are coupled together, the computing system can be in communication with both exercise machines. In this regard, the coupling between exercise machines may include both mechanical and electrical couplings.

In addition to providing osteogenic and muscle hypertrophy functions, some exercise machines can include rehabilitation functions. For example, in some embodiments, the cycling pedals can be selectively locked to prevent their rotational movement, thereby isolating movement of at least one of the user's legs or arms. Moreover, the radial position of the pedals can be adjusted relative to the axis of rotation, thereby reducing the torque required to rotate one of the cycling pedals.

These and other embodiments are discussed below with reference to FIGS. 1-27. However, those skilled in the art will readily appreciate that the detailed description given herein with respect to these drawings is for explanatory purposes only and should not be construed as limiting.

FIG. 1 illustrates a side view of an embodiment of an exercise system 10, in accordance with some embodiments. The exercise system 10 can provide two or more exercise functions, including osteogenesis and muscle hypertrophy. As shown, the exercise system 10 may include an exercise machine 12*a* coupled to another exercise machine 12*b*. In some embodiments, the exercise machine 12*a* is an osteogenic device and the exercise machine 12*b* is a muscular hypertrophy device. The exercise machines 12*a*, 12*b* can provide different exercise functions, which will be described below.

To increase versatility and provide different exercise functions, the exercise system 10 can comprise modular exercise machines that couple to and decouple from each other, which can be subsequently coupled to other exercise machines. The exercise machines 12*a*, 12*b* can be coupled together at a connection 14, such as a joint. The exercise machines 12*a*, 12*b* can decouple from each other at the connection 14, thereby enabling the exercise machines 12*a*, 12*b* to couple with a different exercise machine (not shown in FIG. 1). Accordingly, the exercise system 10 may include the exercise machine 12*a* coupled to a different exercise machine.

The exercise machine 12*a* can include a base 16 or platform, and a frame 18 that connects to and extends from the base 16. The frame 18 may be perpendicular or substantially perpendicular to the base 16. Also, the frame 18 may be arched. However, other shapes and/or configurations are possible. The exercise machine 12*a* can further include multiple handle systems coupled to the frame 18. Each handle system can provide one or more exercise functions or exercise activities. For example, the exercise machine 12*a* can include a handle system 20*a*. When deployed, the handle system 20*a* can enable a user to grasp, and push or pull (while grasping) to promote bone development of bones of the user. The handle system 20*a* can be rotationally coupled to the frame 18 by a pivot mechanism 22*a* rotationally coupled to the frame 18. The phrase "rotationally coupled" refers to rotational movement by one structure relative to another structure. The rotational coupling enables the handle system 20*a* to be deployed at selected positions, and can be locked into place when the desired position is achieved.

The exercise machine 12*a* can further include a handle system 20*b*. When deployed, the handle system 20*b* can enable a user to grasp and pull to promote osteogenesis. The handle system 20*b* can be rotationally coupled to the frame 18 by a pivot mechanism 22*b* rotationally coupled to the frame 18, and the handle system 20*b* can be locked into place by the user. Based on their respective positions, the handle systems 20*a*, 20*b* can promote osteogenesis for the user.

The exercise machine 12*a* can further include a seat assembly 26 configured to support a user during use thereof. The exercise machine 12*a* further includes a rail 28 or track that can be coupled to the base 16 and the frame 18. In some embodiments, the rail 28 is coupled only to the base 16. The seat assembly 26 can be coupled to the rail 28, and can traverse along the rail 28 in one or more directions (as indicated by the two-sided arrow 27). This system can position the user in a desired manner relative to the handle systems 20*a*, 20*b*, as a non-limiting example. The rail 28 can be coupled to the base 16 by a riser 29. Further, the base 16 may be used as a foot plate or foot rest by the user. The riser 29 can position the rail 28 over or at least partially over the foot plate.

The seat assembly 26 can include a seat rest 30 on which a user can sit. The seat assembly 26 can further include a seat back 32 that can extend from the seat rest 30 and provide additional support for the user. The seat back 32 includes multiple portions or components that can be rotationally coupled to each other to promote exercise functions. For example, the seat back 32 includes a portion 34*a*, or first portion, rotationally coupled to a portion 34*b* or to a second portion. To perform an exercise that promotes muscle growth of the abdominal muscles of a user, the portion 34*a* can rotate relative to the portion 34*b*. The seat assembly 26 can include a handle system 20*c* that can be gripped by a user during an abdominal muscle exercise. To perform an exercise that promotes muscle growth of the back muscles ("back extensions") of a user, the portions 34*a*, 34*b* can rotate relative to the seat rest 30. Accordingly, the exercise machine 12*a*, while providing various osteogenic benefits, also can promote muscular development. The seat assembly 26 includes a handle system 20*d* that can be gripped by a user during a back muscle exercise. Also, the seat rest 30 and the seat back 32 may include one or more cushions that provide comfort and support to a user.

The exercise machine 12*a* can further include foot plates 36 designed to engage the feet of the user. Although a single foot plate is shown, the foot plates 36 may include two foot plates. Further, the seat assembly 26 can be positioned on the rail 28 such that a user seated on the seat assembly 26 also is engaged (by the user's feet) with the foot plates 36. Accordingly, the seat assembly 26 is movable to accommodate users of different heights. To promote leg bone development in the user, the feet of the user can push against the foot plates 36.

The exercise machine 12*a* can further include a computing system 40*a* designed to monitor user activity during use of the exercise machine 12*a*. The computing system 40*a* can be rotationally coupled to the frame 18 by a pivot mechanism 22*c* that allows the computing system 40*a* to move relative to the frame 18. Although not shown, the computing system 40*a* may include processor circuits in communication with exercise monitoring devices (such as sensors and/or ergometers) of the exercise machines 12*a*, 12*b*. Further, the processor circuits can be configured to execute one or more software applications stored on a memory circuit. The software applications can present and/or display user activity on a display (not shown in FIG. 1) of the computing system 40*a*. Also, in some embodiments, the seat assembly 26 can include a motorized seat assembly that can be controlled (i.e., moved and/or rotated) through the computing system 40*a*.

The exercise machine 12*b* may include a muscle-building device. As a non-limiting example, the exercise machine 12*b* can be designed for cardiovascular, anaerobic or aerobic exercises. In this regard, the exercise machine 12*b* may include a cycling apparatus 50 that includes foot pedals 52*a*, 52*b* that can be rotationally driven by a user's legs in a manner similar to a bicycle being driven. The cycling apparatus 50 can be located on a base 56 and/or a frame 58 of the exercise machine 12*b*. The exercise machine 12*b* can further include a hand-pedaling apparatus 60 that includes multiple hand pedals that can be rotationally driven by a user's hands. Also, the hand-pedaling apparatus 60 can be secured to a post 62. In some embodiments, the post 62 can be removable from the frame 58, and one or more additional features can be integrated with the exercise machine 12*b*. Due in part to the various exercise functions provided by the exercise machine 12*b*, it may be referred to as a cardiovascular exercise machine or a cardiovascular exercise unit.

The exercise machine 12*b* can further include a computing system 40*b* that can include any feature described for the computing system 40*a* of the exercise machine 12*a*. If desired, information can be transferred by wired communication established when the exercise machine 12*a* is coupled with the exercise machine 12*b*. Alternatively, each of the computing systems 40*a*, 40*b* may include components designed for communication via any number of wireless communication protocols, including at least one of a IEEE 802.11 protocol)(WI-FI®, BLUETOOTH®, a global network (e.g., the Internet), a wide area network, a local area network, a wireless personal area network (WPAN), or NFC protocol, as non-limiting examples.

As shown in FIG. 1, the handle systems 20*a*, 20*b* and the computing system 40*a* can include a deployed configuration (available for use) while the hand-pedaling apparatus 60 and the computing system 40*b* are in a stored configuration. Also, the seat assembly 26 can be positioned for user interaction with the handle systems 20*a*, 20*b* and the computing system 40*a*. However, the computing system 40*b* and the hand-pedaling apparatus 60 can be deployed for user interaction. Also, the seat assembly 26 can be rotated for user interaction with the computing system 40*b*, the cycling apparatus 50, and the hand-pedaling apparatus 60.

Figure 2:
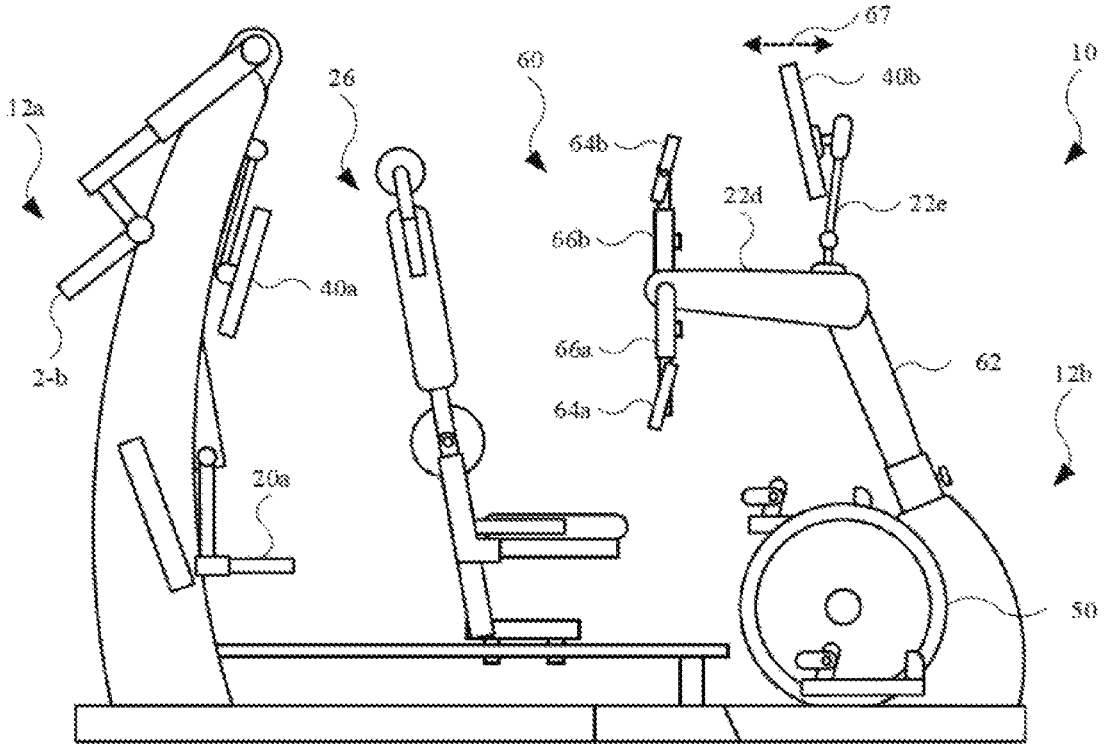
FIG. 2 illustrates a side view of the exercise system shown in FIG. 1, showing the seat assembly rotated to face the exercise machine.

FIG. 2 illustrates a side view of the exercise system 10 shown in FIG. 1, showing the seat assembly 26 rotated to face the exercise machine 12*b*. As shown, the computing system 40*b* and the hand-pedaling apparatus 60 are in a deployed configuration (available for use), and the handle systems 20*a*, 20*b* and the computing system 40*a* are in a stored configuration. The hand-pedaling apparatus 60 is rotationally coupled to the post 62 by a pivot mechanism 22*d*. The hand-pedaling apparatus 60 may include hand pedals 64*a*, 64*b* coupled to posts 66*a*, 66*b*, respectively. Also, the posts 66*a*, 66*b* may each include a telescoping post that can adjust the positions of the hand pedals 64*a*, 64*b*, respectively.

The computing system 40*b* can be rotationally coupled to the pivot mechanism 22*d* by a pivot mechanism 22*e*. Moreover, the computing system 40*b* and the pivot mechanism 22*e* can traverse along the pivot mechanism 22*d* in one or more directions (as indicated by the two-sided arrow 67) to position the computing system 40*b* in a desired manner.

Figure 3:
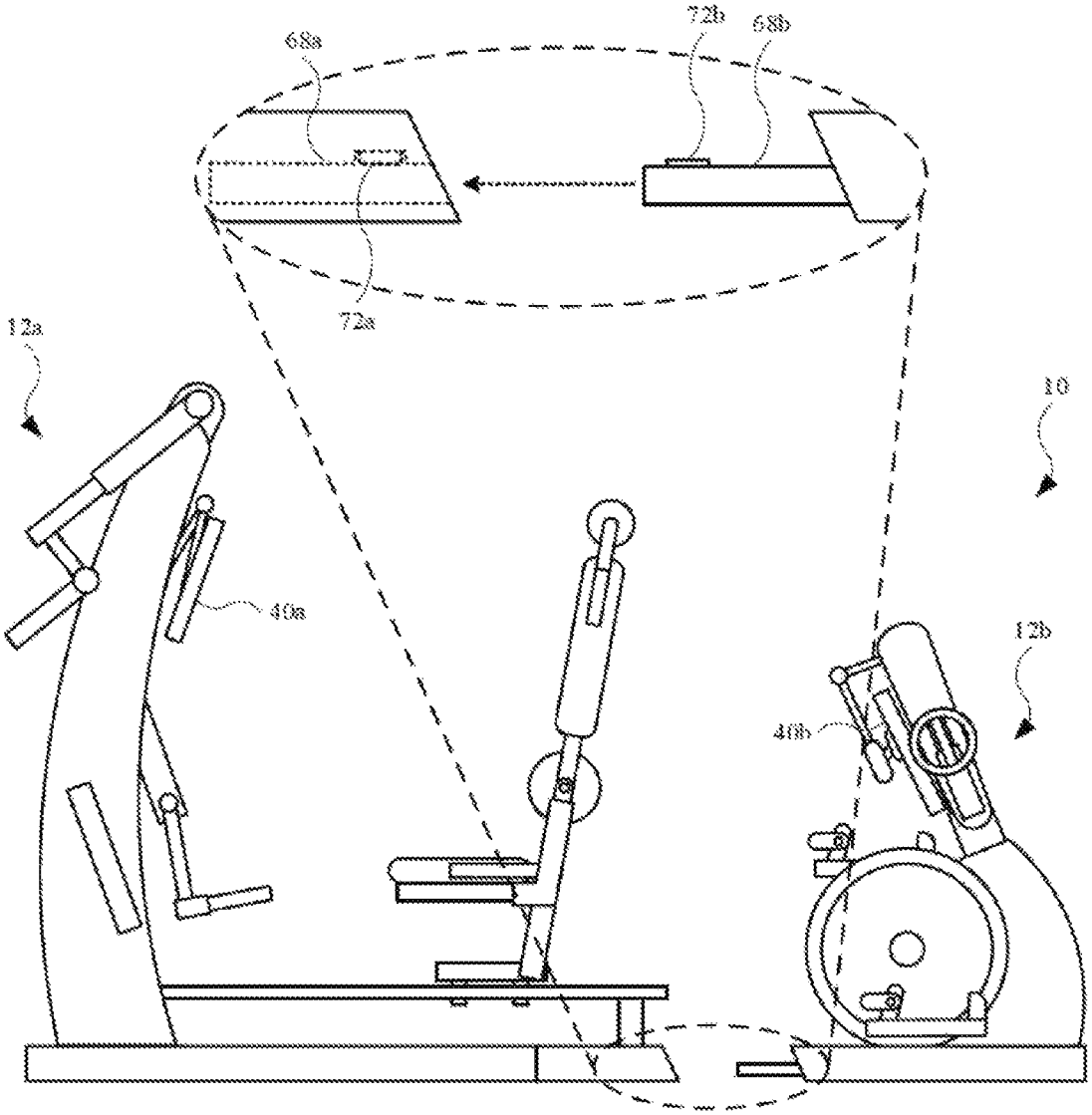
FIG. 3 illustrates a side view of the exercise system shown in FIG. 1, showing the exercise machine decoupled, or removed, from the exercise machine.

FIG. 3 illustrates a side view of the exercise system 10 shown in FIG. 1, showing the exercise machine 12*a* decoupled or removed from the exercise machine 12*b*. As shown in the enlarged view, the exercise machine 12*a* may include coupling mechanisms 68*a*, 68*b*. The coupling mechanism 68*a* may include a slot, while the coupling mechanism 68*b* may include an extension or protrusion. The coupling mechanism 68*b* can enter the coupling mechanism 68*a* to form a mechanical coupling between the exercise machine 12*a* and the exercise machine 12*b*. Also, the exercise machine 12*a* may include a connector 72*a* located in or near the coupling mechanism 68*a*, and the exercise machine 12*b* may include a connector 72*b* located on the coupling mechanism 68*b*. The connectors 72*a*, 72*b* can couple to each other to form an electrical connection between the exercise machines 12*a*, 12*b*, thereby establishing communication between the computing systems 40*a*, 40*b*. With the communication, the computing system 40*a* can send/receive information to/from the computing system 40*b*, and vice-versa.

Figure 4:
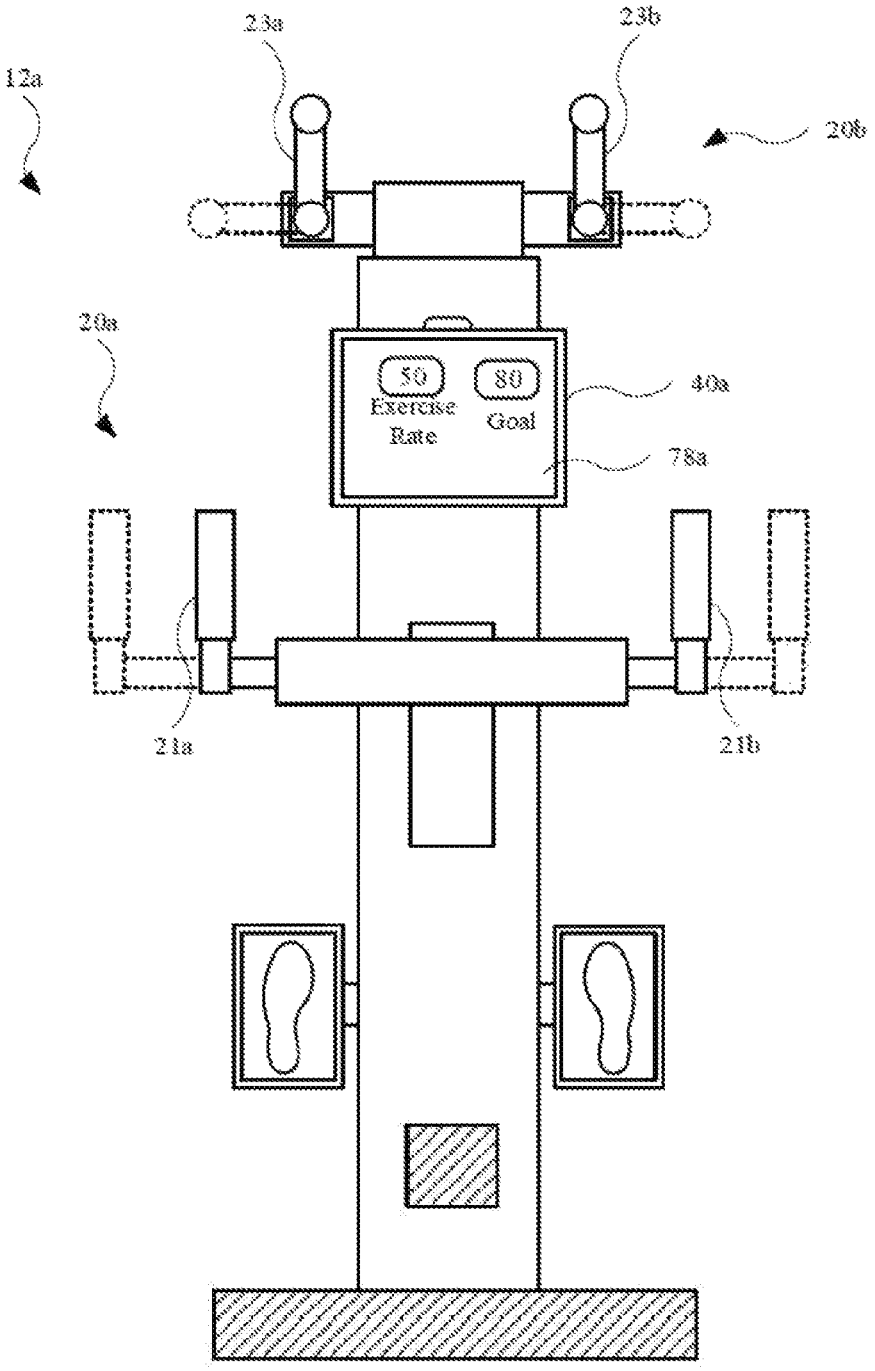
FIG. 4 illustrates an alternate side view of the exercise machine, showing various features of the handle system.

FIG. 4 illustrates an alternate side view of the exercise machine 12*a*, showing various features of the handle system 20*a* of the exercise machine 12*a*. As shown, the handle system 20*a* includes handlebars 21*a*, 21*b*, which can also be referred to as first and second handlebars, respectively. In a first position (or contracted position), a first distance between the handlebars 21*a*, 21*b* is relatively narrow. However, in a second position (or extended position), represented by dotted lines, the distance between the handlebars 21*a*, 21*b* is greater than the first distance. The handle system 20*b* can include handlebars 23*a*, 23*b*, which also can be referred to as first and second handlebars, respectively. In a first position (or upright position or vertical position), the distance between the handlebars 23*a*, 23*b* is relatively narrow. However, in a second position (or lateral position or horizontal position), represented by dotted lines, the distance between the handlebars 23*a*, 23*b* is greater than the first distance. Accordingly, the handle system 20*a* can provide two or more positions, which has the advantage of accommodating users of different sizes as well as changing the angle at which each user exercises. Regarding the latter, the angle can determine the emphasis with which certain muscle groups are trained/conditioned.

The computing system 40*a* also can include a display 78*a*. The display 78*a* may include a touch input display that uses a capacitive touch system to locate a user input to the display 78*a*. Alternatively, or in combination, the computing system 40*a* may include controls (not shown in FIG. 4), in the form of buttons and/or switches, used to provide inputs to alter the information presented on the display 78*a*. As shown, the display 78*a* may present visual information in the form of a software application. The software application may include an exercise or fitness application used in conjunction with various exercise functions associated with the handle system 20*b*.

Figure 5:
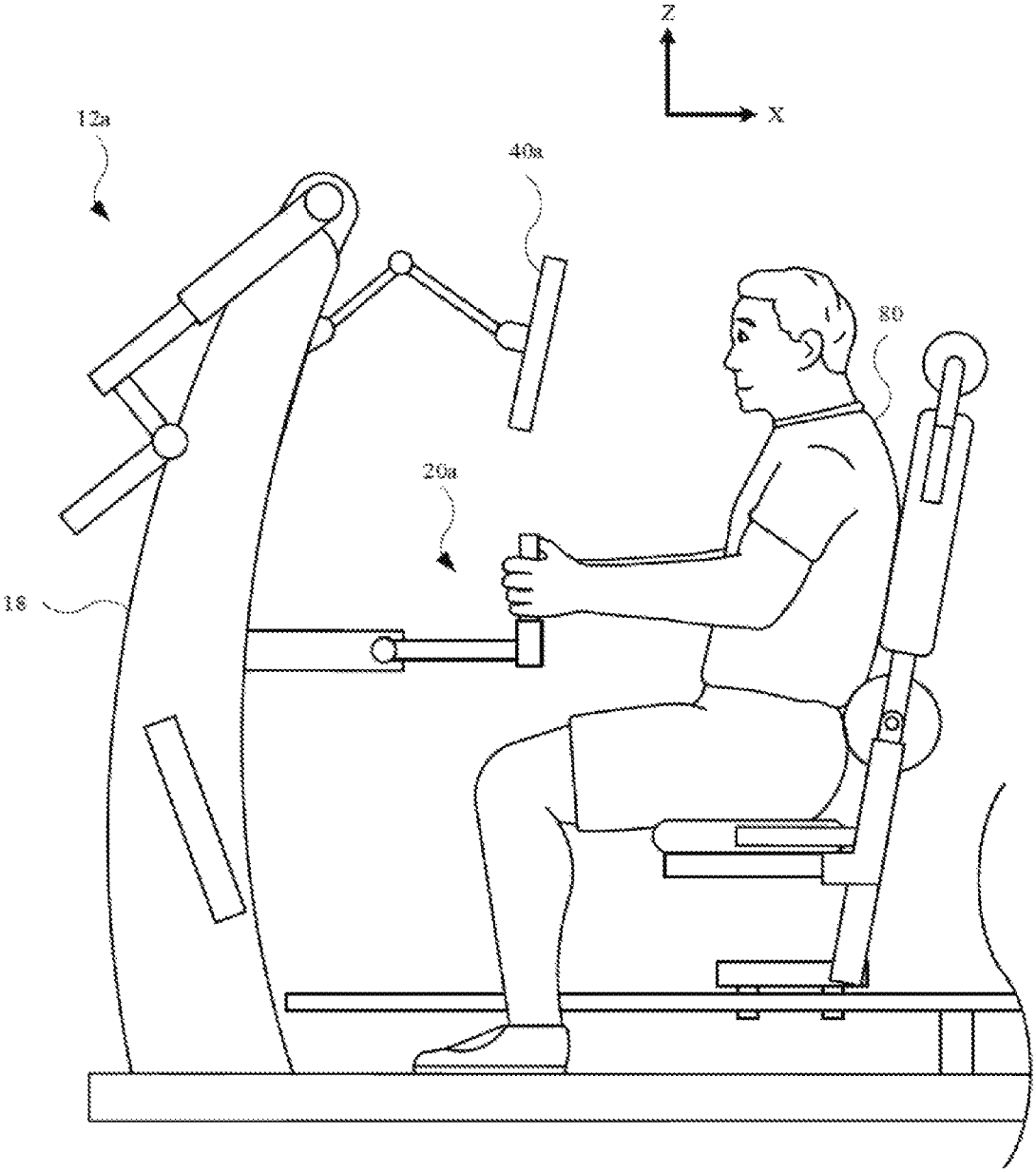
FIG. 5 illustrates a user interacting with the handle system shown in FIG. 4, in accordance with some embodiments.

FIG. 5 illustrates a user 80 interacting with the handle system 20*a* of the exercise machine 12*a* shown in FIG. 4, in accordance with some embodiments. The user 80 can grip the handle system 20*a* while providing a pushing force against the frame 18 in a direction along the X-axis (of a Cartesian coordinate system). This can promote osteogenesis in the arms and/or chest of the user. Although not shown, the exercise machine 12*a* may include a sensing mechanism that monitors the user-provided force to the handle system 20*a*. The sensing mechanism(s) may include an ergometer or one or more sensors (mechanical or solid state sensors). The handle system 20*a* may remain static or generally stationary during osteogenesis. However, the sensing mechanism can detect the amount of user-provided pushing force to the handle system 20*a*, and provide an input to the computing system 40*a* corresponding to the amount of the user-provided pushing force.

Alternatively, the user 80 can provide a pulling force in a direction away from the frame 18 along the X-axis, thereby promoting osteogenesis in the arms and/or chest. In this regard, the sensor(s) can monitor the user-provided pulling force, and provide an input to the computing system 40*a* indicating the amount of the pulling force. Similarly, when the user 80 achieves or exceeds a threshold pulling force, the computing system 40*a* can notify the user 80 on the display 78*a* (labeled in FIG. 4), indicating to the user 80 that muscular hypertrophy and/or osteogenesis is achieved.

Figure 6:
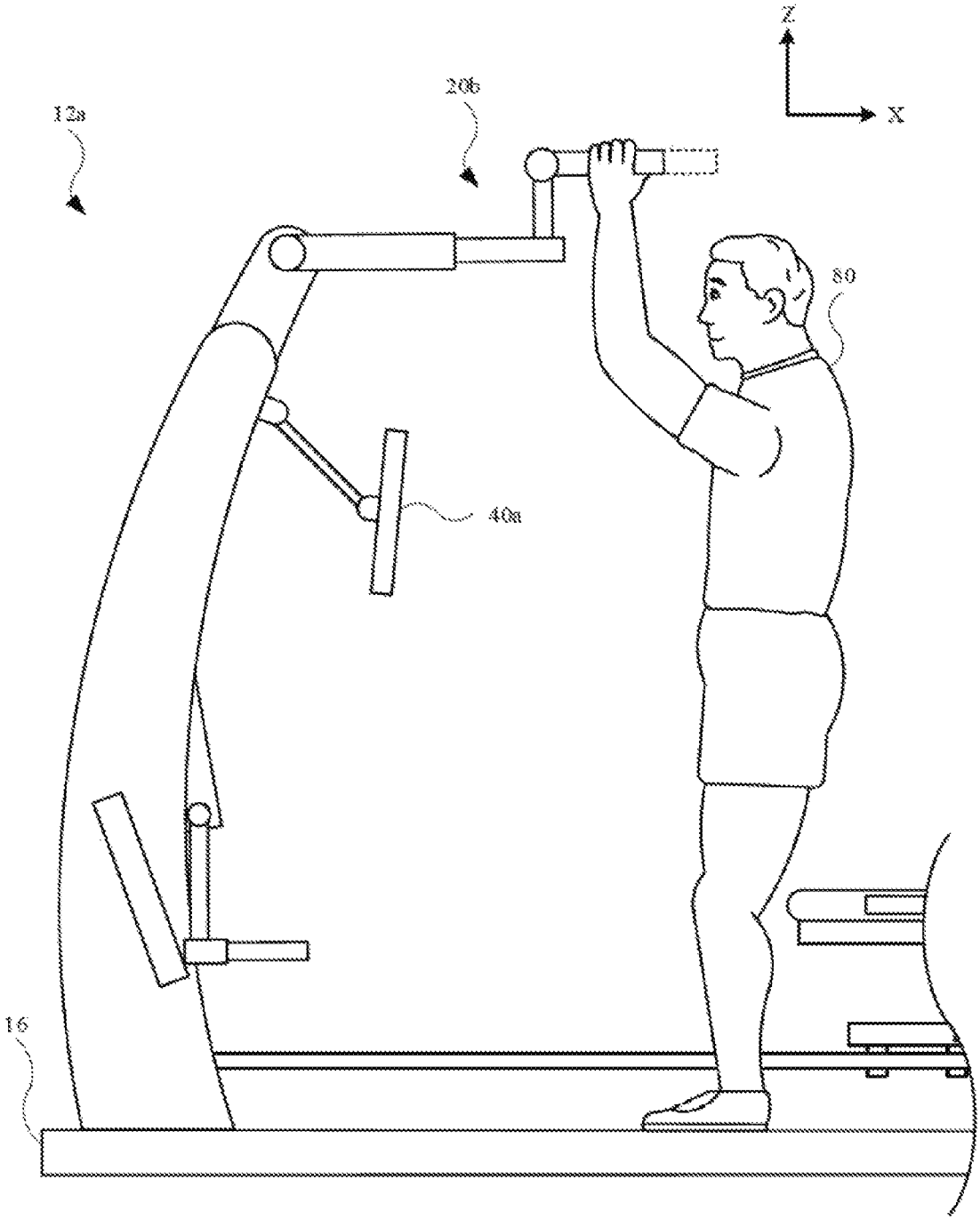
FIG. 6 illustrates a user interacting with the handle system, in accordance with some embodiments.

FIG. 6 illustrates a user 80 interacting with the handle system 20*b*, in accordance with some embodiments. As shown, the user 80 can stand on the base 16. In this regard, the base 16 may define a foot pad for the user 80. The user 80 can grasp the handle system 20*b* while providing a pulling force toward the base 16 in a direction along the Z-axis, thereby promoting osteogenesis in the arms and/or back. Although not shown, the exercise machine 12*a* may include an additional sensing mechanism, or mechanisms (similar to the sensing mechanism(s) previously described), capable of providing an input (corresponding to the user-provided force) to the computing system 40*a* indicating the amount of the pulling force. The handle system 20*b* may remain static or generally stationary. However, the sensing mechanism can detect the amount of user-provided pulling force to the handle system 20*b*, and provide an input to the computing system 40*a* corresponding to the amount of the user-provided pulling force.

Figure 7:
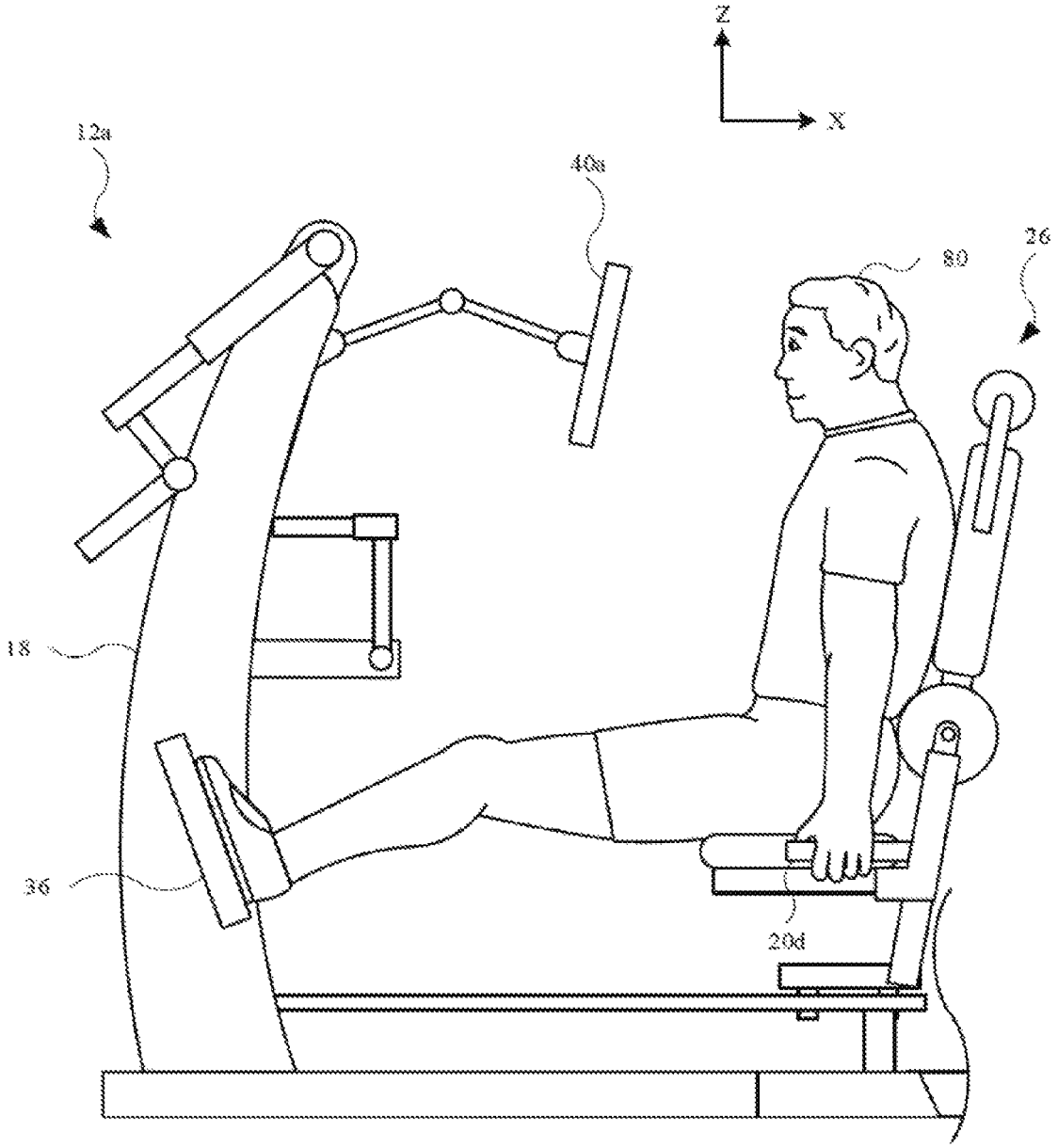
FIG. 7 illustrates a user interacting with the foot plates of the exercise machine, in accordance with some embodiments.

FIG. 7 illustrates a user 80 interacting with the foot plates 36 of the exercise machine 12*a*, in accordance with some embodiments. The user 80 can grip the handle system 20*d*, located on the seat assembly 26, while providing a pushing force away from the frame 18 in a direction along the Z-axis, thereby exercising the leg muscles of the user 80. Although not shown, the exercise machine 12*a* may include an additional sensing mechanism, or mechanisms (similar to the sensing mechanism(s) previously described), capable of providing an input (corresponding to the user-provided force) to the computing system 40*a* indicating the amount of the pushing force. To promote osteogenesis, the seat assembly 26 may remain static, or generally stationary during exercise by the user 80. However, the sensing mechanism can detect the amount of user-provided pushing force to the seat assembly 26, and provide an input to the computing system 40*a* corresponding to the amount of the user-provided force.

Figure 8:
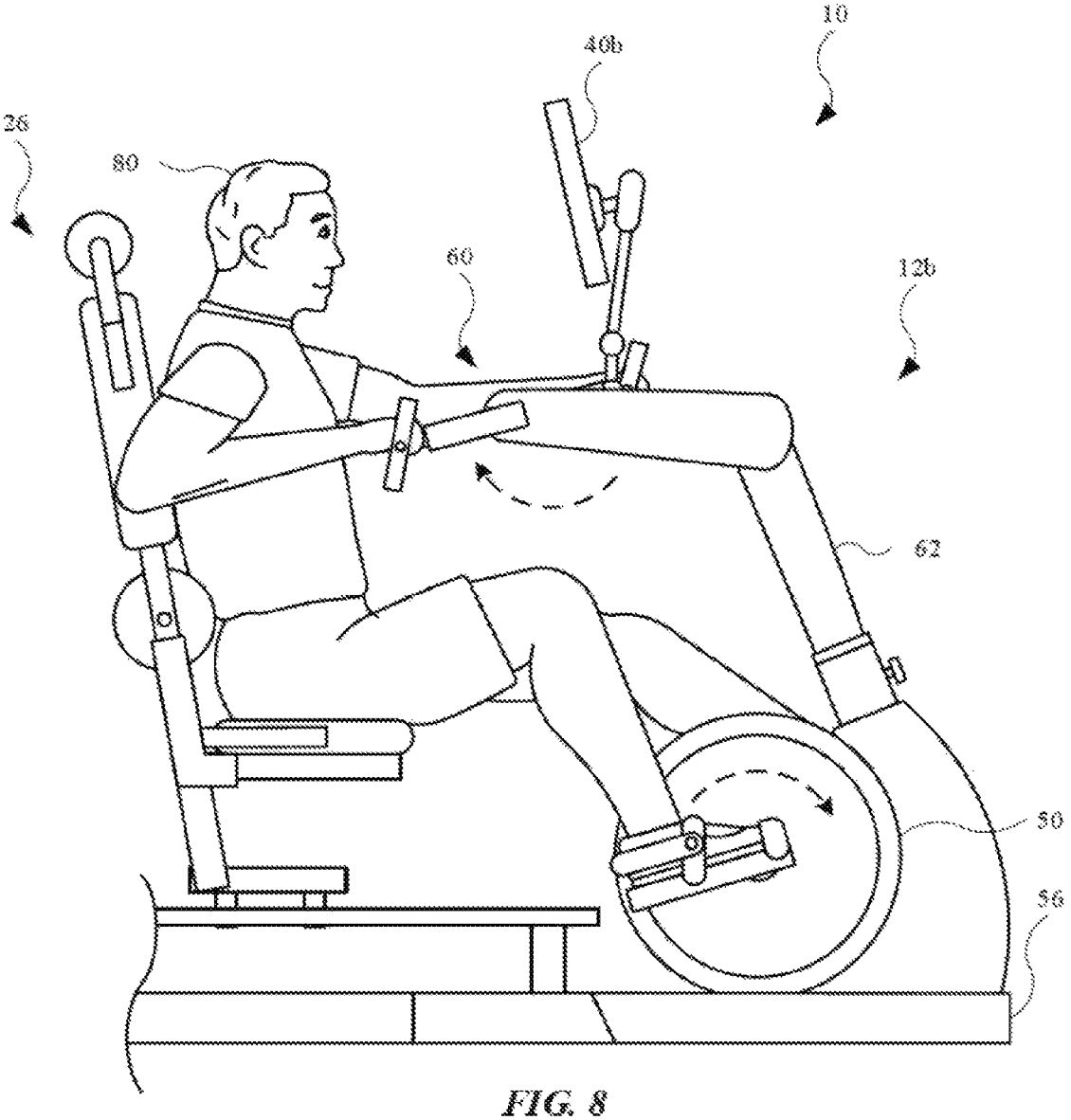
FIG. 8 illustrates a side view of the exercise system shown in FIG. 1, showing the various features of the exercise system, in accordance with some embodiments.

FIG. 8 illustrates a side view of the exercise system 10 shown in FIG. 1, showing the various features of the exercise machine 12*b*, in accordance with some embodiments. As shown, the seat assembly 26 can be rotated away from the exercise machine 12*a* (not shown in FIG. 8) and toward the exercise machine 12*b*. As a result, the user 80 can sit on the seat assembly 26 and interact with the cycling apparatus 50 and the hand-pedaling apparatus 60. As shown, the user 80 can pedal the cycling apparatus 50 and the hand-pedaling apparatus 60 in a clockwise direction. However, a counterclockwise pedaling direction is also possible. Further, the user 80 can use the computing system 40*b* to monitor exercise activity. To provide an adjustment (such as the height of the hand-pedaling apparatus 60), the post 62 can be moved toward or away from the base 56.

Figure 9:
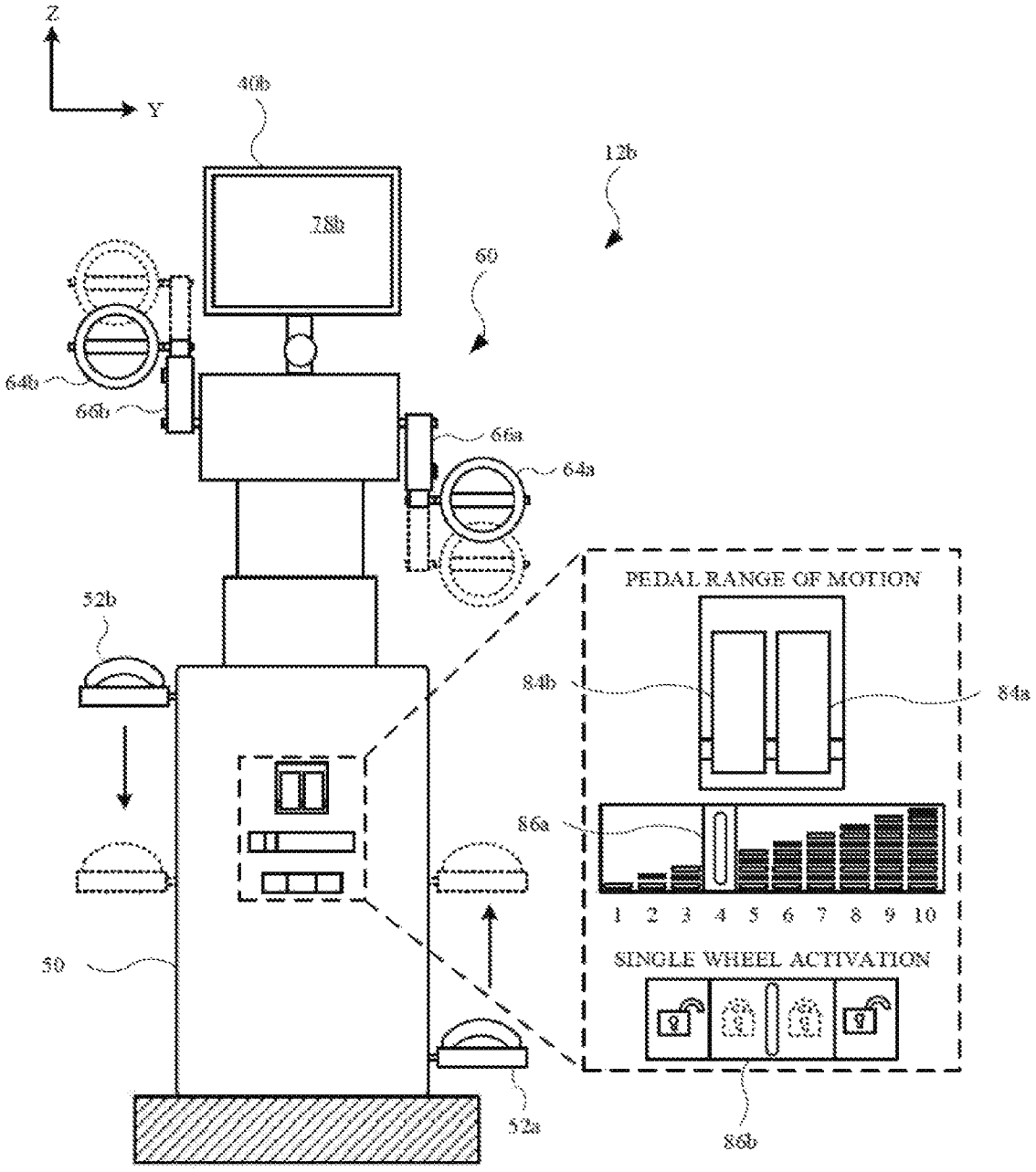
FIG. 9 illustrates an alternate view of the exercise machine shown in FIG. 8, showing various features of the exercise machine.

FIG. 9 illustrates an alternate side view of the exercise machine 12*b* shown in FIG. 8, showing various features of the exercise machine 12*b*. As shown, the cycling apparatus 50 can enable the foot pedals 52*a*, 52*b* to be repositioned along the Z-axis, as indicated by the dotted lines. By so repositioning the foot pedals 52*a*, 52*b*, the torque required to rotate the foot pedals 52*a*, 52*b* changes. As a result, a user (not shown in FIG. 9) can modify the activity level required to operate the cycling apparatus 50. Moreover, the foot pedals 52*a*, 52*b* can be individually adjusted. In other words, the foot pedal 52*a* can be adjusted relative to the foot pedal 52*b*, or vice-versa. As a result, the torque required to rotationally drive one foot pedal may be different than that required to rotationally drive the other foot pedal. For example, when the foot pedal 52*a* is located in a position corresponding to the dotted line and the foot pedal 52*b* is not adjusted, the foot pedal 52*a* requires less torque (to rotationally drive the foot pedal 52*a*) as compared to the foot pedal 52*b*. This can promote rehabilitation to the leg of the user engaged with the foot pedal 52*a*, as less exertion is required by the leg to rotationally drive the foot pedal 52*a*. Meanwhile, the user can continue to operate the foot pedal 52*b* in a normal manner (i.e., not under rehabilitation conditions). Although not shown, the foot pedals 52*a*, 52*b* can be repositioned on the cycling apparatus 50 in multiple, non-discrete locations, and not just limited to what is shown in FIG. 9.

Similarly, the hand-pedaling apparatus 60 allows the hand pedals 64*a*, 64*b* to be repositioned along the Z-axis, as indicated by the dotted lines. In this regard, the posts 66*a*, 66*b* may include telescoping posts (as a non-limiting example) capable of repositioning the hand pedals 64*a*, 64*b*, respectively. By repositioning the hand pedals 64*a*, 64*b*, the torque required to rotate the hand pedals 64*a*, 64*b* changes. As a result, a user can modify the activity level required to operate the hand-pedaling apparatus 60. Moreover, the hand pedals 64*a*, 64*b* can be individually adjusted relative to each other. Accordingly, the torque required to rotationally drive one hand pedal may be different than that required to rotationally drive the other hand pedal. For example, when the hand pedal 64*a* is located in a position corresponding to the dotted line and the hand pedal 64*b* is not adjusted, the hand pedal 64*a* requires less torque (to rotationally drive the hand pedal 64*a*) as compared to the hand pedal 64*b*. This can promote rehabilitation to the arm of the user engaged with the hand pedal 64*a*, as less exertion is required by the arm to rotationally drive the hand pedal 64*a*. Meanwhile, the user can continue to operate the hand pedal 64*b* in a normal manner (i.e., not under rehabilitation conditions). Although not shown, the hand pedals 64*a*, 64*b* can be repositioned on the hand-pedaling apparatus 60 in multiple, non-discrete locations. Also, it should be further noted that the display 78*b* of the computing system 40*b* can present a software application that shows the torque generated by the user for both the hand pedals and the foot pedals. Accordingly, in addition to muscular hypertrophy, the exercise machine 12*b* can also promote rehabilitation.

Embodiments of the exercise machine 12*b* can include several controls. For example, as shown in the enlarged view, the exercise machine 12*b* can include levers 84*a*, 84*b* used to control the range of motion of the pedals 52*a*, 52*b*, respectively. In other words, the levers 84*a*, 84*b* can control the radial position of the pedals 52*a*, pedal 52*b*, respectively, on the cycling apparatus 50. The exercise machine 12*b* can further include a switch 86*a* that can be operated by a user to adjust the resistance provided by the cycling apparatus 50 to the pedals 52*a*, 52*b*. In addition, the exercise machine 12*b* can include a switch 86*b* that can be operated by a user to lock or unlock the pedals. For example, as shown in FIG. 9, both the pedals 52*a*, 52*b* are unlocked. However, the switch 86*b* can be actuated in one direction to lock the pedal 52*a*, and subsequently be actuated in another, opposing direction to lock the pedal 52*b*. As a result, one of the pedals 52*a*, 52*b* can be immobilized while the other pedal is free to move. This may further promote rehabilitation and recovery of the leg engaged with the immobilized pedal.

Figure 10:
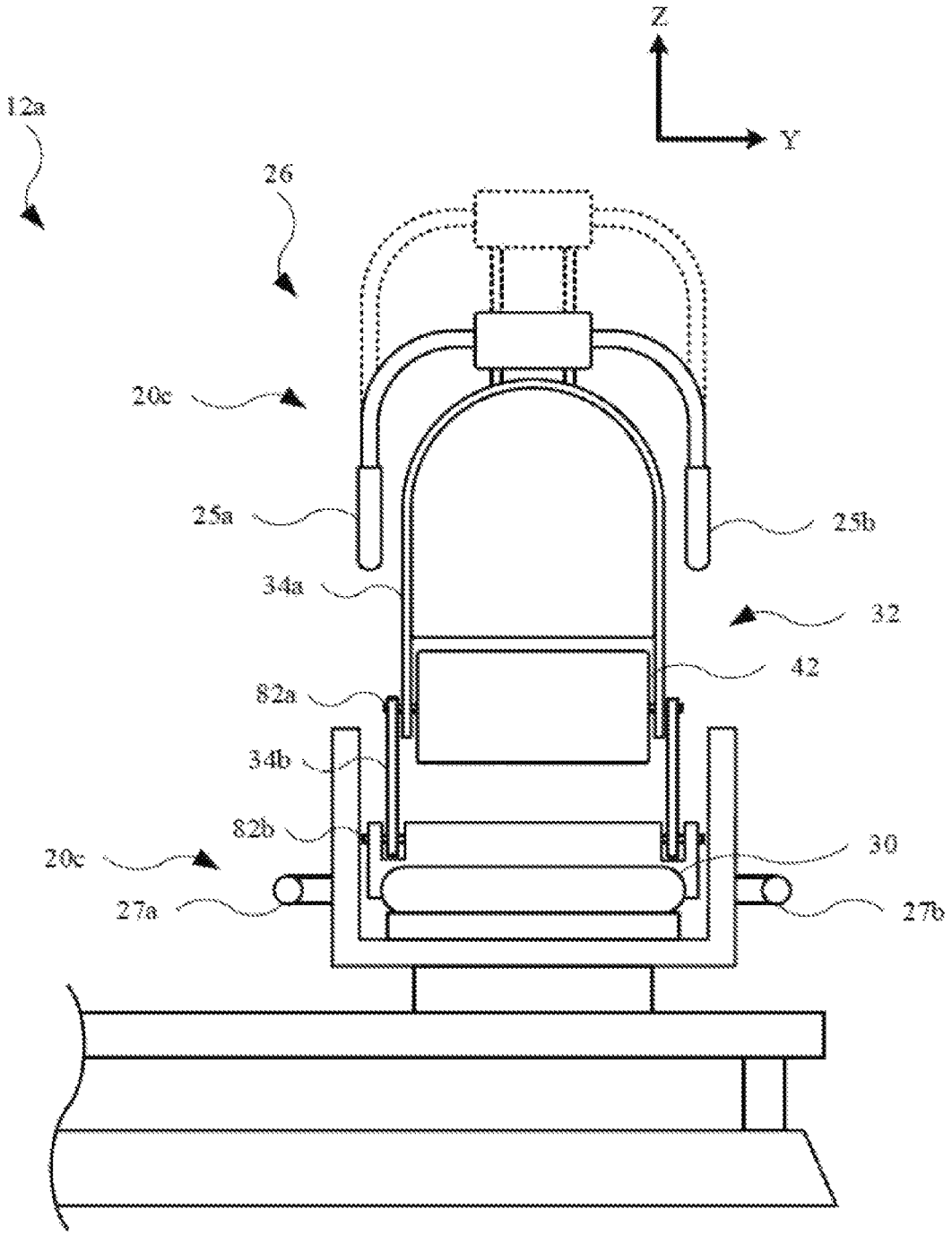
FIG. 10 illustrates a front view of the seat assembly, in accordance with some embodiments.

FIG. 10 illustrates a front view of the seat assembly 26, in accordance with some embodiments. Although the seat assembly 26 is mechanically integrated with the osteogenic device defined by the exercise machine 12*a*, in some embodiments, the seat assembly 26 is mechanically integrated with a muscular hypertrophy device defined by the exercise machine 12*b* (shown in FIG. 1). As shown, the handle system 20*c* of the seat assembly 26 can include handlebars 25*a*, 25*b*. The handle system 20*c* is adjustable, and can move relative to the seat back 32 along the Z-axis. Accordingly, the handle system 20*c* can adjust based on the user. Also, the handle system 20*d* of the seat assembly 26 can include handlebars 27*a*, 27*b*.

To incorporate dynamic movement and provide additional exercise functions to the exercise machine 12*a*, the seat assembly 26 may include multiple pivot points. For example, the seat assembly 26 may include a pivot point 82*a* that allows the portion 34*a* of the seat back 32 to rotate relative to the portion 34*b* of the seat back 32. The seat assembly 26 may further include a pivot point 82*b* that allows the portions 34*a*, 34*b* to rotate relative to the seat rest 30. The pivot points 82*a*, 82*b* each may be defined in part by a rod or cylindrical element. Also, the seat assembly 26 may include a cushion 42 (including a cylindrical cushion) that surrounds and covers the pivot point 82*a*.

Figure 11:
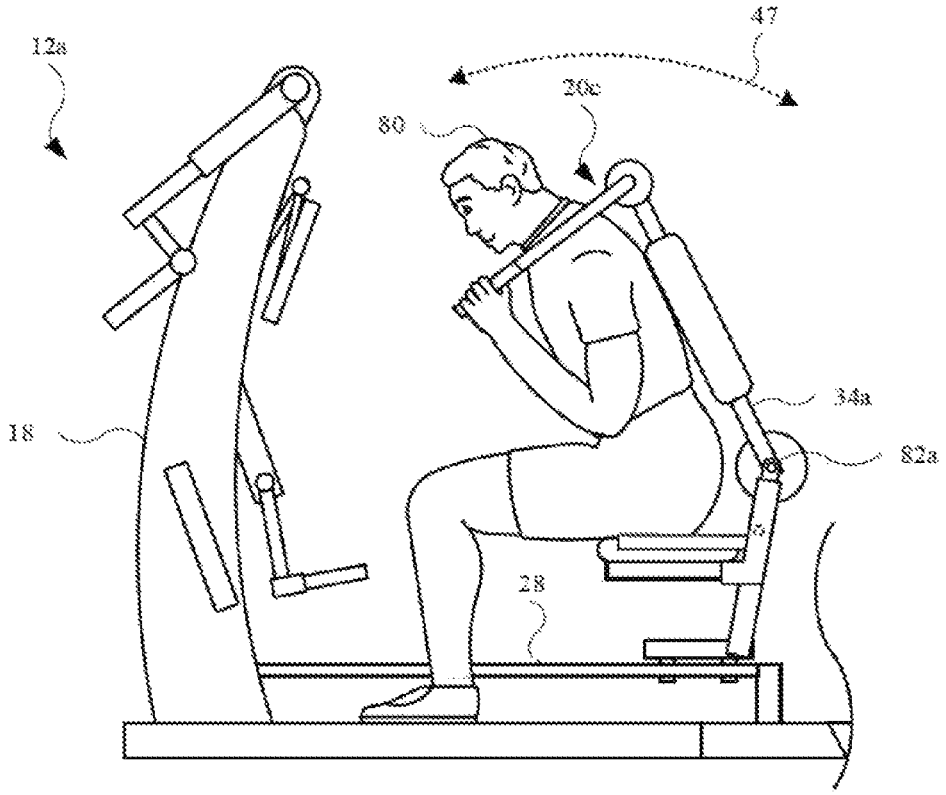
FIG. 11 illustrates a side view of the exercise machine, showing movement of the seat assembly, in accordance with some embodiments.
Figure 12:
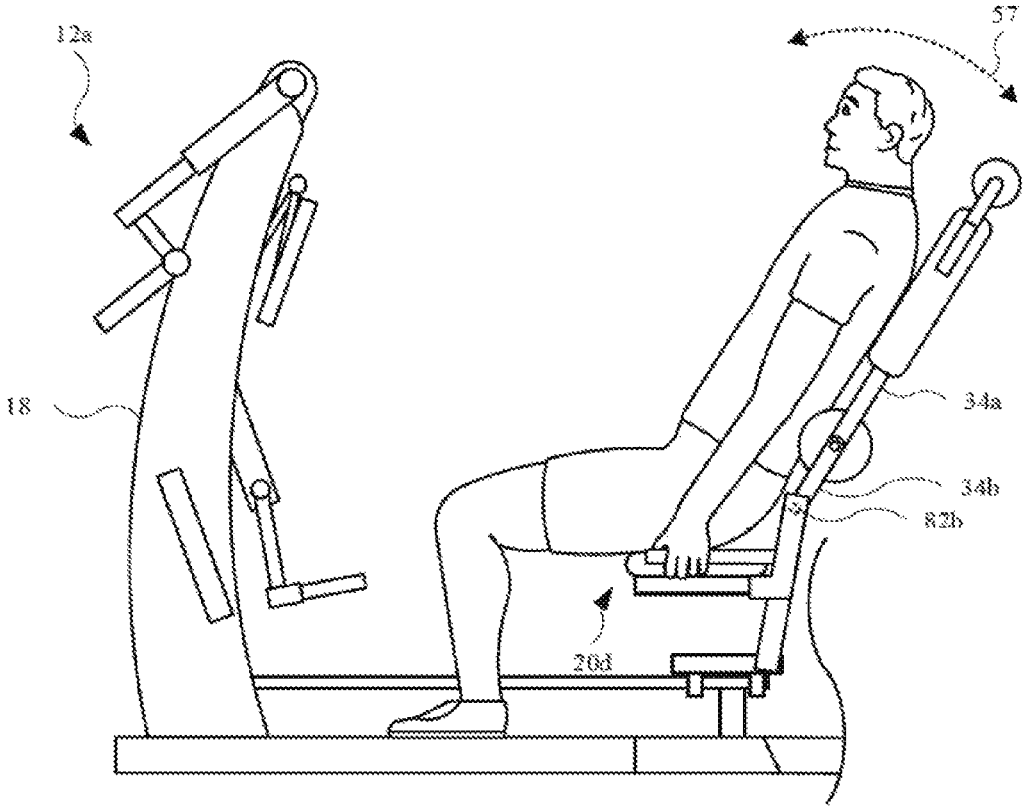
FIG. 12 illustrates a side view of the exercise machine, showing additional movement of the seat assembly, in accordance with some embodiments.

FIGS. 11 and 12 show a user 80 using the seat assembly 26 to perform different exercises. FIG. 11 illustrates a side view of the exercise machine 12*a*, showing movement of the seat assembly 26, in accordance with some embodiments. As shown, the user 80 can grasp the handle system 20*c* and rotate the portion 34*a* about the pivot point 82*a* toward the frame 18. By repeating this motion toward and away from the frame 18 (as indicated by the two-sided arrow 47), the user 80 may exercise the abdominal muscles. Although not shown, the user 80 can place both feet to one side of the rail 28 and perform a similar motion to exercise the external oblique muscles.

FIG. 12 illustrates a side view of the exercise machine 12*a*, showing additional movement of the seat assembly 26, in accordance with some embodiments. As shown, the user 80 can grasp the handle system 20*d* and rotate the portion 34*a* and the portion 34*b* about the pivot point 82*b* away from the frame 18. By repeating this motion away from and toward the frame 18 (as indicated by the two-sided arrow 57), the user 80 may exercise the back muscles.

FIGS. 13-21 illustrate alternate embodiments of exercise machines. The embodiments shown and described in FIGS. 13-21 represent exercise machines that can be coupled (mechanically and electrically) to the exercise machines 12*a*, 12*b* (both shown in FIG. 1). These versions can define alternate exercise systems that differ from the exercise system 10 shown in FIG. 1. Further, in some embodiments, an exercise system is formed by a combination of two exercise machines shown and described in FIGS. 13-21. Alternatively, FIGS. 13-21 may show and describe alterations and modifications to the exercise machines 12*a*, 12*b*.

Figure 13:
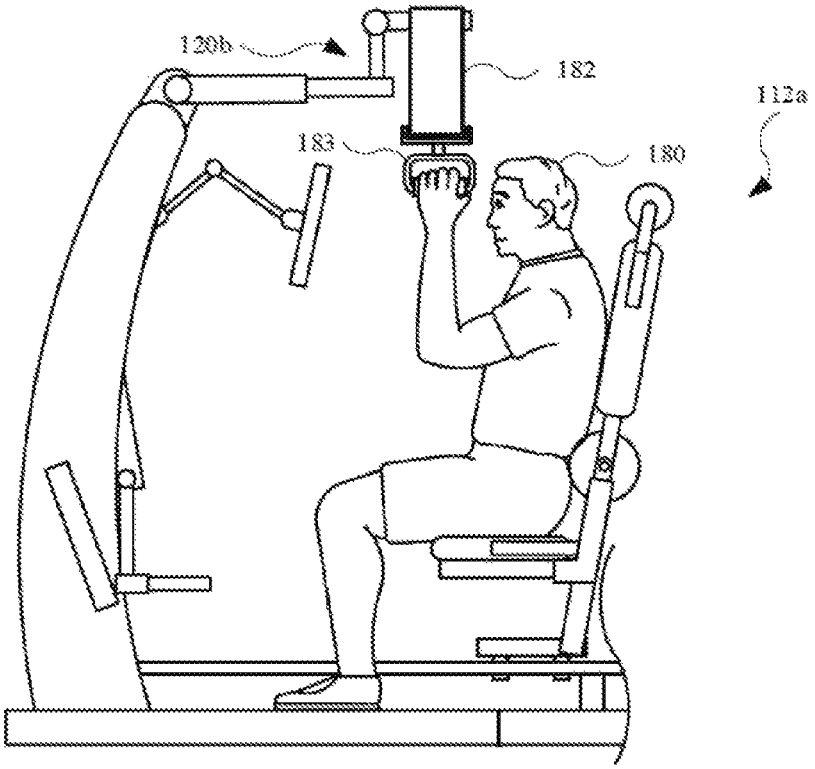
FIG. 13 illustrates a side view of an alternate embodiment of an exercise machine, showing a handle system and a resistance mechanism extending from the handle system, in accordance with some embodiments.

FIG. 13 illustrates a side view of an alternate embodiment of an exercise machine 112*a*, showing a handle system 120*b* and a resistance mechanism 182 extending from the handle system 120*b*, in accordance with some embodiments. As shown, the resistance mechanism 182 is coupled to a handle 183. When a user 180 grasps the handle 183, the user 180 can pull on the resistance mechanism 182, causing the resistance mechanism 182 to elongate or stretch. Similar to prior resistance mechanisms, the resistance mechanism 182 can include elastic properties such that the resistance mechanism 182 provides a counterforce to the force provided by the user 180. Based on the resistance mechanism 182, the exercise machine 112*a* can provide increased resistance, which in turn can provide a relatively more intense osteogenesis in the arms and/or upper back of the user 180. Although not shown, an additional resistance mechanism capable of user interaction can be integrated with the handle system 120*b*.

Figure 14:
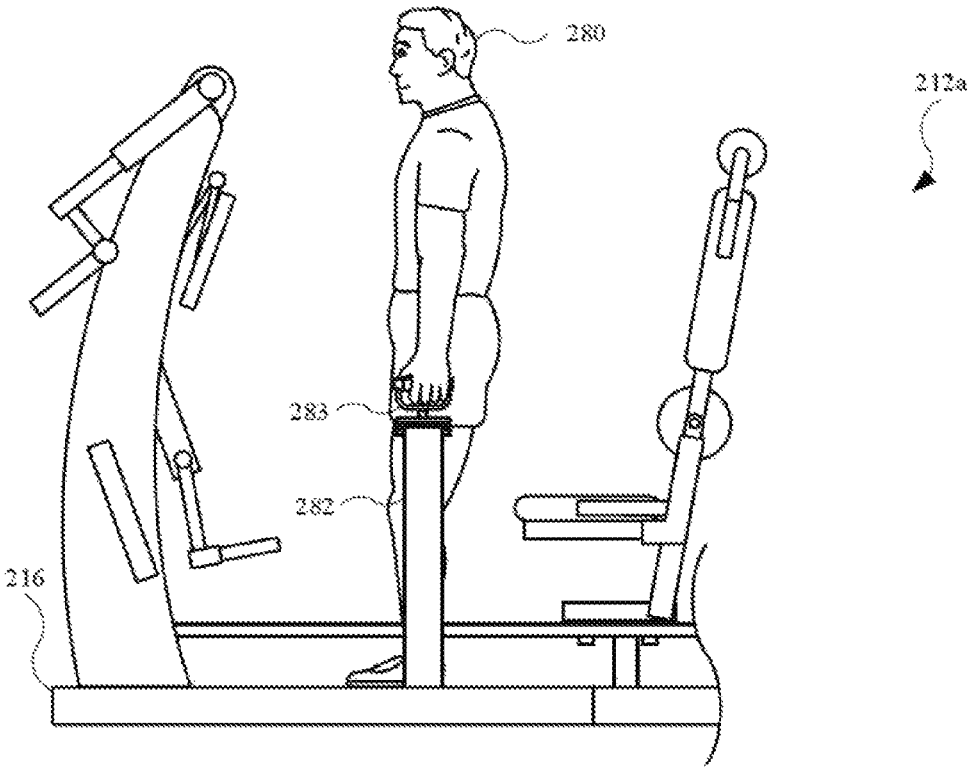
FIG. 14 illustrates a side view of an alternate embodiment of an exercise machine, showing a base and a resistance mechanism extending from the base, in accordance with some embodiments.

FIG. 14 illustrates a side view of an alternate embodiment of an exercise machine 212*a*, showing a base 216 and a resistance mechanism 282 extending from the base 216, in accordance with some embodiments. As shown, the resistance mechanism 282 is coupled with a handle 283. When a user 280 grasps the handle 283, the user 280 can pull on the resistance mechanism 282, causing the resistance mechanism to elongate or stretch. Similar to prior resistance mechanisms, the resistance mechanism 282 can include elastic properties such that the resistance mechanism 282 provides a counterforce to the force provided by the user 280. As a result, the resistance mechanism 282 can provide exercise repetitions, such as shoulder exercise repetitions. Based on the resistance mechanism 282, the exercise machine 212*a* can provide increased resistance, which in turn can provide a relatively more intense osteogenesis in (as compared to prior embodiments) the arms and/or upper back of the user 280. The resistance mechanism 282 can promote osteogenesis that varies from that which is shown for the resistance mechanism 182 in FIG. 13. Also, although not shown, an additional resistance mechanism may be included for user interaction.

Figure 15:
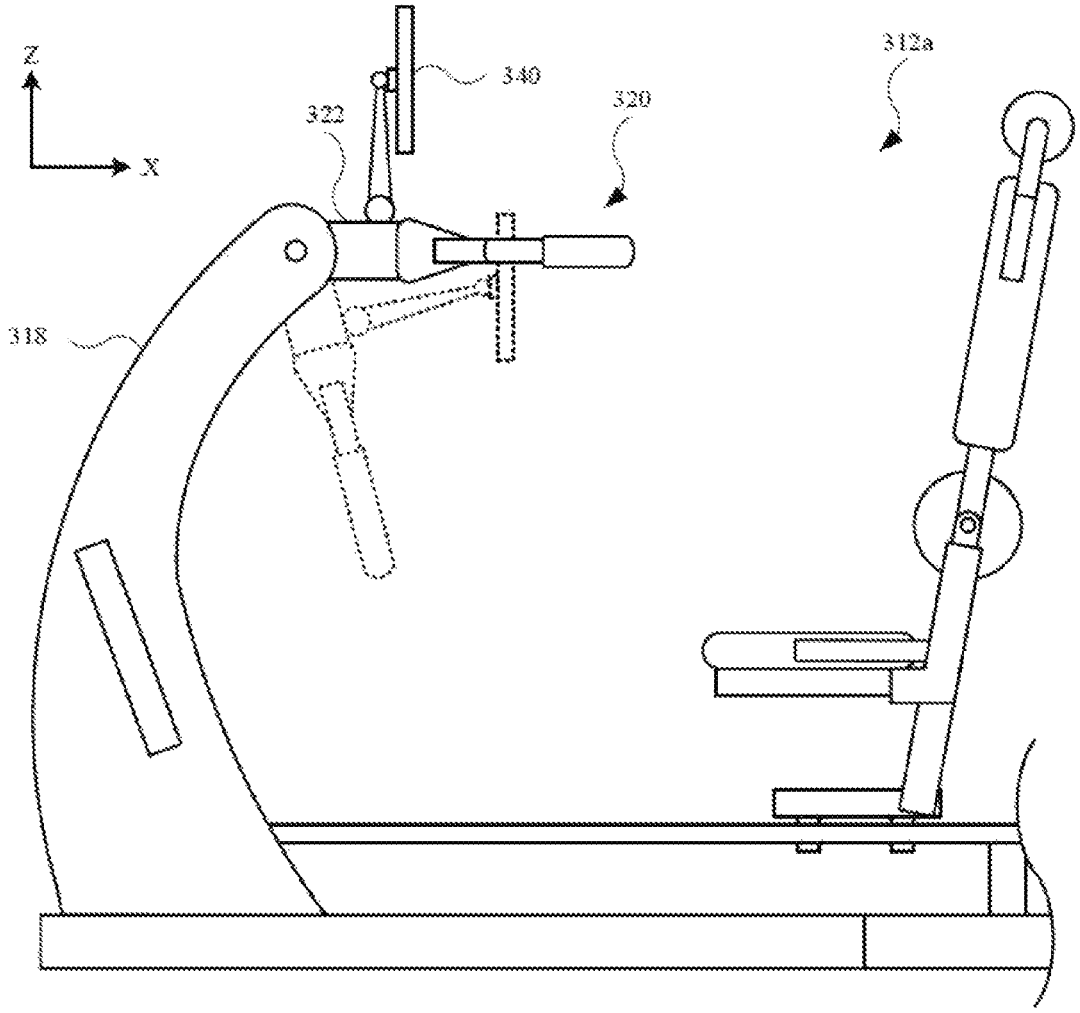
FIG. 15 illustrates a side view of an alternate embodiment of an exercise machine, in accordance with some embodiments.

FIG. 15 illustrates a side view of an alternate embodiment of an exercise machine 312*a*, in accordance with some embodiments. As shown, the exercise machine 312*a* may include a frame 318. The exercise machine 312*a* can further include a handle system 320 rotationally coupled to the frame 318 by a pivot mechanism 322. The exercise machine 312*a* can further include a computing system 340 located on the pivot mechanism 322. The computing system 340 can be capable of traversing the pivot mechanism 322 along the X-axis. As indicated by the dotted lines, the handle system 320 can rotate and move to different positions, thereby providing different exercise functions. Further, the computing system 340 may rotate or pivot while still facing a user (not shown in FIG. 15).

Figure 16:
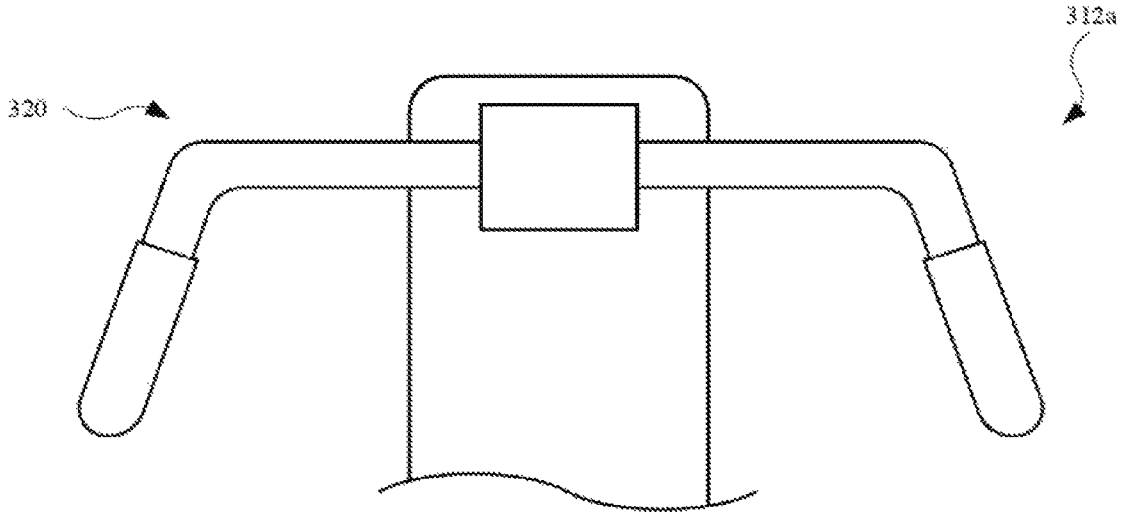
FIG. 16 illustrates an alternate view of the exercise machine shown in FIG. 15, showing the handle system.

FIG. 16 illustrates another view of the exercise machine 312*a* shown in FIG. 15. As shown, the handle system 320 may include a single bar with multiple diagonal regions designed for user interaction. The handle system 320 may provide a rigid handle system for specific exercise functions.

Figure 17:
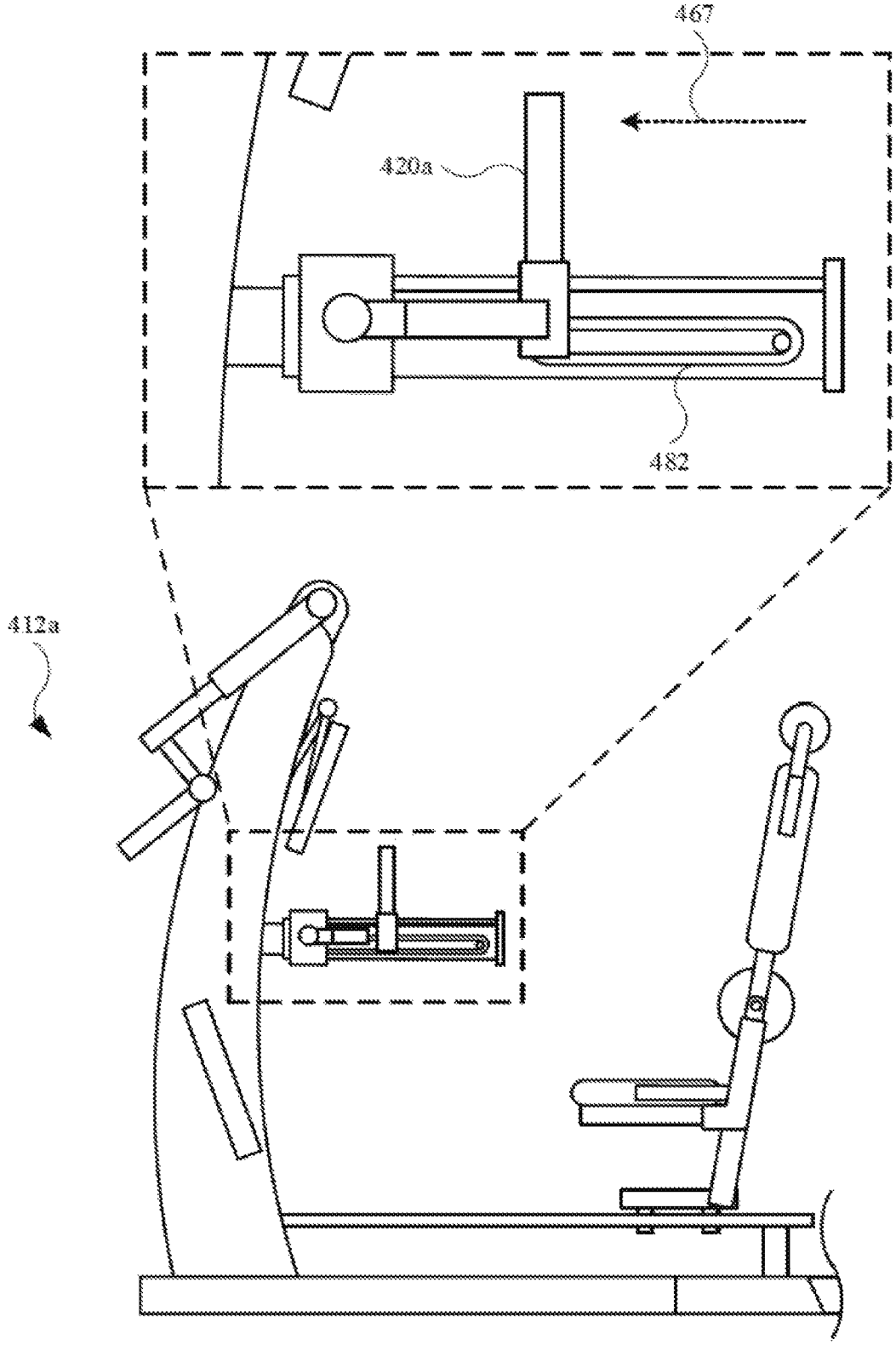
FIG. 17 illustrates a side view of an alternate embodiment of an exercise machine, showing a handle system coupled to a resistance mechanism, in accordance with some embodiments.

FIG. 17 illustrates a side view of an alternate embodiment of an exercise machine 412*a*, showing a handle system 420*a* coupled to a resistance mechanism 482, in accordance with some embodiments. A user (not shown in FIG. 17) can grasp the handle system 420*a* and provide a force (in the direction of the arrow 467). The resistance mechanism 482 may subsequently provide a counterforce to the user-provided force. In this manner, the resistance mechanism 482 can include elastic properties, and may include a material such as rubber. Similar to prior embodiments, the handle system 420*a* provides a modified osteogenic exercise with a relatively increased intensity. The resultant increased activity can provide increased osteogenic training to the bones associated with the user's arms and or back. Although not shown, an additional resistance mechanism(s) can be integrated with the handle system 420*a*.

Figure 18:
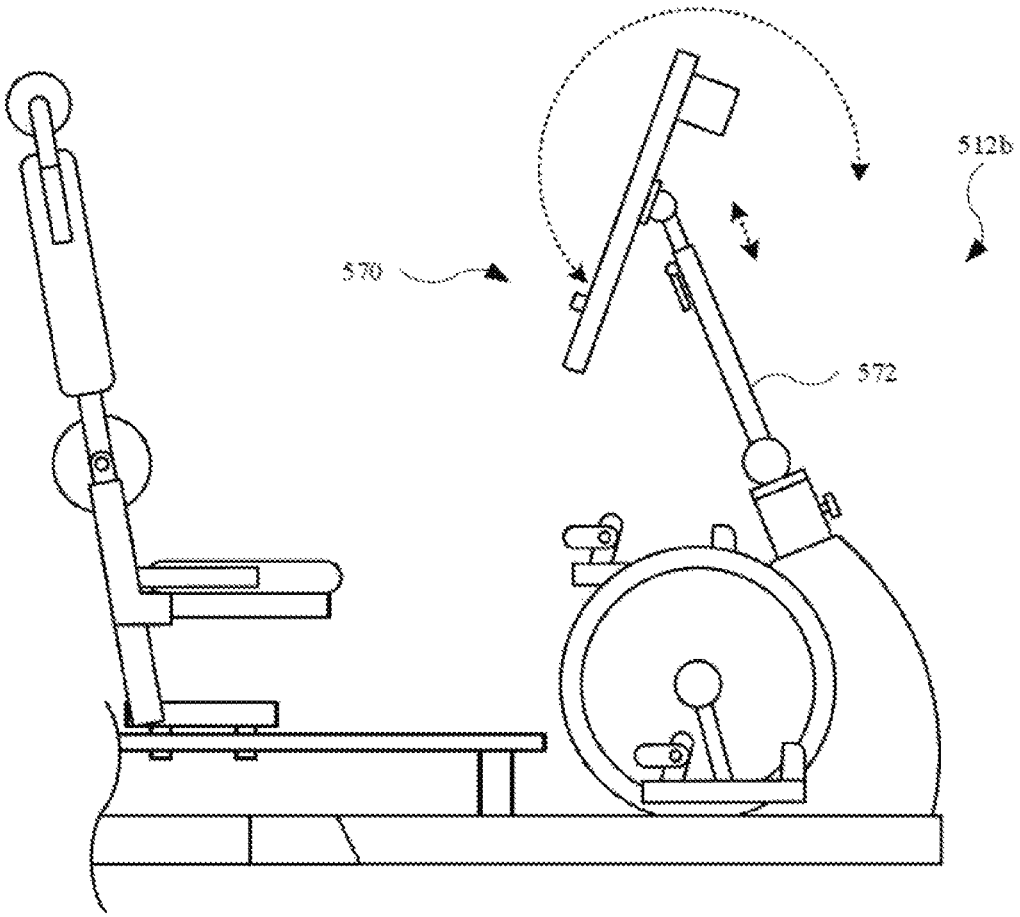
FIG. 18 illustrates a side view of an exercise machine, showing a tray system, in accordance with some embodiments.

FIG. 18 illustrates a side view of an exercise machine 512*b*, showing a tray system 570, in accordance with some embodiments. As shown, the exercise machine 512*b* can include a base 556 and a frame 558. The tray system 570 can be rotationally coupled to a post 572, with the post 572 being coupled to the frame 558. Further, the position (i.e., the height) of the tray system 570 can be adjusted. The tray system 570 can provide additional benefits to a user (not shown in FIG. 18)._The tray system 570 may replace the hand-pedaling apparatus 60 when the hand-pedaling apparatus 60 is removed from the frame 58 (shown in FIG. 1).

Figure 19:
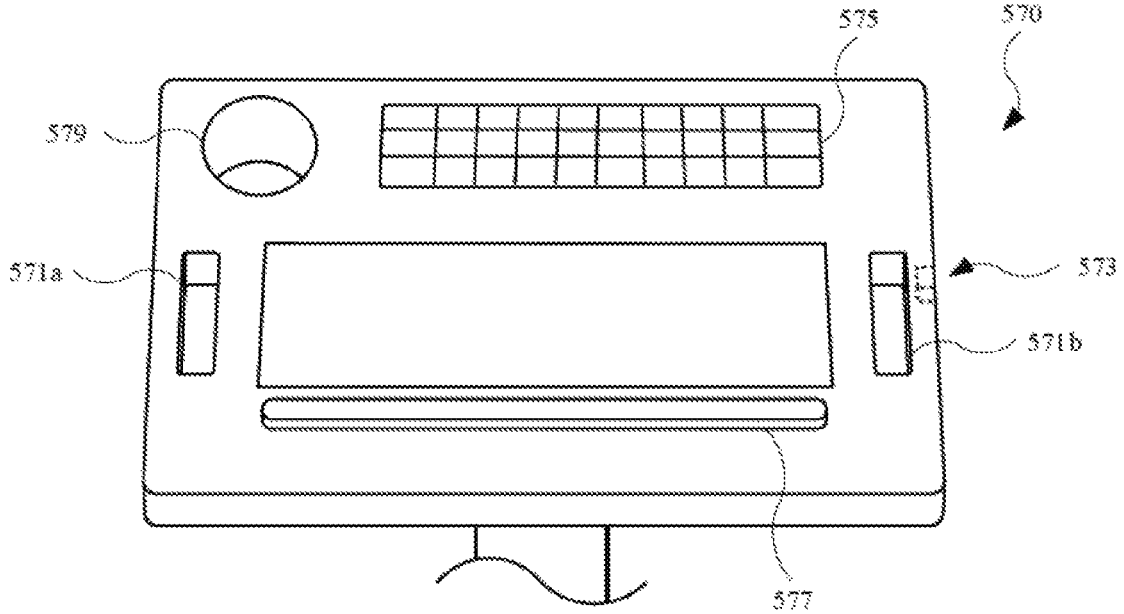
FIG. 19 illustrates an isometric view of the tray system shown in FIG. 18.

FIG. 19 illustrates an isometric view of the tray system 570 shown in FIG. 18. As shown, the tray system 570 may include handles 571*a*, 571*b* that allow the user to grasp the tray system 570 to rotate/tilt the tray system 570. The tray system 570 may further include a port 573. The port 573 may include a Universal Serial ("USB") port, or a port in accordance with other protocols such as mini-USB and USB-C. In this regard, the port 573 may include a power port that allows the user to plug a cable assembly (not shown in FIG. 19) into the port 573 to charge an electronic device. Alternatively, or in combination, the port 573 also may act as a data port that allows an electronic device to couple to the exercise machine 512*b* (shown in FIG. 18). Accordingly, the user's electronic device can act in a manner similar to a computing system described herein.

The tray system 570 may further include a solar panel system 575 that includes one or more photovoltaic panels designed to convert light energy to electrical energy. The solar panel system 575 can be used as the power source for the electronic device electrically coupled to the port 573. Alternatively, or in combination, the solar panel system 575 may provide energy used by the exercise machine 512*b* (shown in FIG. 18). Accordingly, the solar panel system 575 can be used as a power source for the exercise machine 512*b*. The tray system 570 may further include a ledge 577 that maintains a stationary position of the user's electronic device or reading material, as non-limiting examples. The ledge 577 may be an adjustable ledge. For example, while the ledge 577 is shown extending beyond a surface of the tray system 570, the ledge can be contracted and lie flush or co-planar with respect to the surface. The tray system 570 may further include a cup holder 579.

Figure 20:
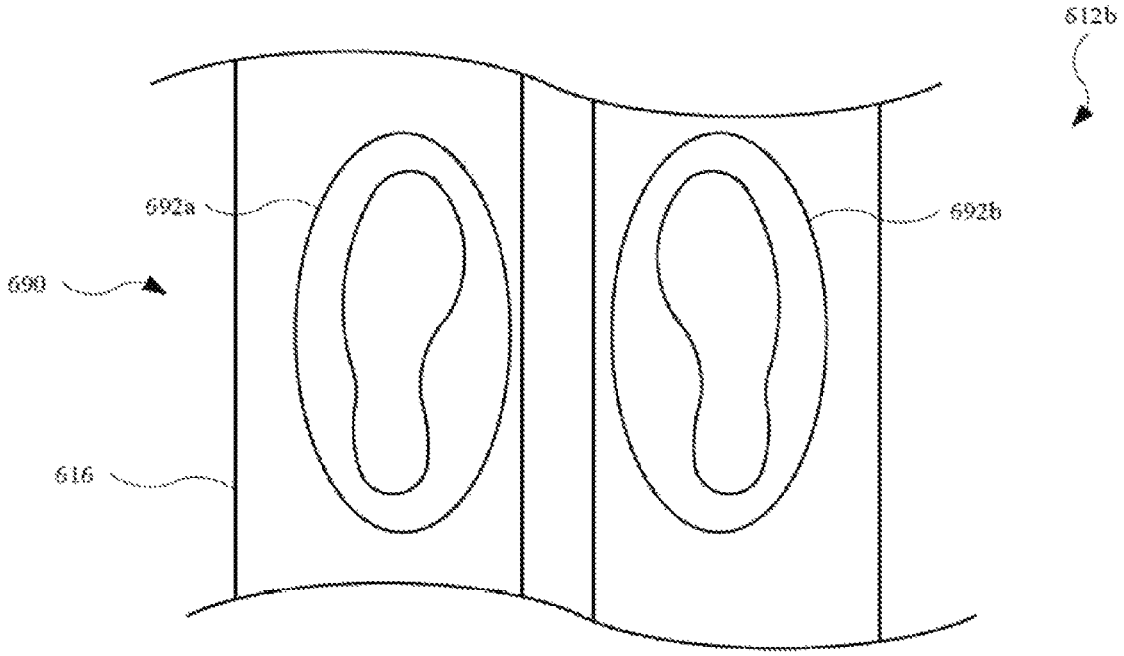
FIG. 20 illustrates a partial plan view of the exercise machine, further showing a balancing system, in accordance with some embodiments.

FIG. 20 illustrates a partial plan view the exercise machine 612*b*, further showing a balancing system 690 of the exercise machine 612*b*, in accordance with some embodiments. The balancing system 690 can be integrated with the base 616 of the exercise machine 612*b*. As shown, the balancing system 690 may include sensing locations 692*a*, 692*b*. The sensing locations 692*a*, 692*b* may include a weight sensor or some other force-sensitive device. In particular, the sensing locations 692*a*, 692*b* can individually, or separately, monitor an applied weight or force. As a result, the balancing system 690 can provide the exercise machine 612*b* with stability feedback information of a user (not shown in FIG. 21) that stands on the balancing system 690.

Figure 21:
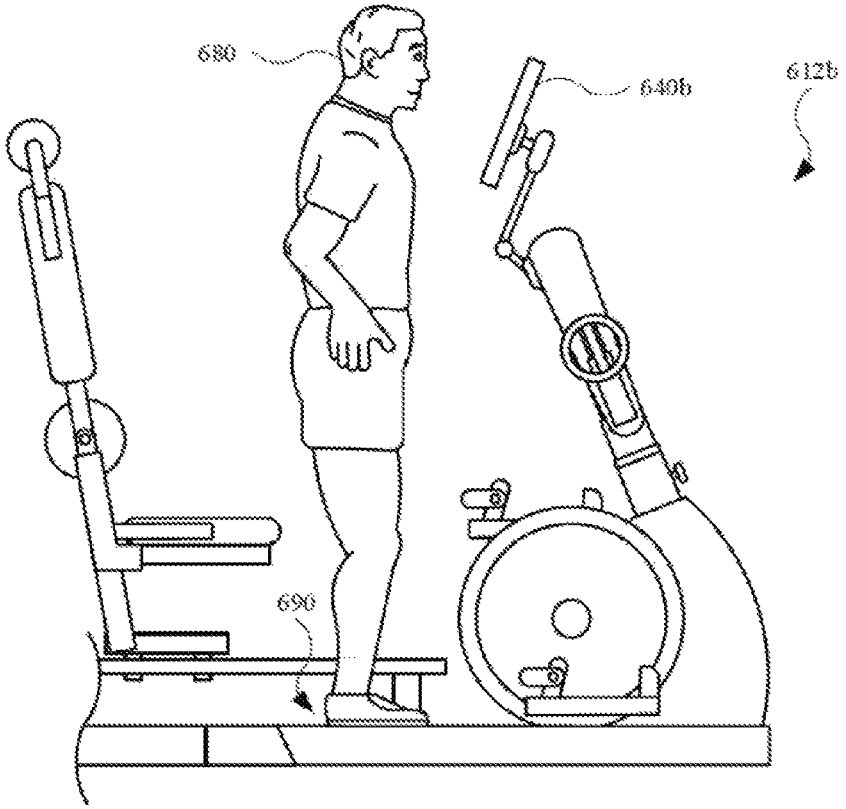
FIG. 21 illustrates a side view of a user standing on the balancing system shown in FIG. 20, in accordance with some embodiments.

FIG. 21 illustrates a side view of a user 680 standing on the balancing system 690 shown in FIG. 20, in accordance with some embodiments. In some embodiments, the computing system 640*b* can operate a software application in conjunction with the balancing system 690. For example, the computing system 640*b* can request that the user 680 stand still and upright. In one version, the balancing system 690 can either confirm whether the user 680 is generally applying equal weight on each foot or favoring one foot over the other. As a result, the balancing 690 may provide user diagnostics used with rehabilitation, as a non-limiting example.

FIGS. 22-25 illustrate alternate embodiments of seat assemblies. The embodiments shown and described in FIGS. 22-25 represent seat assemblies that can be mechanically integrated with at least some exercise machines described herein, thereby defining alternate exercise systems that differ from the exercise system 10 shown in FIG. 1. Accordingly, in some embodiments, an exercise system is formed by a combination of two or more exercise machines, with one of the exercise machines incorporating a seat assembly shown and described in FIGS. 22-25. Alternatively, FIGS. 22-25 may show and describe alterations and modifications to the seat assembly 26 (shown in FIG. 1).

Figure 22:
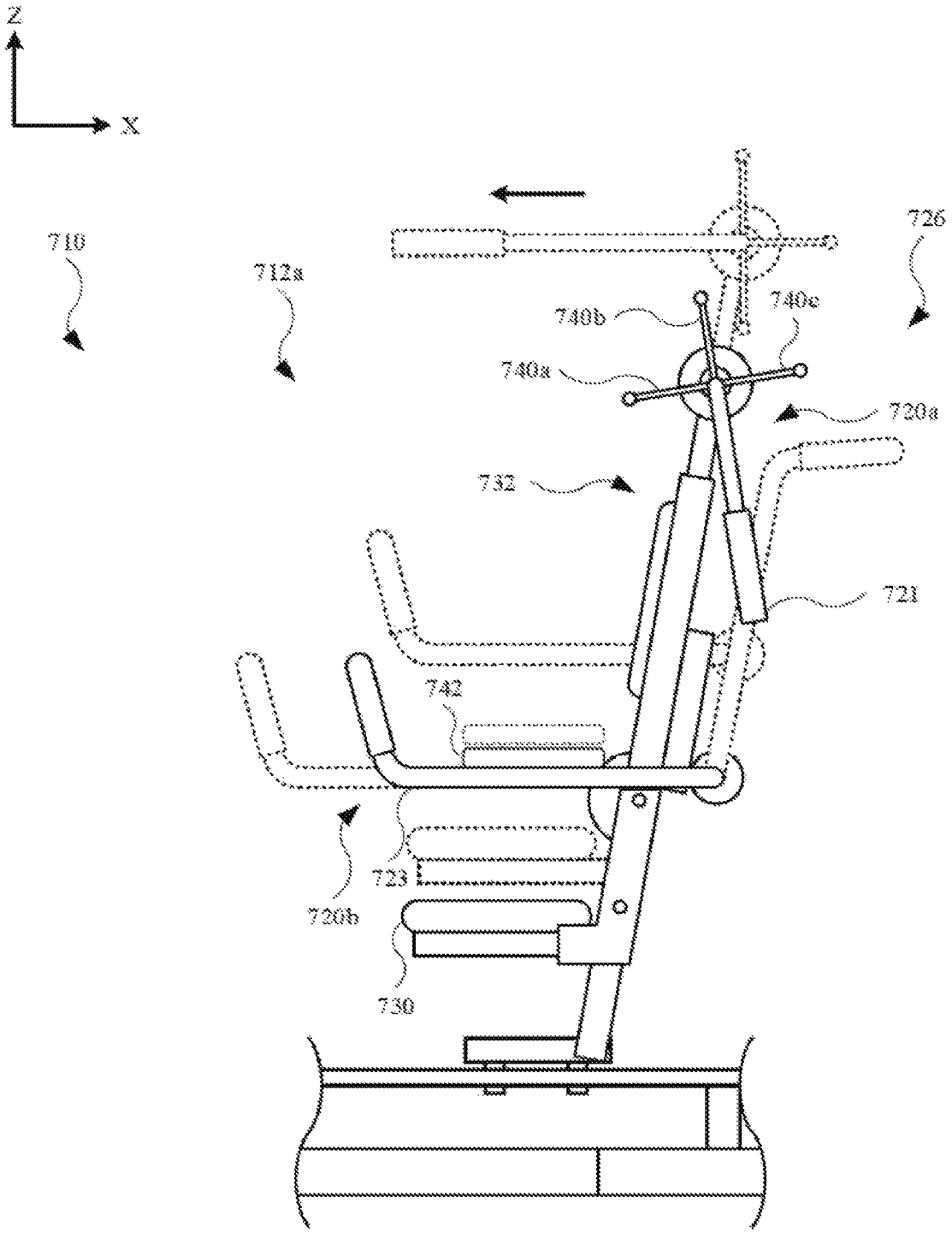
FIG. 22 illustrates a side view of the exercise machine shown in FIG. 20, in accordance with some embodiments.

FIG. 22 illustrates a side view of an alternate embodiment of a seat assembly 726, in accordance with some embodiments. The seat assembly 726 can be located on an exercise machine 712*a* of an exercise system 710 (both partially shown). The seat assembly 726 may include several features previously described for the seat assembly 26 (shown in FIG. 1). Also, in some embodiments, the seat assembly 726 can substitute for the seat assembly 26 on the exercise machine 712*a* (shown in FIG. 1).

As shown, the seat assembly 726 may include a seat rest 730 and a seat back 732. The seat assembly 726 may further include handle systems 720*a*, 720*b*. Each handle system may include enhancements that provide the seat assembly 726 with multiple advantageous features. For example, the handle system 720*a* may include radial handles 740*a*, 740*b*, 740*c*. These radial handles may extend radially from a handlebar 721 of the handle system 720*a*. Each of the radial handles can provide a gripping mechanism to facilitate a user (not shown in FIG. 22) pulling and rotating the handle system 720*a* to place it in a position for performing an exercise function. For example, the handle system 720*a* may rotate from a first position (behind the seat back 732) to a second position (over the seat back 732), with the second position indicated by dotted lines. Moreover, the handle system 720*a* can elevate along the Z-axis and extend (i.e., lengthen) along the X-axis. Although not shown, the handle system 720*a* may include two or more handlebars similar to prior embodiments.

The handle system 720*b* may include a handlebar 723 that extends from the seat rest 732. The handlebar 723 may include a cushion 742. When a user grasps the handle system 720*b*, the user can adjust the handle system 720*b* by elevating it along the Z-axis, as indicated by dotted lines. Similarly, the cushion 742 also can be elevated along the Z-axis, as indicated by dotted lines. Although not shown, the handle system 720*b* may include two handlebars similar to prior embodiments. Additionally, a height adjustable mount (not shown in FIG. 22) can adjust/elevate the position (height) of the seat rest 730, as indicated by dotted lines. Accordingly, the seat rest 730 may be referred to as a height-adjustable seat rest.

Figure 23:
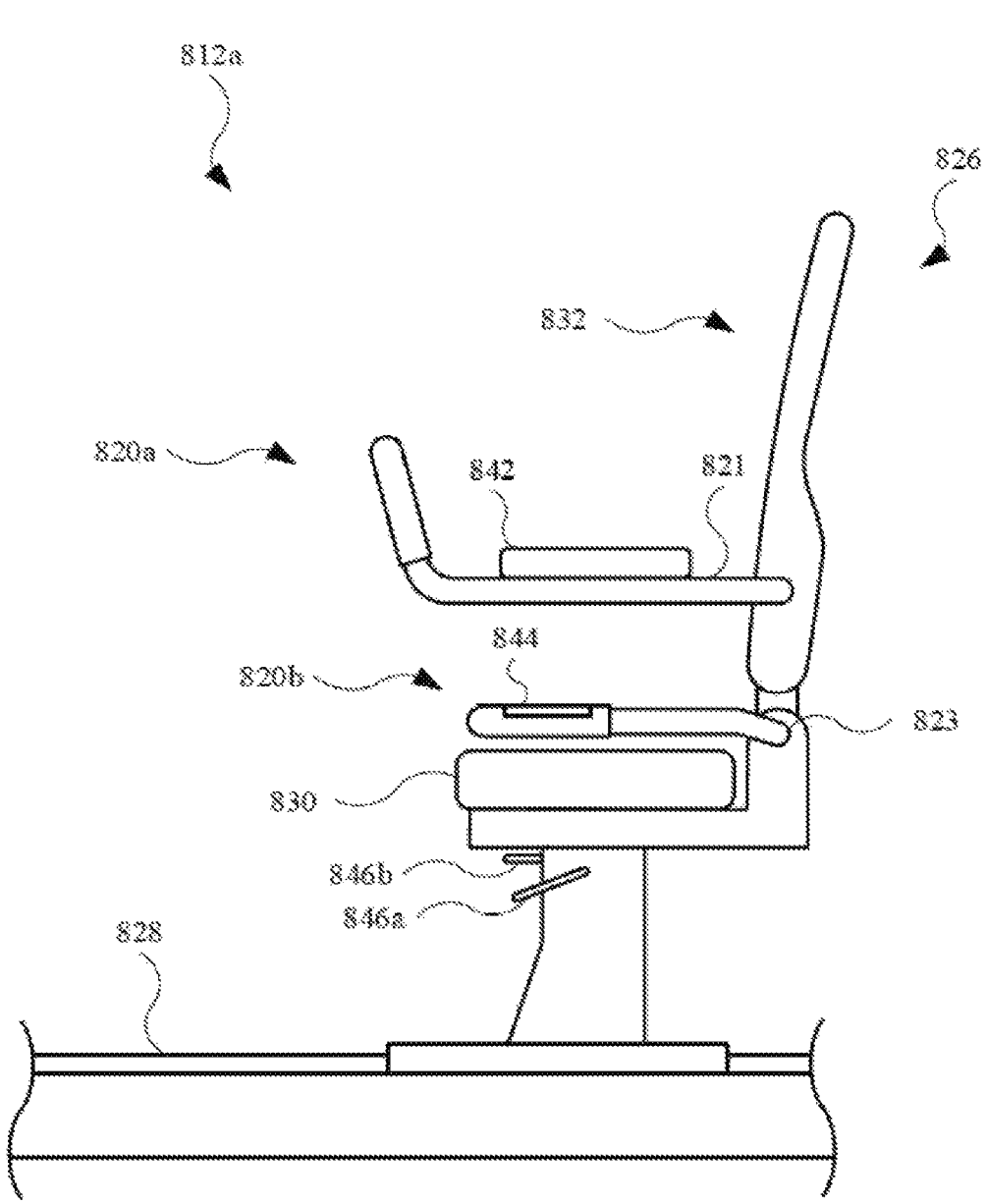
FIG. 23 illustrates a side view of an alternate embodiment of the exercise machine shown in FIG. 22.

FIG. 23 illustrates a side view of an alternate embodiment of a seat assembly 826, in accordance with some embodiments. The seat assembly 826 is located on an exercise machine 812*a* of an exercise system 810 (both partially shown). The seat assembly 826 may include several features previously described for the seat assembly 26 (shown in FIG. 1). Also, in some embodiments, the seat assembly 826 can substitute for the seat assembly 26 on the exercise machine 12*a* (shown in FIG. 1).

As shown, the seat assembly 826 may include a seat rest 830 and a seat back 832. The seat assembly 826 may further include handle systems 820*a*, 820*b*. Each handle system may include enhancements that provide the seat assembly 826 with multiple advantageous features. For example, the handle system 820*a* may include a handlebar 821 that includes a diagonal portion that provides a different gripping angle for the user. The handlebar 821 may include a cushion 842. The handle system 820*a* may include an additional handlebar equipped with a cushion in a manner similar to that of the handlebar 821 and the cushion 842, respectively.

The handle system 820*b* may include a handlebar 823 with a monitoring device 844. The monitoring device 844 may include heart rate monitor designed to detect the heart rate of a user (not shown in FIG. 23) who grasps the handlebar 823 (at a location corresponding to the monitoring device 844). The handle system 820*b* may include an additional handlebar equipped with a monitoring device in a manner similar to that of the handlebar 823 and the monitoring device 844, respectively.

The seat assembly 826 may further include adjustment mechanisms 846*a*, 846*b*. In some embodiments, the adjustment mechanism 846*a* can include a locking mechanism that prevents the seat assembly 826 from rotational movement and/or axial movement (along a rail 828). The adjustment mechanism 846*b* may lock or unlock the seat assembly 826 to adjust the height of the seat assembly 826.

Figure 24:
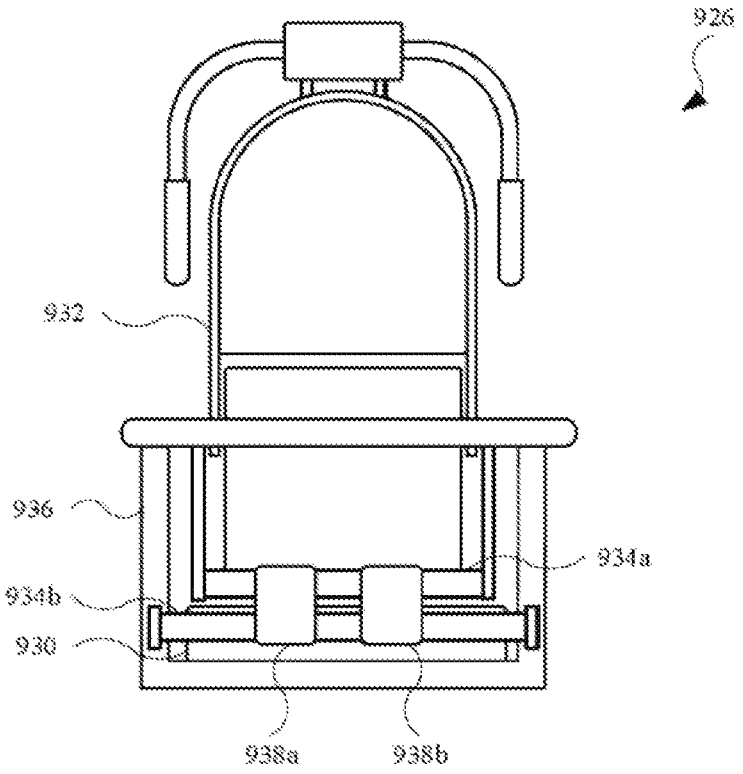
FIG. 24 illustrates a partial plan view of another embodiment of the exercise machine.

FIG. 24 illustrates a rear view of an alternate embodiment of a seat assembly 926, showing resistance mechanisms configured to provide resistance during exercise routines, in accordance with some embodiments. The seat assembly 926 may include several features previously described for the seat assembly 26 (shown in FIG. 1). Also, in some embodiments, the seat assembly 926 can substitute for the seat assembly 26 on the exercise machine 12*a* (shown in FIG. 1).

As shown, the seat assembly 926 may include a seat rest 930 and a seat back 932. The seat assembly 926 further includes a post 934*a* coupled to the seat back 932 and a post 934*b* coupled to a support bar 936. The seat assembly 926 can further include resistance bands 938*a*, 938*b* coupled to the posts 934*a*, 934*b*. When a user (not shown in FIG. 24) causes the seat back 932 to rotate relative to the seat rest 930 during, for example, an abdominal exercise, the post 934*a* moves (in conjunction with the seat back 932) relative to the post 934*b*. The relative movement causes the resistance bands 938*a*, 938*b* to stretch, thereby providing resistance to the user during the exercise. Accordingly, the resistance bands 938*a*, 938*b* may include elastic properties, and may include a material such as rubber. The number of resistance bands may vary, based upon the manufacture of the seat assembly 926. Alternatively, the user may adjust the number of resistance bands based upon a desired resistance.

Figure 25:
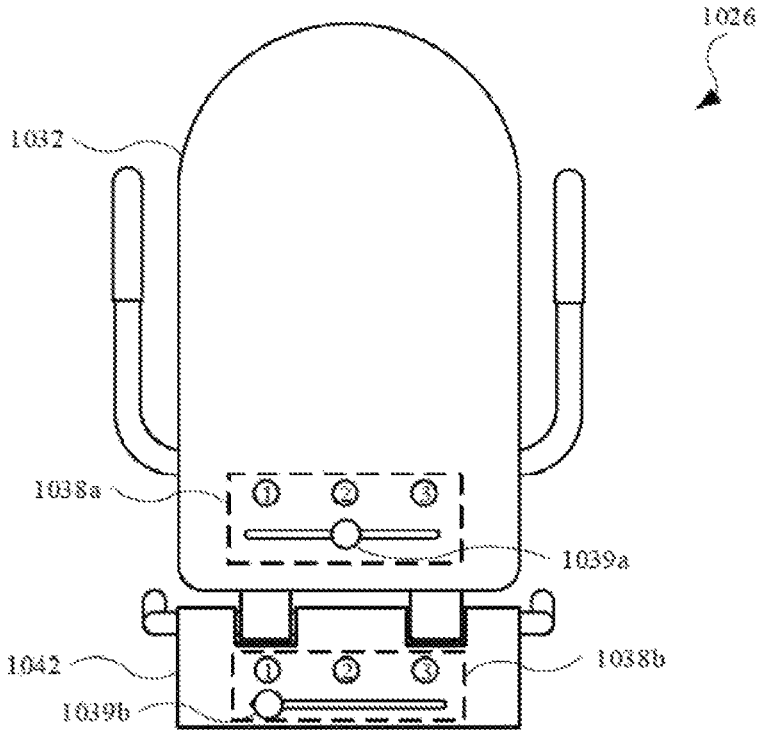
FIG. 25 illustrates another view of an embodiment of an exercise machine.

FIG. 25 illustrates a rear view of an alternate embodiment of a seat assembly 1026, showing adjustable resistance mechanisms used to provide resistance during exercise routines, in accordance with some embodiments. The seat assembly 1026 may include several features previously described for the seat assembly 26 (shown in FIG. 1). Also, in some embodiments, the seat assembly 1026 can substitute for the seat assembly 26 on the exercise machine 12*a* (shown in FIG. 1).

As shown, the seat assembly 1026 may include a seat back 1032 and a base module 1042 that carries a seat rest (not shown in FIG. 25). The seat assembly 1026 can further include an internal resistance mechanism 1038*a* (shown as a dotted line) that can be integrated with the seat back 1032, and an internal resistance mechanism 1038*b* (shown as a dotted line) that can be integrated with the base module 1042. The internal resistance mechanism 1038*a* may provide resistance during exercises, such as an abdominal exercise, an external oblique exercise, or a back muscle exercise. For example, when a user (not shown in FIG. 25) causes the seat back 1032 to rotate relative to the base module 1042 during an abdominal muscle exercise, the internal resistance mechanism 1038*a* may provide resistance against the movement of the seat back 1032. Further, the seat assembly 1026 may include a lever 1039*a* that can be controlled by the user to change the level of resistance provided by the internal resistance mechanism 1038*a*. As shown, the levels of resistance are indicated in an increasing order as "1," "2," and "3." However, the levels may vary in other embodiments.

To provide additional adjustable features, the internal resistance mechanism 1038*b* can be used to adjust the resistance of another exercise function located on the seat assembly 1026, or adjust the resistance of another exercise machine (not shown in FIG. 25) on which the seat assembly 1026 is integrated. The seat assembly 1026 also can include a lever 1039*b* that can be controlled by the user to change the level of resistance provided by the internal resistance mechanism 1038*b*.

Figure 26:
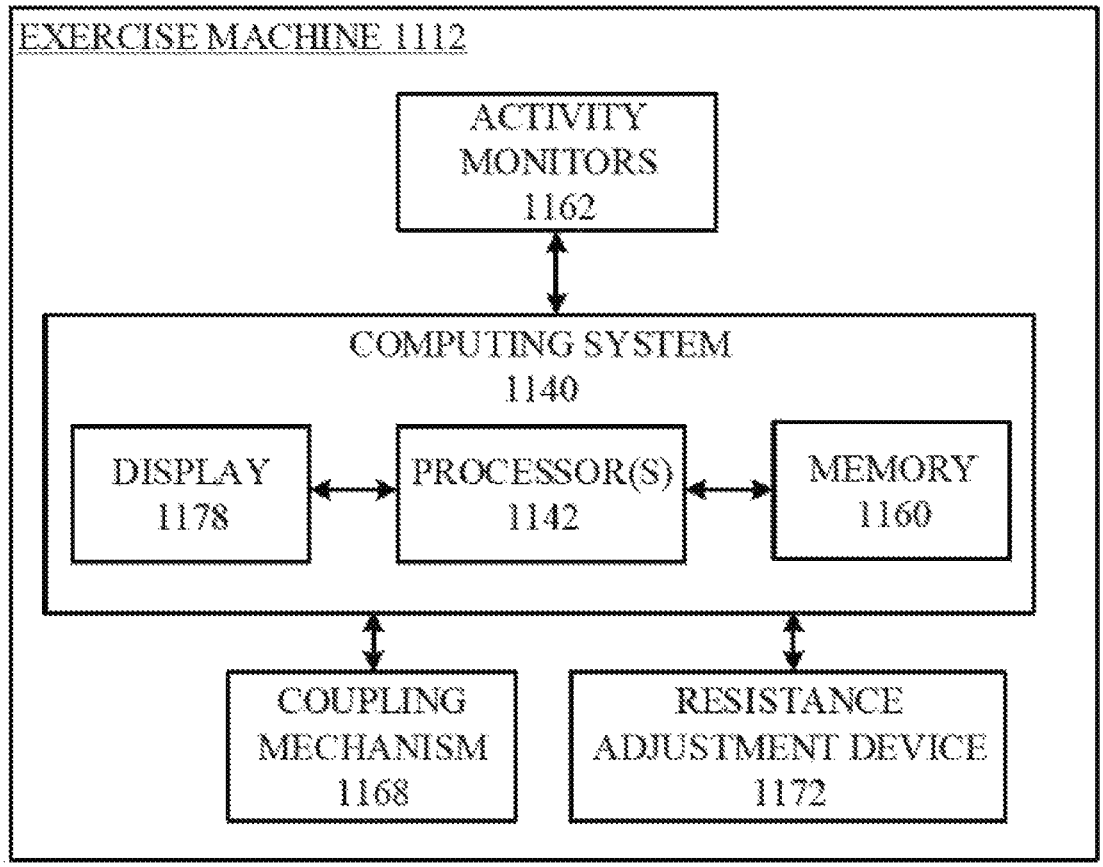
FIG. 26 illustrates a schematic view of an embodiment of an exercise machine, in accordance with some embodiments.

FIG. 26 illustrates a schematic view of an embodiment of an exercise machine 1112, in accordance with some embodiments. The exercise machine 1112 may include a computing system 1140 that can have one or more processors 1142 for executing functions of the exercise machine 1112. The one or more processors 1142 can refer to at least one of a central processing unit (CPU) and at least one microcontroller for performing dedicated functions. Also, the one or more processors 1142 can refer to application specific integrated circuits.

According to some embodiments, the exercise machine 1112 can include a display 1178. The display 1178 can be capable of displaying a user interface that can include icons (representing software applications), textual images, and/or motion images. In some examples, each icon can be associated with a respective function that can be executed by the computing system 1140. In some cases, the display 1178 can include a display layer (not illustrated), which can include a liquid-crystal display (LCD), light-emitting diode display (LED), or the like. According to some embodiments, the display 1178 can include a touch input detection component and/or a force detection component that can be configured to detect changes in an electrical parameter (e.g., electrical capacitance value) when the user's appendage (acting as a capacitor) comes into proximity with the display 1178 (or in contact with a transparent cover layer that covers the display 1178). The display 1178 can be connected to the one or more processors 1142 via one or more connection cables.

According to some embodiments, the exercise machine 1112 can include memory 1160, which can include a single disk or multiple disks (e.g., hard drives). A storage management module also can be included to manage one or more partitions within the memory 1160. In some cases, the memory 1160 can include flash memory, semiconductor (solid state) memory or the like. The memory 1160 also can include a Random Access Memory ("RAM") and a Read-Only Memory ("ROM"). The ROM can store programs, utilities or processes to be executed in a non-volatile manner. The RAM can provide volatile data storage, and stores instructions related to the operation of the electronic device exercise machine.

According to some embodiments, the exercise machine 1112 may include an activity monitor 1162 in communication with the computing system 1140. The activity monitor 1162 may include at least one or more sensors, including mechanical switches, electronic switches (including solid state switches), ergometers and monitoring system (including, e.g., heart rate monitors).

According to some embodiments, the exercise machine 1112 may include a coupling mechanism 1168 in communication with the computing system 1140. The coupling mechanism 1168 may include a mechanical coupling mechanism and an electrical coupling mechanism. Further, the coupling mechanism 1168 may include a decoding mechanism used by the computing system 1140 to provide information to the exercise machine 1112. The information determined by the decoding mechanism may include the type of exercise machine (including identification information and exercise functions) coupled to the exercise machine 1112. In some embodiments, the coupling mechanism 1168 receives information stored on a computing system of an exercise machine coupled to the exercise machine 1112 via the coupling mechanism 1168.

According to some embodiments, the exercise machine 1112 may include a resistance adjustment device 1172 in communication with the computing system 1140. The resistance adjustment device 1172 can enable an adjustment of the intensity of the exercise functions of the exercise machine 1112. The resistance adjustment device 1172 can provide an input to the computing system 1140 in the form of the resistance provided to the exercise function. As a result, the information provided by resistance adjustment device 1172 can be used by the computing system 1140 to determine activity levels (based upon the resistance) as well as a user's calorie-burning levels. Regarding the latter, the memory 1160 may store instructions for execution of a calorie-burring software application.

Figure 27:
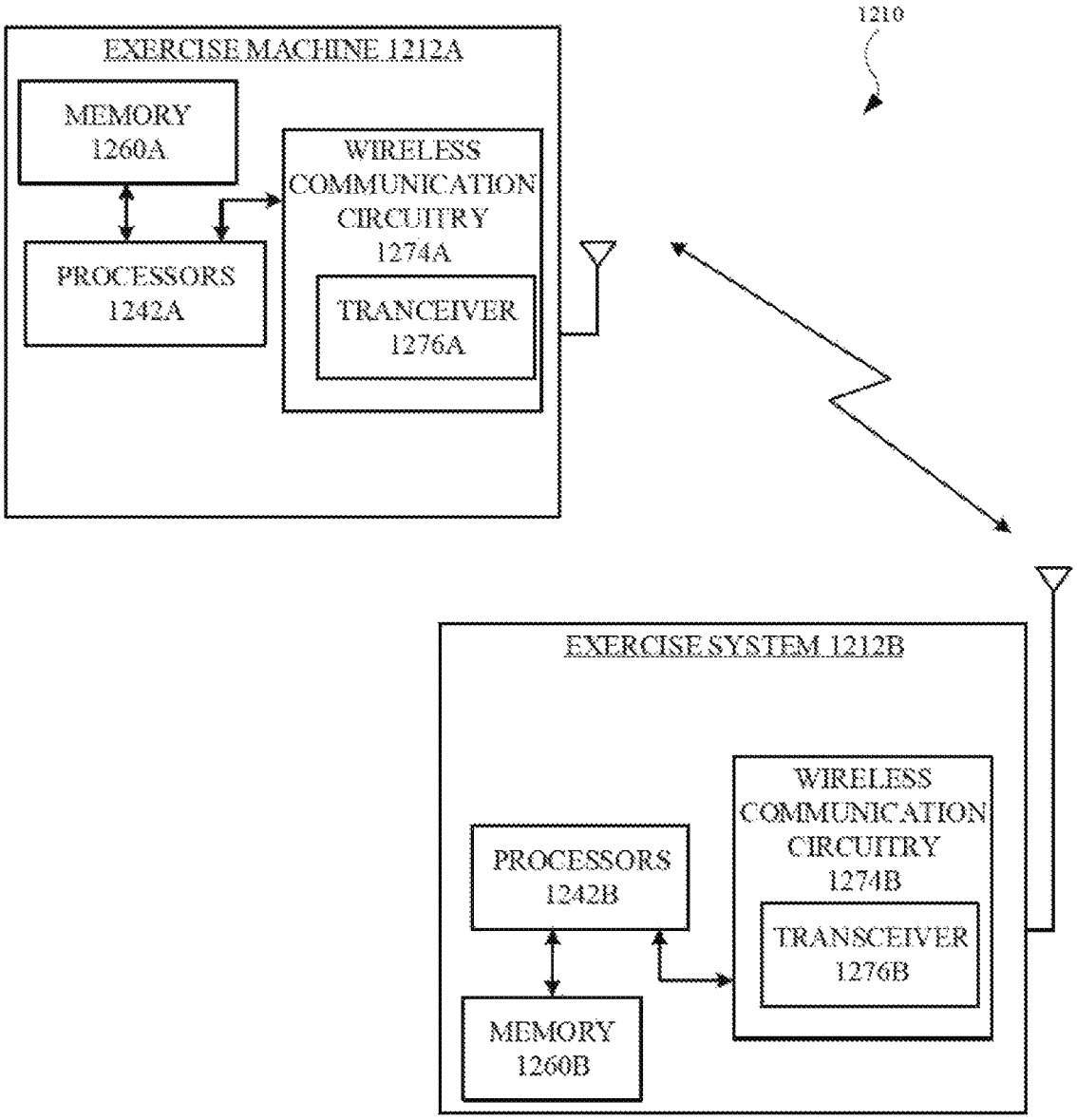
FIG. 27 illustrates a schematic view of an embodiment of an exercise system that includes exercise machines in communication with each other, in accordance with some embodiments.
Figure 28:
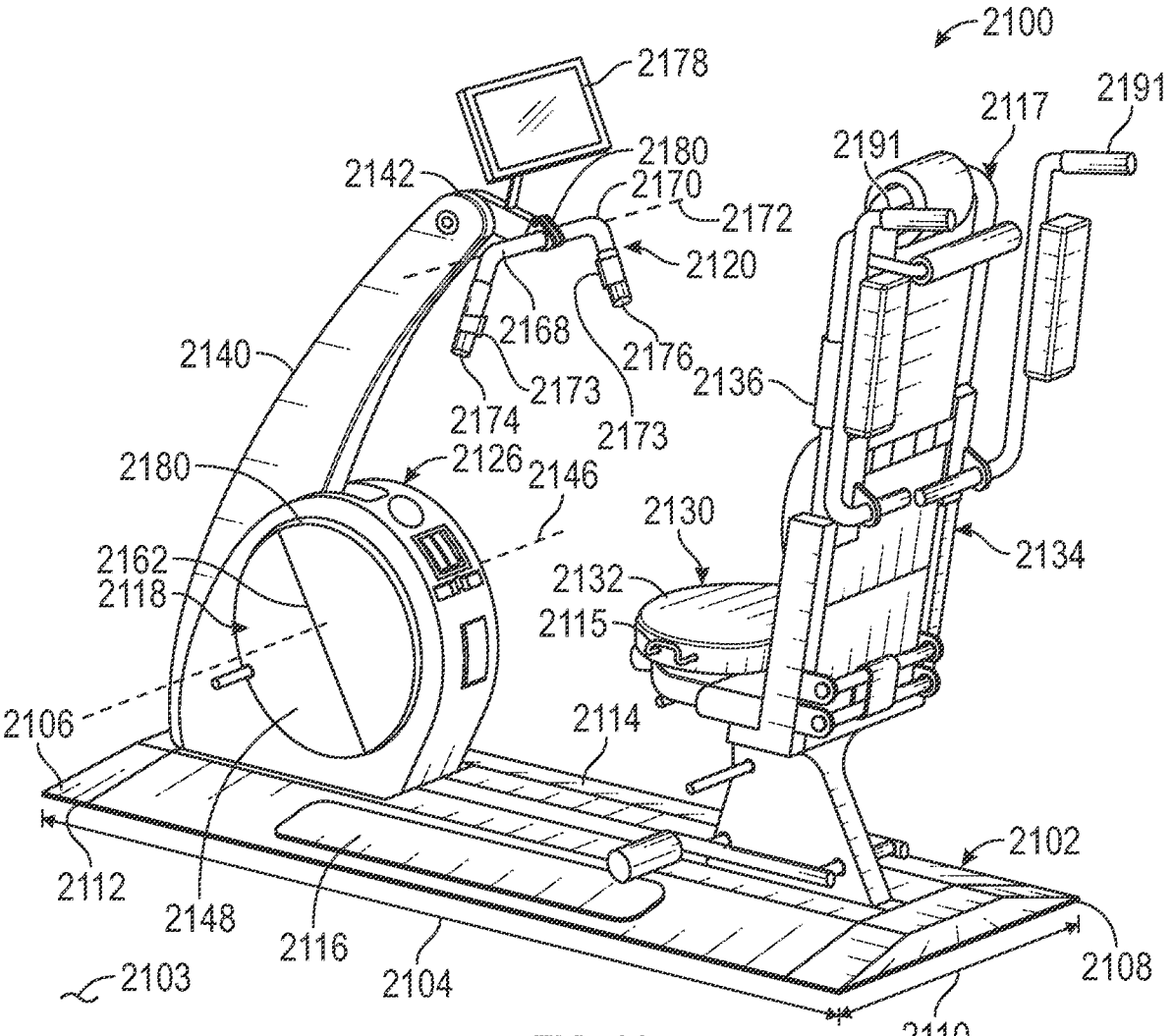
FIGS. 28-31 illustrate another embodiment of an exercise machine, according to aspects of the disclosure.
Figure 29:
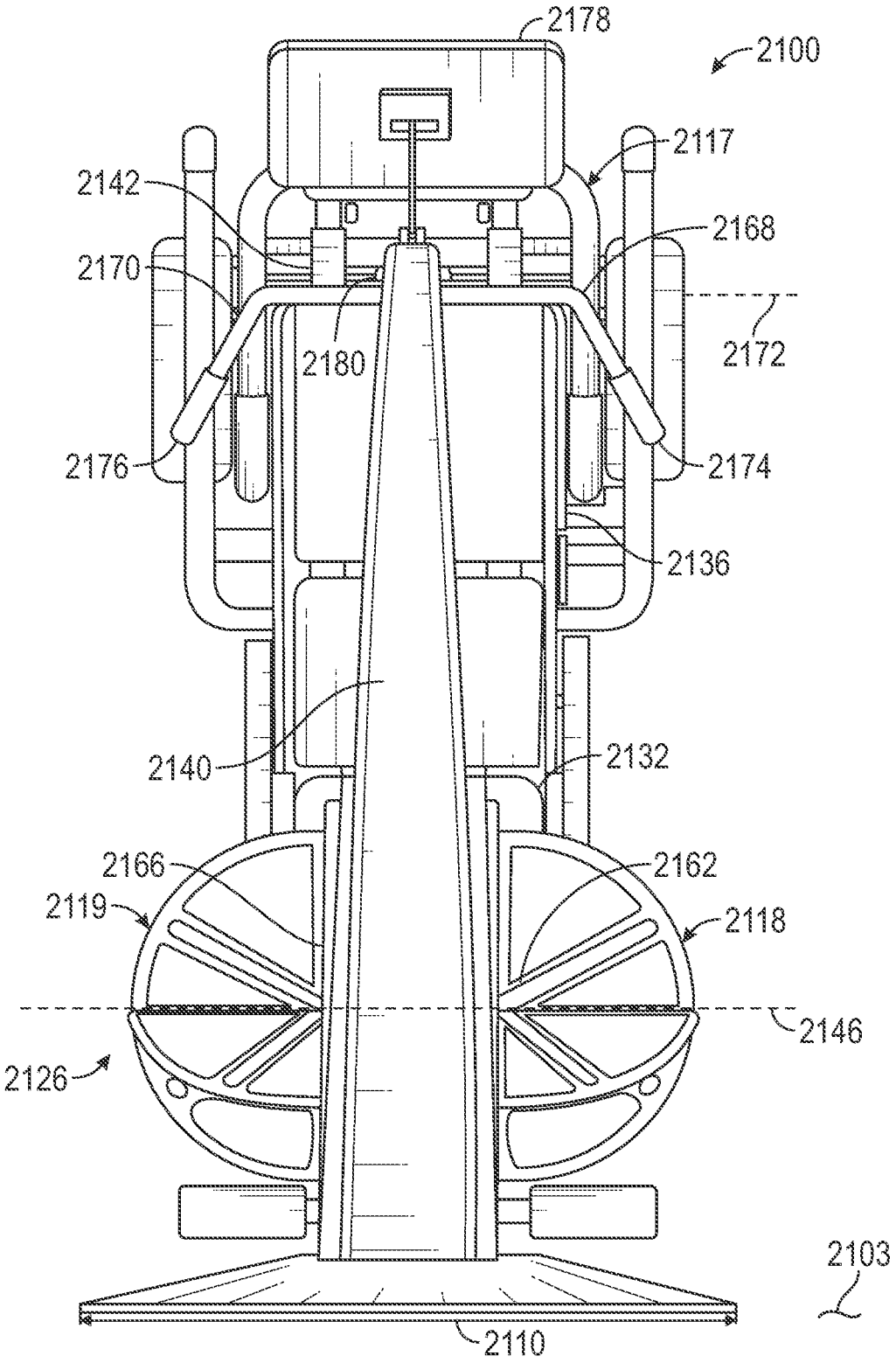
Figure 30:
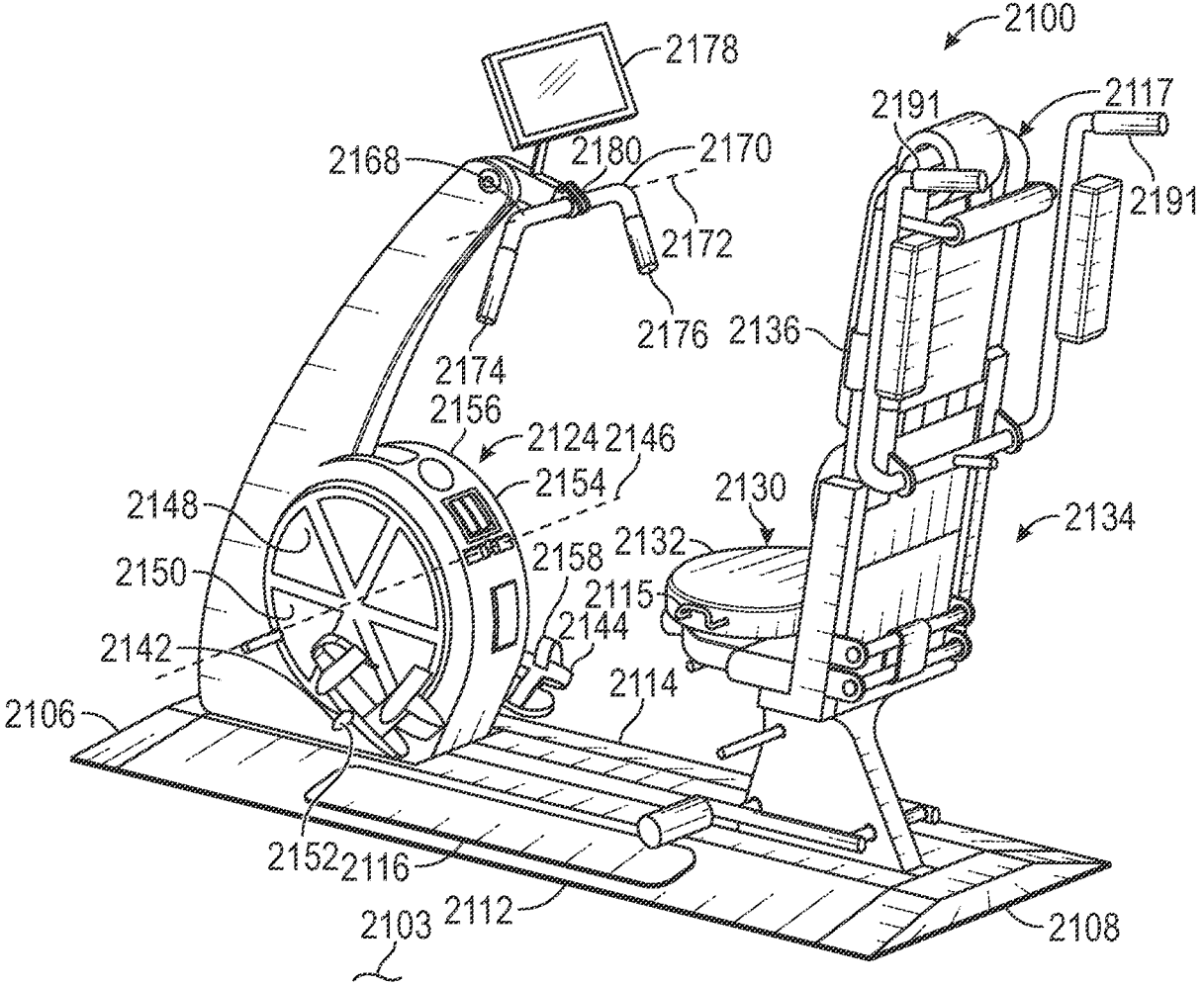
Figure 31:
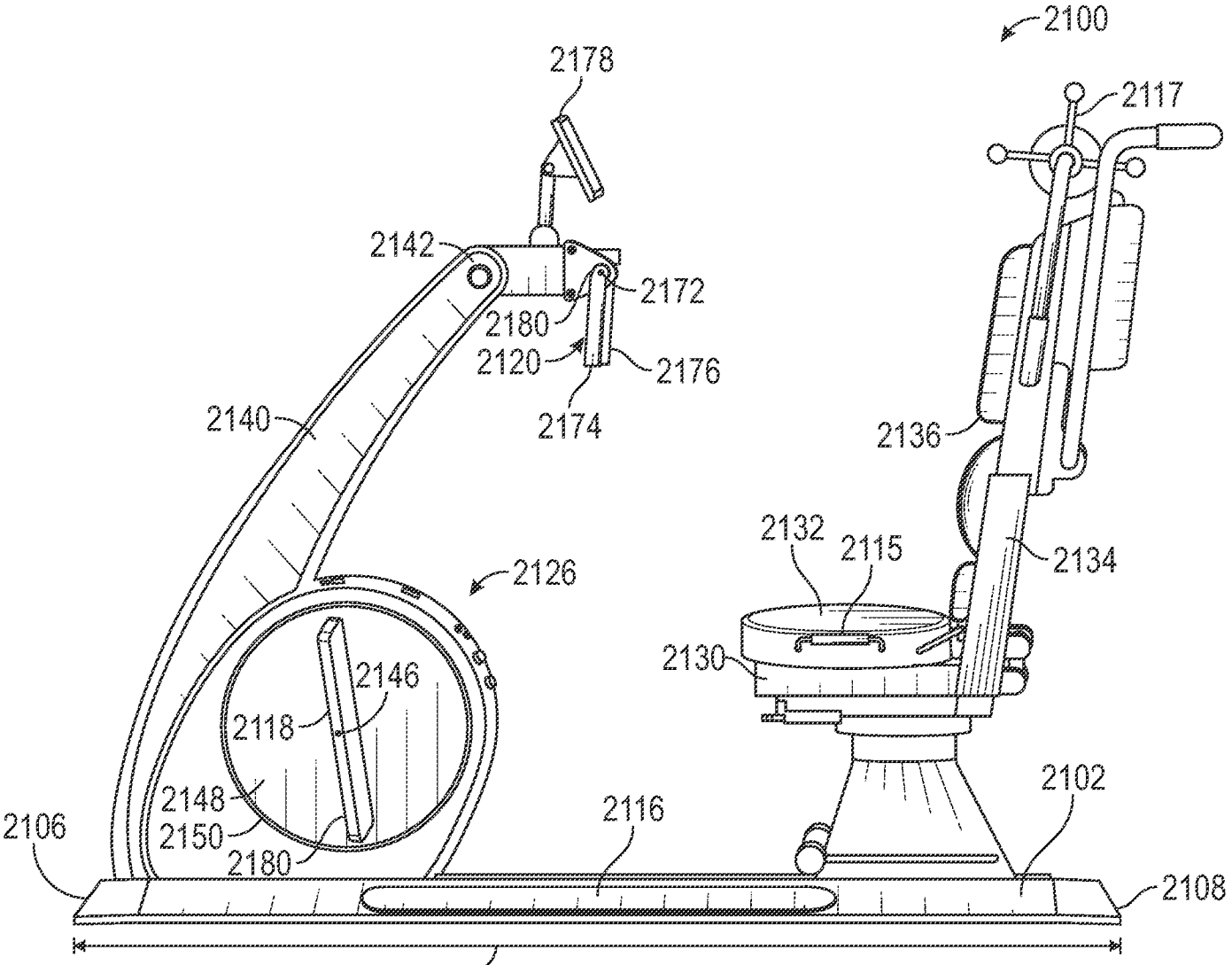

In some embodiments, a "coupling" between two exercise machines of an exercise system also can include a wireless coupling. As a result, in some embodiments, the wireless coupling can represent the only coupling between two exercise machines of an exercise system. However, an exercise system may include a coupling defined by, e.g., mechanical, electrical, and/or a wireless coupling. FIG. 27 illustrates a schematic view of an embodiment of an exercise system 1210 that includes an exercise machine 1212A in communication with an exercise machine 1212B, in accordance with some embodiments. As shown, the exercise machines 1212A, 1212B can include processors 1242A, 1242B, respectively. Also, the exercise machines 1212A, 1212B can include memories 1260A, 1260B, respectively. The processors and memories of the exercise machines 1212A, 1212B may include features previously described for the exercise machine 1112 (in FIG. 26), the one or more processors 1142 and the memory 1160, respectively, of the exercise machine 1112.

In some instances, the exercise machines 1212A, 1212B can be in communication with each other without the use of physical coupling mechanisms. For example, the exercise machines 1212A, 1212B may include wireless communication circuitry 1274A and wireless communication circuitry 1274B, respectively. Each of the wireless communication circuitry 1274A, 1274B may include components designed for communication via any number of wireless communication protocols, including at least one of a IEEE 802.11 protocol)(WI-FI®, BLUETOOTH®, a global network (e.g., the Internet), a wide area network, a local area network, a wireless personal area network (WPAN), or NFC protocol, as non-limiting examples. The wireless communication circuitry 1274A, 1274B may include transceiver circuitry 1276A, 1176B, respectively. Based on the wireless communication circuitry 1274A, 1274B, the exercise machine 1212A can send and receive information to/from the exercise machine 1212B, and vice versa.

Embodiments of the exercise system can include numerous different exercise stations and workouts. For examples, the exercise system can include a total of at least four, five or six different exercise stations. The exercise system can include a total of at least seven, eight, nine or even ten different exercise stations, in other versions.

Additional Grip Strength Embodiments

Grip strength has been correlated with overall physical and mental wellbeing. Grip strength measurements can be used in conjunction with and/or to guide, assist, or enhance exercise and rehabilitation of a user. Accordingly, a more effective exercise apparatus is needed. More specifically, there is a need for an exercise apparatus that provides isometric and dynamic exercise and that can, during a grip-strengthening-style exercise, measure a grip strength of the user. Aspects of the present disclosure are related to such an exercise apparatus.

Referring to the FIGS. 28-56, wherein like numerals indicate corresponding parts throughout the views, embodiments of exercise machines are shown. More specifically, and with references to FIGS. 28-31, is a first exemplary embodiment of an exercise machine 2100 for exercising at least one body part of a user. The exercise machine 2100 can include a base 2102 that can support the exercise machine 2100, and the base 2102 may be configured to rest on a ground surface 2103. The base 2102 may extend longitudinally and can define a base length 2104 from a first base end 2106 to a second base end 2108. The base 2102 may also extend laterally and can define a base width 2110 from a first base side 2112 to a second base side 2114. The base 2102 may also define at least one base foot area 2116 disposed centrally between the base ends 2106, 2108 and adjacent to one of the first and second base sides 2112, 2114. The at least one foot area 2116 is textured to prevent a user from slipping when standing on the at least one foot area 2116. As shown, the at least one base foot area 2116 can include a pair of base foot areas 2116. Each of the pair of base foot areas 2116 may extend longitudinally a foot area distance along each of the first base side 2112 and the second base side 2114. The pair of base foot areas 2116 can also each extend laterally toward an opposite one of the first base side 2112 and the second base side 2114.

In addition, the exercise machine 2100 may include at least one osteogenic or isometric device (hereinafter referred to as an "isometric device"). Hereafter, the isometric device may refer to any one of the isometric devices 2115, 2117, 2118, 2119, 2120, 2174, 2176, 2191, 2221, 2222, 2323, 2324, 2423, 2424, 2425, 2521, 2525. The isometric device can be coupled to the base 2102. During an isometric exercise sufficient to facilitate osteogenesis and/or muscle hypertrophy, the isometric device can be configured to receive an application of force by the user. Moreover, and in certain embodiments of the exercise machine, the isometric device can be configured to be grasped by a hand of the user. The application of force, by the user, to the isometric device can be a pulling-type, pushing-type, or grasping-type force. It should be appreciated that the terms "apply force" or "application of force" can include a single force, more than one force, or a range of forces.

The exercise machine 2100 can also include at least one dynamic device 2126 that can be coupled to the base 2102. It should be appreciated that a dynamic device can be further defined, but is not limited to, a device that that has moving parts and is configured to facilitate at least one dynamic exercise of a user. The at least one dynamic device 2126 may be configured to be movable in response to selective engagement by the user to provide a dynamic exercise for the user and to facilitate osteogenesis and/or muscle hypertrophy.

The exercise machine 2100 may additionally include a seat 2130 having a seating platform 2132 that can be coupled to the base 2102. The seating platform 2132 can, for example, extend outwardly from the base 2102 away from the ground surface 2103. Thus, the seating platform 2132 can define a seating surface for supporting the user in a seating position, the seating surface extending longitudinally, laterally and parallel to the base 2102. A back portion 2134 may also extend in a back rest direction from the seating platform 2132 away from the ground surface 2103. The back portion 2134 can also define a back rest portion 2136 in a seated position, the back rest portion extending to the seat 2130 to abut a back of the user. A position of the seating platform 2132 and/or back rest portion 2136 may additionally be adjustable in a horizontal and/or vertical dimension. In some embodiments, the angle of the seat 2130 is adjustable. According to other aspects, the angle of the back rest portion 2136 is adjustable. Examples of how adjustments to the seat 2130 and back rest portion 2136 can be implemented include, but are not limited to, using telescoping tubes and pins, hydraulic pistons, electric motors, etc. The seating platform 2132 may further include a fastening system (not shown), such as a seat belt, for securing the user to the seat 2130. The fastening system could additionally or alternatively include a passive bar under which the user can secure their knees or thighs.

In some embodiments, a pair of upper seat handles 2117 can be adjustably coupled to the back rest portion 2136. The pair of upper seat handles 2117 can be configured to rotate about respective upper seat handle axes 2138. Specifically, such upper seat handle axes 2138 can extend laterally relative to and may be spaced from the ground surface 2103. A position of the pair of upper seat handles 2117 may also be adjustable. Additionally, a pair of lower seat handles 2115 can be coupled to the seat 2130. Further yet, a pair of arm support handles 2191 can be pivotably coupled to the back rest portion 2136. The lower and upper seat handles 2115, 2117, and the pair of arm support handles 2191 may each be configured to be gripped by the user to facilitate a grip-strengthening-style exercise, and to facilitate at least one of osteogenesis and muscle hypertrophy.

The exercise machine 2100 can further include a main post 2140 that may be coupled to the base 2102. The main post 2140 can be in a spaced relationship relative to the seating platform 2132 at the first base end 2106. In addition, the main post 2140 can extend outwardly from the base 2102 and away from the ground surface 2130 to a distal post end 2142.

According to an aspect, the at least one dynamic device 2126 can be a cycle mechanism 2126. The cycle mechanism 2126 can be attached to the base 2102 adjacent to the main post 2140. In more detail, the cycle mechanism 2126 may include at least one pedal 2142, 2144 that can be configured to allow the user to engage and move the cycle mechanism 2126. The at least one pedal 2142, 2144 of the cycle mechanism 2126 can include a first pedal 2142 and a second pedal 2144. Each pedal 2142, 2144 may be offset from and rotatable about a cycle axis 2146 centrally located in the cycle mechanism 2126. Specifically, the cycle axis 2146 can extend laterally relative to and can be spaced from the ground surface 2103. The cycle axis 2146 may also be transverse to a post direction in which the main post 2140 extends.

In one example, the cycle mechanism 2126 can also include a first disc 2148 that may extend radially from the cycle axis 2146 to a first disc perimeter 2150. A first pedal axle 2152 can extend from the first disc 2148. The first pedal axle 2152 may extend along and be offset from the cycle axis 2146. Therefore, the first pedal axle 2152 can be configured to rotatably support the first pedal 2142. Similarly, the cycle mechanism 2126 can also include a second disc 2154 that may extend radially from the cycle axis 2146 to a second disc perimeter 2156. The second disc 2154 can be spaced axially from the first disc 2148. A second pedal axle 2158 can extend from the second disc 2154. The second pedal axle 2158 may extend along and be offset from the cycle axis 2146. Thus, the second pedal axle 2158 can be configured to rotatably support the second pedal 2144. As an alternative to the first disc 2148 and the second disc 2154, the cycle mechanism 2126 may include a shaft that rotates in a circle, along which the pedals 2142, 2144 may transition to different positions.

In an alternative embodiment, the first disc 2148 may also include a first semicircular panel 2118 that can be hinged from and rotatable about a first centerline 2162 of the first disc 2148. The first centerline 2162 can be centrally located and can extend laterally relative to, and can be spaced from, the ground surface 2103. Therefore, the first semicircular panel 2118 can be movable to a first panel extended position. To facilitate osteogenesis in the user, the user may place their foot on the first semicircular panel 2118 in such a position. Likewise, the second disc 2154 may also include a second semicircular panel 2119 that can be hinged from, and rotatable about a second centerline 2166, of the second disc 2154. As with the first centerline 2162 of the first disc 2148, the second centerline 2166 can be centrally located, and extend laterally relative to, and be spaced from the ground surface 2103. Thus, the second semicircular panel 2119 can be movable to a second panel extended position. While the second semicircular panel 2119 is in the second panel extended position, the user may place their foot thereon to facilitate osteogenesis.

In some embodiments, the exercise machine 2100 can also include a lateral bar 2120 that may be coupled to the distal post end 2142 of the main post 2140. The lateral bar 2120 can extend laterally relative to and be spaced from the ground surface 2103. The lateral bar 2120 can extend from a first lateral bar end 2168 to a second lateral bar end 2170 to define a lateral bar axis 2172. The lateral bar axis 2172 may be orthogonal to the post direction of the main post 2140. The lateral bar 2120 may include a first bar handle 2174 that can extend from the first lateral bar end 2168. As a result, the first bar handle 2174 can be transverse to the lateral bar axis 2172. The lateral bar 2120 may also include a second bar handle 2176 that may extend from the second lateral bar end 2170. Thus, the second bar handle 2176 can be transverse to the lateral bar axis 2172. To facilitate a grip-strengthening-style exercise and to facilitate osteogenesis and/or muscle hypertrophy, the first bar handle 2174 and second bar handle 2176 can be configured to be gripped by the user.

In certain embodiments, a sensor 2173 can be coupled to one or more of the isometric devices of the exercise machine 2100. In some embodiments, sensor 2173 can be coupled to one of the isometric devices such as the first or second bar handles 2174, 2176, the lower or upper seat handles 2115, 2117, or the arm support handles 2191. It should be appreciated that the sensor 2173 may be attached to any other handle, or like mechanism, of the exercise machine 2100. It is further yet to be appreciated that the isometric device may be detachable from the exercise machine 2100. That is, the isometric device may be a stand-alone apparatus, separate and apart from the exercise machine 2100.

The sensor 2173 can be configured to facilitate a measurement of the grip strength of the user when the isometric device is grasped, gripped, clenched, or otherwise engaged, by the user. It should be understood that the terms "gripped," "grasped," "clenched," or "otherwise engaged" in any tense (past, present, or future) may be used interchangeably herein. For example, and in a grip-strengthening-style exercise, a user may grasp the isometric device with a hand, foot, or any other extremity, prosthetic or otherwise. When the user grips the isometric device, the sensor 2173 measures the grip strength of the user. In other words, the sensor 2173 senses and/or measures the grip force the user is applying to the sensor 2173. In an embodiment, the sensor 2173 may be a load cell configured to facilitate the measurement of the grip strength of the user. Such a load cell is further described below. The sensor 2173 may also be configured to provide resistance on-demand to challenge the grip strength of the user.

In another embodiment, the sensor 2173 can comprise a strain gauge configured to facilitate the measurement of the grip strength of the user. The strain gauge can be any suitable type of strain gauge. For example, the strain gauge can be any mechanical, magnetic, optical, acoustical, pneumatic, or electrical type strain gauge. Such strain gauges could include extensometers or semiconductor, photoelectric, metallic, diffused-semiconductor, or thin-film or bonded resistance strain gauges. In yet another embodiment, the sensor 2173 could be a pressure sensitive sheet. By using a pressure sensitive sheet, the grip strength of the user can be measured over an area of the isometric device.

The sensor 2173 could further be a hydraulic load cell configured to facilitate the measurement of the grip strength. The hydraulic load cell can include a bladder containing a fluid. When the bladder is grasped, the change in fluid pressure is measured and correlated to the force being applied to the bladder by the grip of the user. It is also to be appreciated that the hydraulic load cell is envisioned as encompassing any device wherein a fluid is displaced and a force of the grip of the user can be measured.

According to an aspect, the exercise machine 2100 can further include a control console 2178. The control console 2178 may include a display configured to display information to the user during use of the exercise machine 2100. For example, the display can display a representation of the measurement of the grip strength. The representation of the measurement of the grip strength could be a numerical value, a color corresponding to a measurement, or any other suitable type of representation of the measurement. Moreover, the display can display the representation of the measurement over time. For example, the representation of the measurement over time can be displayed as a graph. Further yet, the representation of the measurement of the grip strength can be displayed over an area. For example, and when the sensor is a pressure sensitive sheet, the display can illustrate the isometric device and the forces applied to the areas of the isometric device being gripped by the user.

For example, a virtual model of the isometric device may be presented on the display and the areas where forces are applied may be updated in real-time or near real-time (e.g., less than 2 seconds) on the display. Such active updating of the areas of the isometric device on the virtual model may provide an enhanced user interface that may increase the user's experience using the control console 2178, exercise machine 2100, or both.

The control console 2178 may include a speaker that can be used to communicate instructions to the user regarding use of the exercise machine 2100. In one example, a remote individual may provide instructions to the user through the speaker. Such information and instructions may be provided to the user prior to, during, and/or after an exercise. This could include information on how to perform the exercise, feedback regarding how much force is being applied, a target force to be applied, historical information for the user about how much force they applied at prior sessions, comparisons to averages, etc. The information and instructions may be provided during a telemedicine, telehealth, teletherapeutic, etc. session where a medical professional is viewing the grip strength measurements in real-time on a computing device distal from the control console 2178 and provides the information and instructions in real-time or near real-time.

The control console 2178 may include a control system. The control system can be operatively coupled to the sensor 2173, wherein the control system is configured to receive, from the sensor 2173, the measurement of the grip strength of the user. The control system may have any combination of memory storage such as random-access memory (RAM) or read-only memory (ROM). The control system may also include a processor, or similar processing resources, microcontroller, central processing unit (CPU), hardware, or software control logic to provide information to and instruct the user regarding use of the exercise machine 2100. The processor can be configured to receive the measurement of the grip strength from the sensor 2173. It is to be appreciated that the control system may be located anywhere in the exercise machine 2100. For example, the control system may be located in a control box.

The control system may be configured to control operation of the exercise machine 2100. For example, the control system may determine that the grip strength of the user has increased above a threshold amount. Based on the determination that the grip strength of the user increasing above the threshold amount, the control system may transmit control instructions to the sensor 2173 to increase the resistance provided by the sensor 2173. Increasing the resistance may challenge the muscles of the user to grip the sensor 2173 harder, and over time, may increase the grip strength of the user beyond what could be achieved without increasing the resistance. Further, if the control system determines that the grip strength of the use is below a threshold amount for a period of time, the control system may transmit control instructions to the sensor 2173 to decrease resistance to provide easier exercises for the user and to aid in improving the grip strength of the user. The control system may be communicatively coupled to one or more other computing devices that are authorized to control the exercise machine 2100. For example, the control system may be coupled to a computing device of a medical professional (e.g., doctor, physician, physical therapist, nurse, etc.) during a telemedicine session and the computing device of the medical professional may monitor the grip strength of the user in real-time and provide control instructions to control operation of the exercise machine 2100.

The control console 2178 may also include one or more wireless, wired or any combination thereof of communication ports. Such communication ports can enable communication with external resources as well as with various input and output (I/O) devices, such as a keyboard, a mouse, pointer, touch controller, cell phone, personal electronic device and display device. The control console 2178 may also include one or more buses operable to transmit communication of management information between the various hardware components. Finally, the control console 2178 can communicate using wire-line-communication data buses, wireless network communication, or any combination thereof.

A plurality of load cells 2180 can be electrically coupled (e.g., wired or wireless) to the control console 2178. The plurality of load cells 2180 may be mechanically coupled to the at least one dynamic device 2126 and/or the at least one isometric device. The plurality of load cells 2180 can sense at least one load during the isometric exercise and the dynamic exercise and may output a signal corresponding to the at least one load. Based on the output signals from the load cells 2180, the control console 2178 can display the output from the load cells 2180, and the user, or other person (e.g., a trainer, a nurse, a technician, a rehabilitation specialist, a physician, etc.) may interact with the console 2178 to select a program or exercise routine to be executed.

Figure 32:
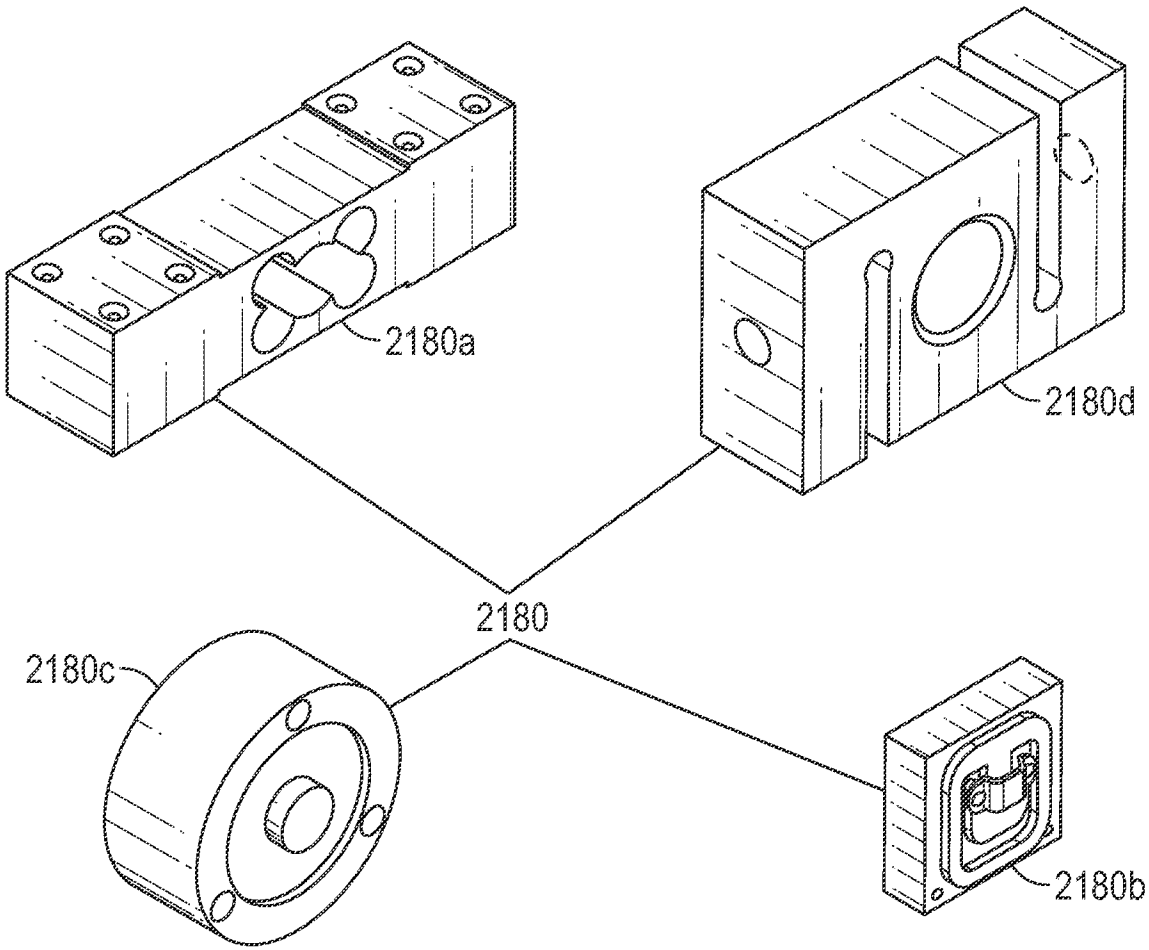
FIG. 32 shows examples of a plurality of load cells that can be used in the exercise machine, according to aspects of the disclosure.

FIG. 32 depicts several options for the plurality of load cells 2180. In some embodiments, the load cells 2180 can be piezoelectric load cells, such as PACEline CLP Piezoelectric Subminiature Load Washers. In other embodiments, the load cells can be hydraulic load cells, such as NOSHOK hydraulic load cells. In some versions, the plurality of load cells 2180 can include a plurality of strain gauges. Embodiments of the load cells can be bending-type load cells, such as Omega SGN-4/20-PN 4 mm grid, 20 ohm nickel foil resistors. Other examples of the plurality of load cells can be double-beam-type load cells **2180*a*, such as Rudera Sensor RSL 642 strain gauges. Still other embodiments of the plurality of load cells can be half-bridge-type load cells 2180*b*, such as Onyehn 4 pcs 50 kg Human Scale Load Cell Resistance Half-bridge/Amplifier Strain Weight Sensors with 1 pcs HX711 AD Weight Modules for Arduino DIY Electronic Scale strain gauges. In some embodiments, the load cells can be S-type load cells 2180*c*, such as SENSORTRONICS S-TYPE LOAD CELL 60001 load cells. Additionally, the load cells can be button-type load cells 2180*d*, such as Omega LCGB-250 250 lb Capacity Load Cells. Naturally, the plurality of load cells 2180** can comprise combinations of these various examples. The embodiments described herein are not limited to these examples.

Figure 33:
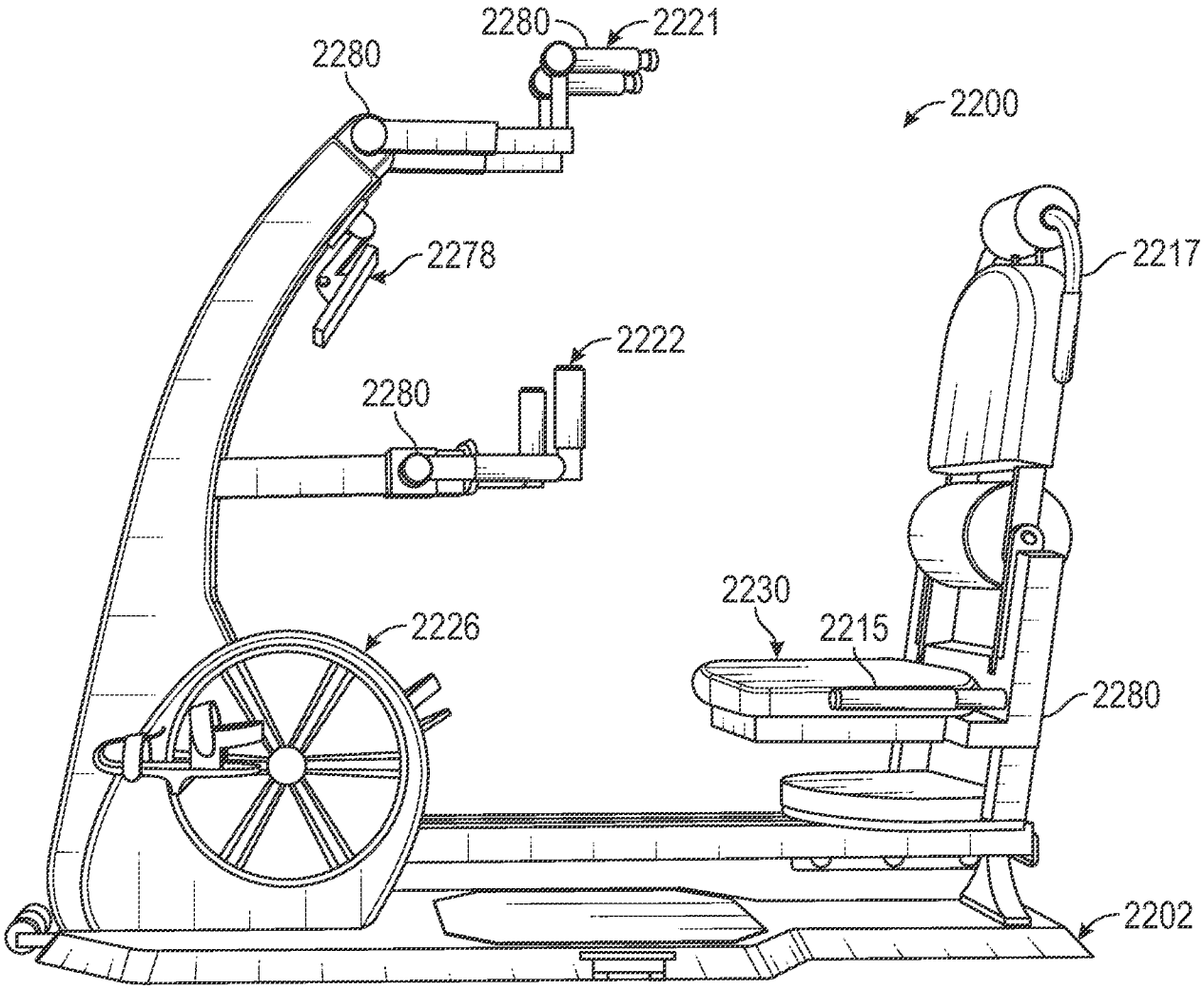
FIGS. 33-34 illustrate an alternate embodiment of an exercise machine, according to aspects of the disclosure.
Figure 34:
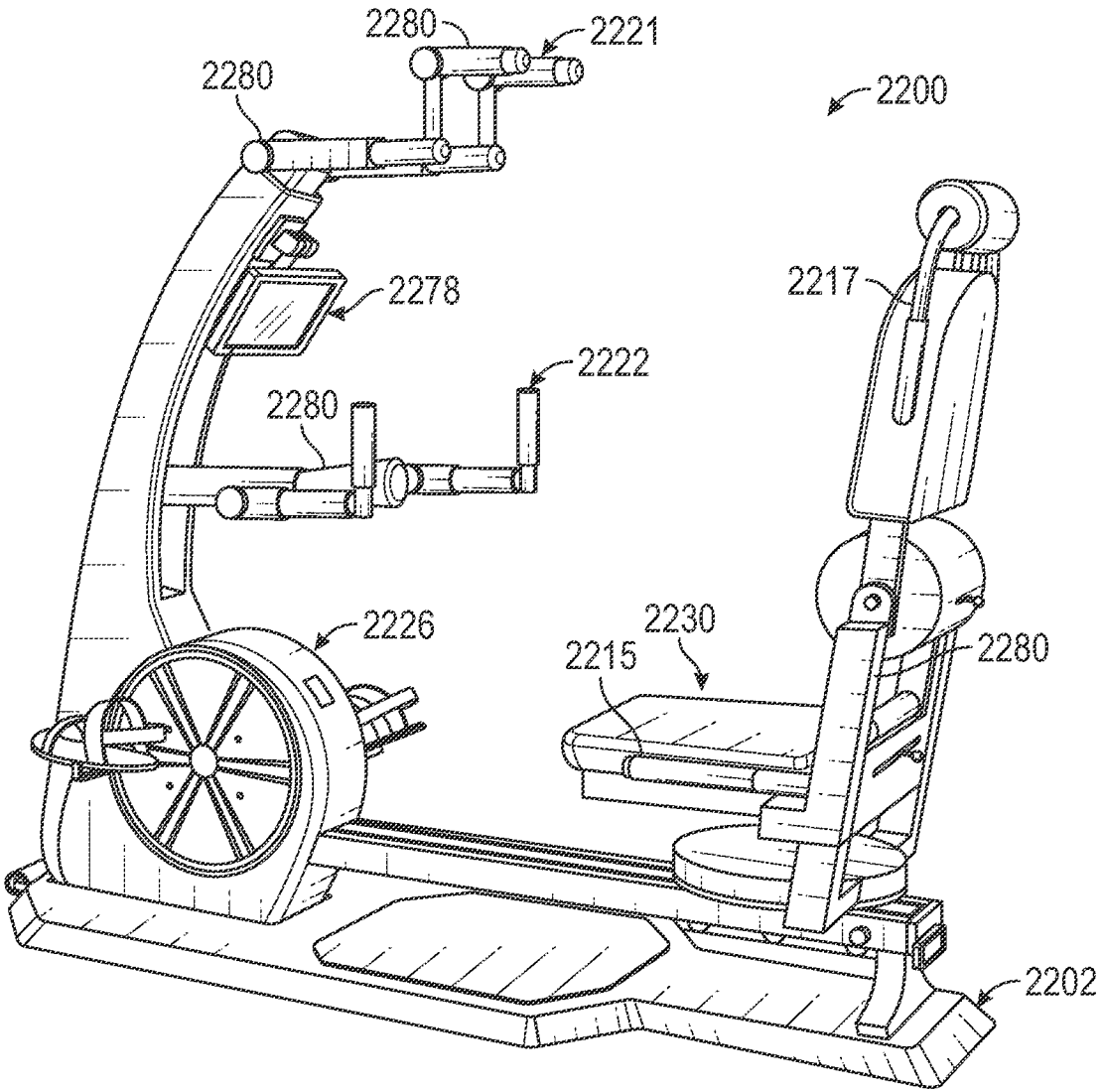
Figure 35:
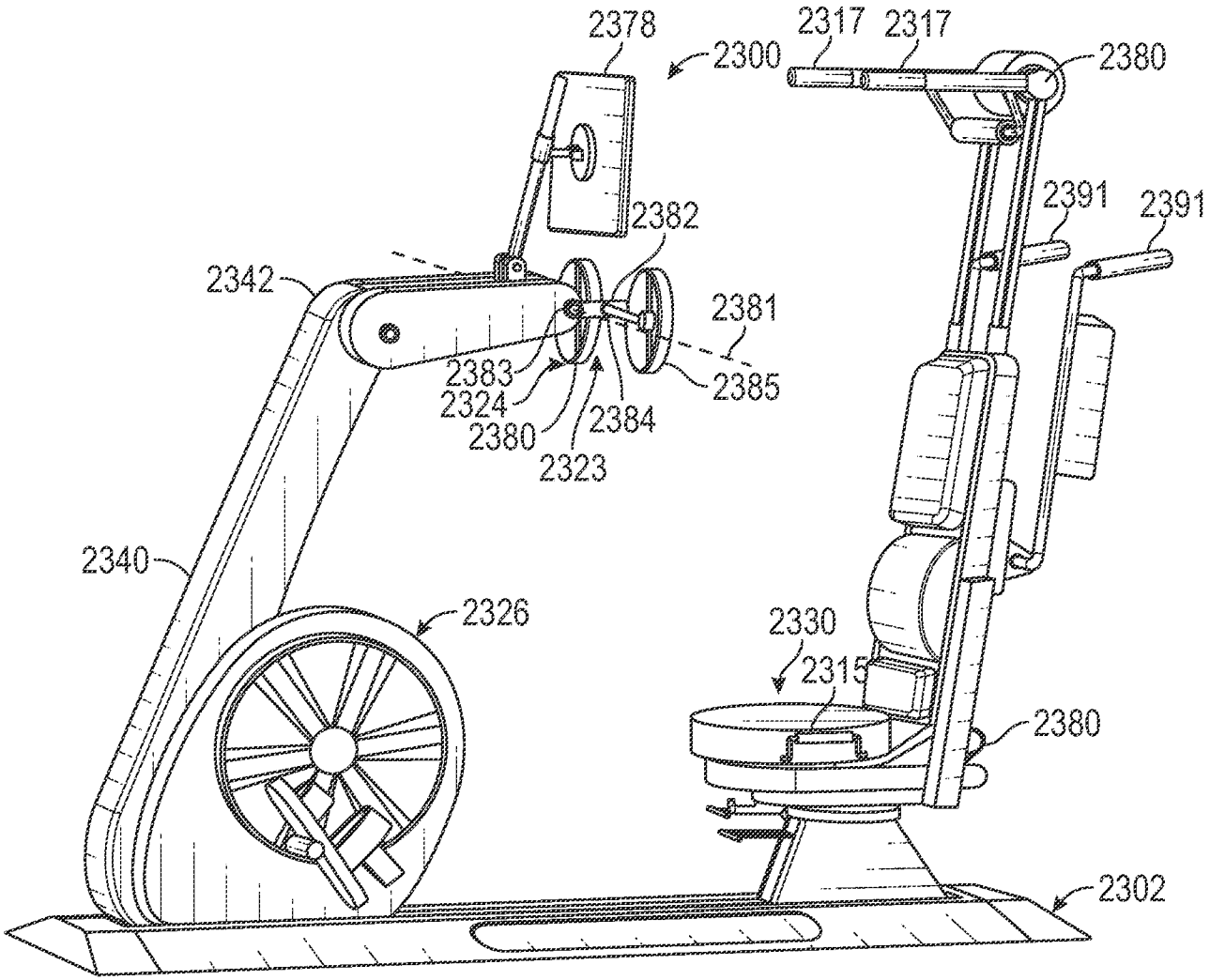
FIGS. 35-40 illustrate another alternate embodiment of an exercise machine, according to aspects of the disclosure.

FIGS. 33-34 show a second exemplary embodiment of an exercise machine 2200. The exercise machine 2200 may share similar aspects to that of the exercise machine 2100 discussed above. In addition, the exercise machine 2200 may include at least one isometric device 2221, 2222 and can additionally include at least one dynamic device 2226, 2228. More specifically, a pair of upper load handles 2221 can be located above and in front of the seat 2230. In a core-pull-style exercise, the user can apply force to the upper load handles 2221, while being constrained in the seat 2230 by the fastening system (not shown). In the core-pull-style exercise, while the lower body of the user is restrained from upward movement by the fastening system, the user can sit in the seat 2230, apply the fastening system, hold the pair of upper load handles 2221, and pull on the pair of upper load handles 2221 with their arms. In a grip-strengthening-style exercise, the user can grasp the upper load handles 2221, while remaining seated.

According to an aspect, adjustments can be made to the position of the pair of upper load handles 2221. For example, these adjustments can include the height of the pair of upper load handles 2221, the distance between the pair of upper load handles 2221 and the seat 2230. The adjustments may also include the distance between each handle of the pair of upper load handles 2221, the angle of the upper load handles 2221 relative to the user, etc. In some embodiments, to account for natural differences in limb length or injuries, each handle of the pair of upper load handles 2221 can be adjusted separately.

The exercise machine 2200 may also include a pair of middle load handles 2222 that can be spaced apart from and in the front of the seat 2230. In a chest-press-style exercise, while seated, the user can apply force to the pair of middle load handles 2222. In the chest-press-style exercise, the user can sit in the seat 2230, hold the pair of middle load handles 2222, and push against the pair of middle load handles 2222 with their arms. In a grip-strengthening-style exercise, the user can grasp the middle load handles 2222.

According to an aspect, adjustments can be made to the position of the pair of middle load handles 2222. These adjustments can include the height of the pair of middle load handles 2222, or the distance between the pair of middle load handles 2222 and the seat 2230. The adjustments can also include the distance between each handle of the pair of middle load handles 2222, or the angle of the pair of middle load handles 2222 relative to the user, etc. In some embodiments, to account for natural differences in limb length or injuries, each handle of the pair of middle load handles 2222 can be adjusted separately. Based on one or more signals from the plurality of load cells 2280, feedback and instructions can be provided to the user with the control console 2278 based on one or more signals from the plurality of load cells 2280.

FIGS. 35-40 show a third exemplary embodiment of an exercise machine 2300. The exercise machine 2300 can include a first pivoting assembly 2323 that may be coupled to and pivotable about a lateral pivoting axis 2381 at the distal post end 2342. The first pivoting assembly 2323 can have a first pivoting arm 2382 that may extend therefrom, and the first pivoting arm 2383 can have a proximal first arm end 2383 and a distal first arm end 2384. A first pivoting handle 2385 can be pivotally attached to the distal first arm end 2384. The exercise machine 2300 may also include a second pivoting assembly 2324 that can be coupled to and pivotable about the lateral pivoting axis 2381 at the distal post end 2342. The second pivoting assembly 2342 can have a second pivoting arm 2386 that may extend from the lateral pivoting axis 2381, and the second pivoting arm 2386 can have a proximal second arm end 2387 and a distal second arm end 2388. A second pivoting handle 2389 can be pivotally attached at the distal second arm end 2388. The first pivoting handle 2385 and the second pivoting handle 2389 can be gripped by the user to facilitate at least one of osteogenesis and muscle hypertrophy. In a grip-strengthening-style exercise, the user can grasp the first or second pivoting handles 2385, 2389.

Figure 36:
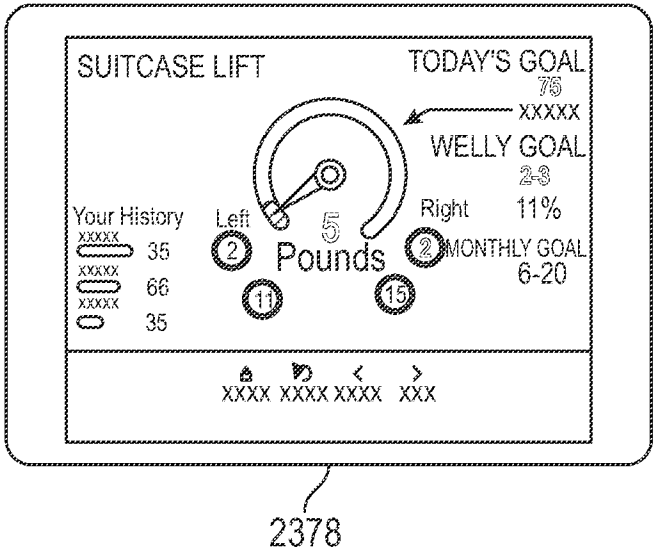
Figure 36:
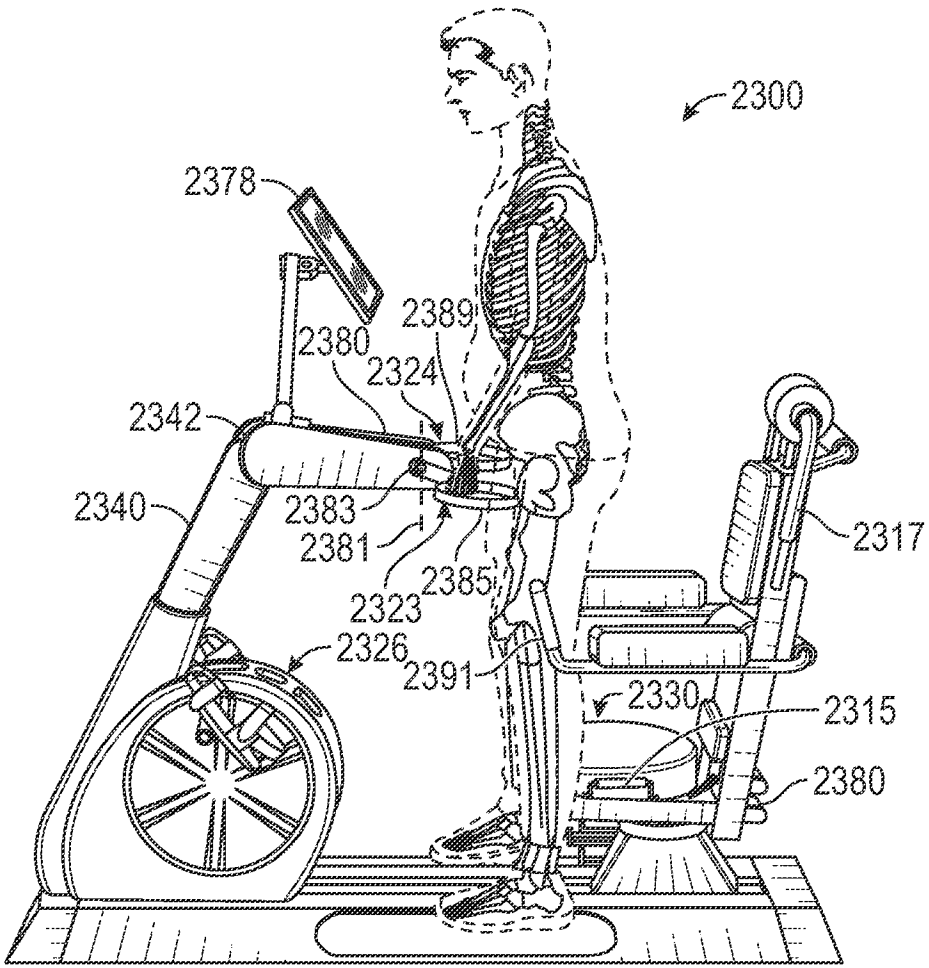
Figure 37:
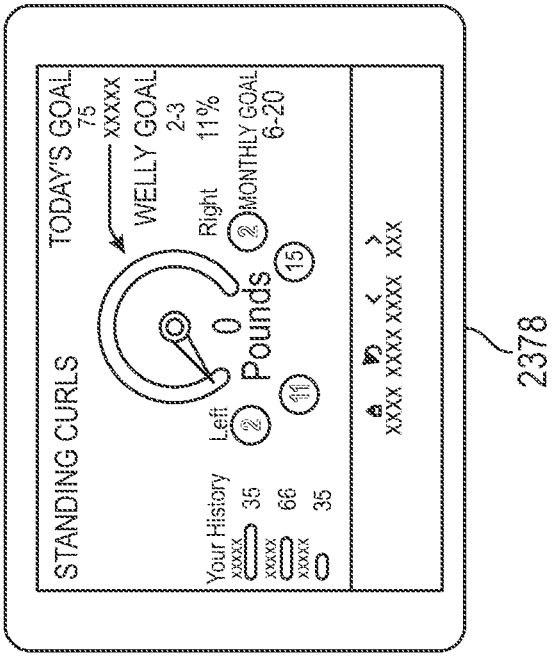
Figure 37:
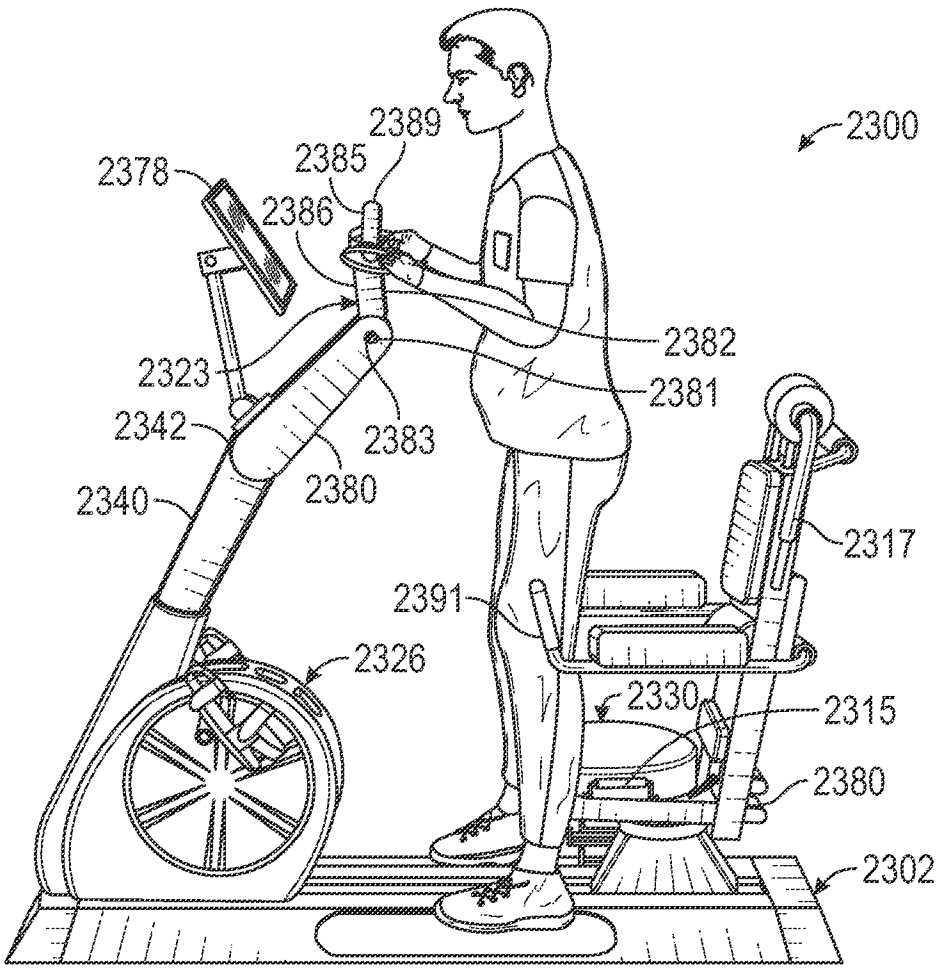
Figure 38:
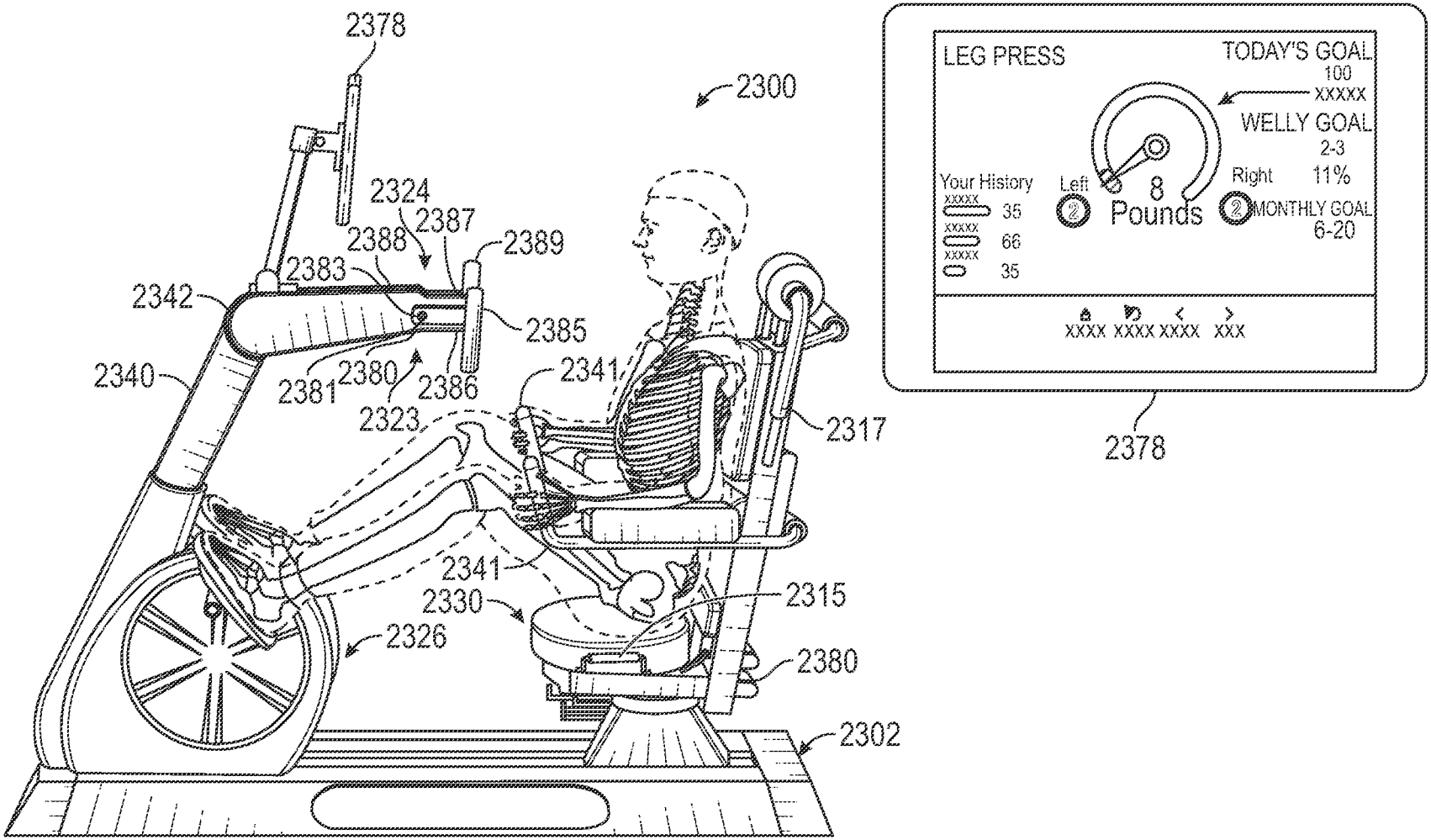
Figure 39:
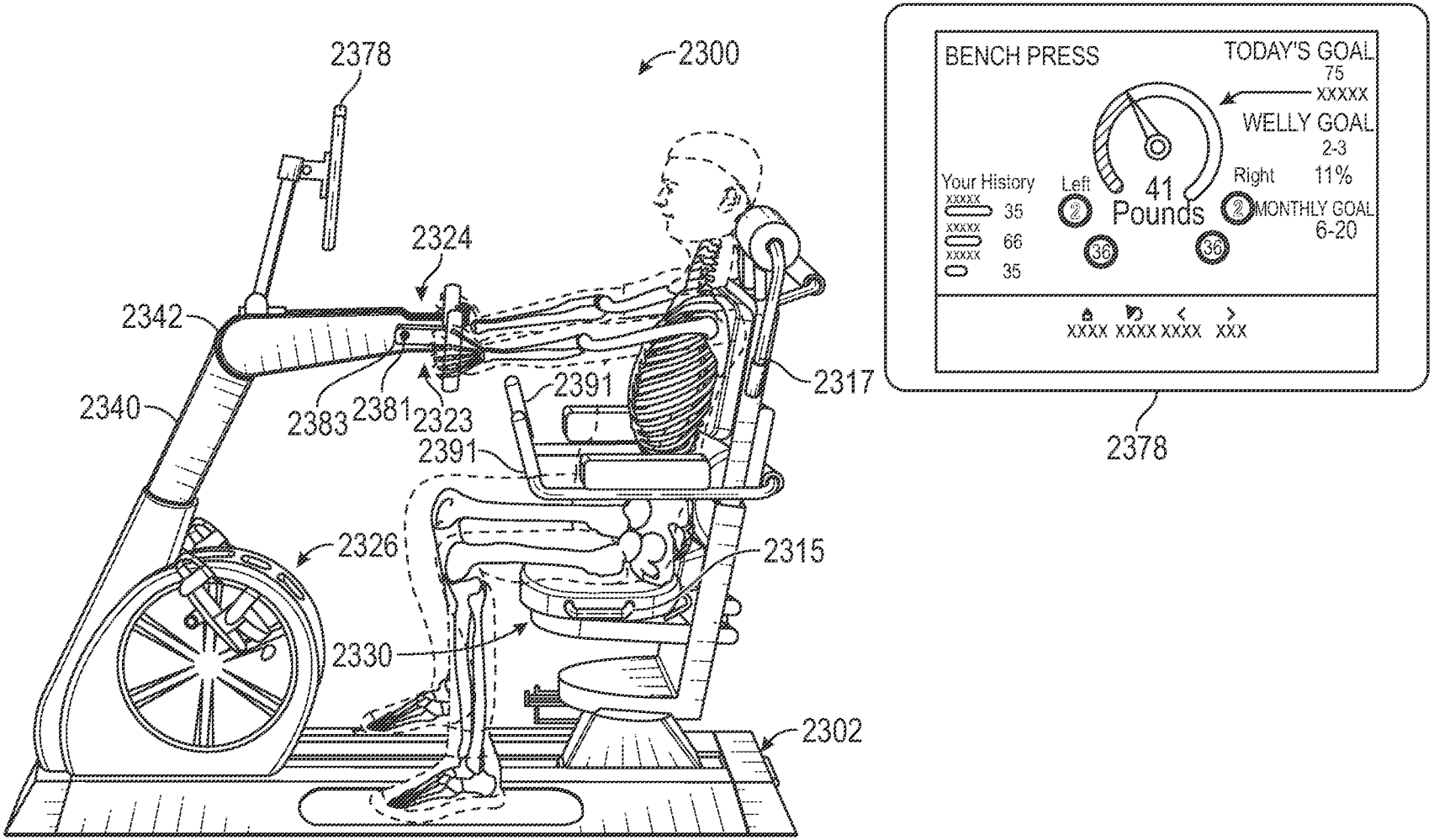
Figure 40:
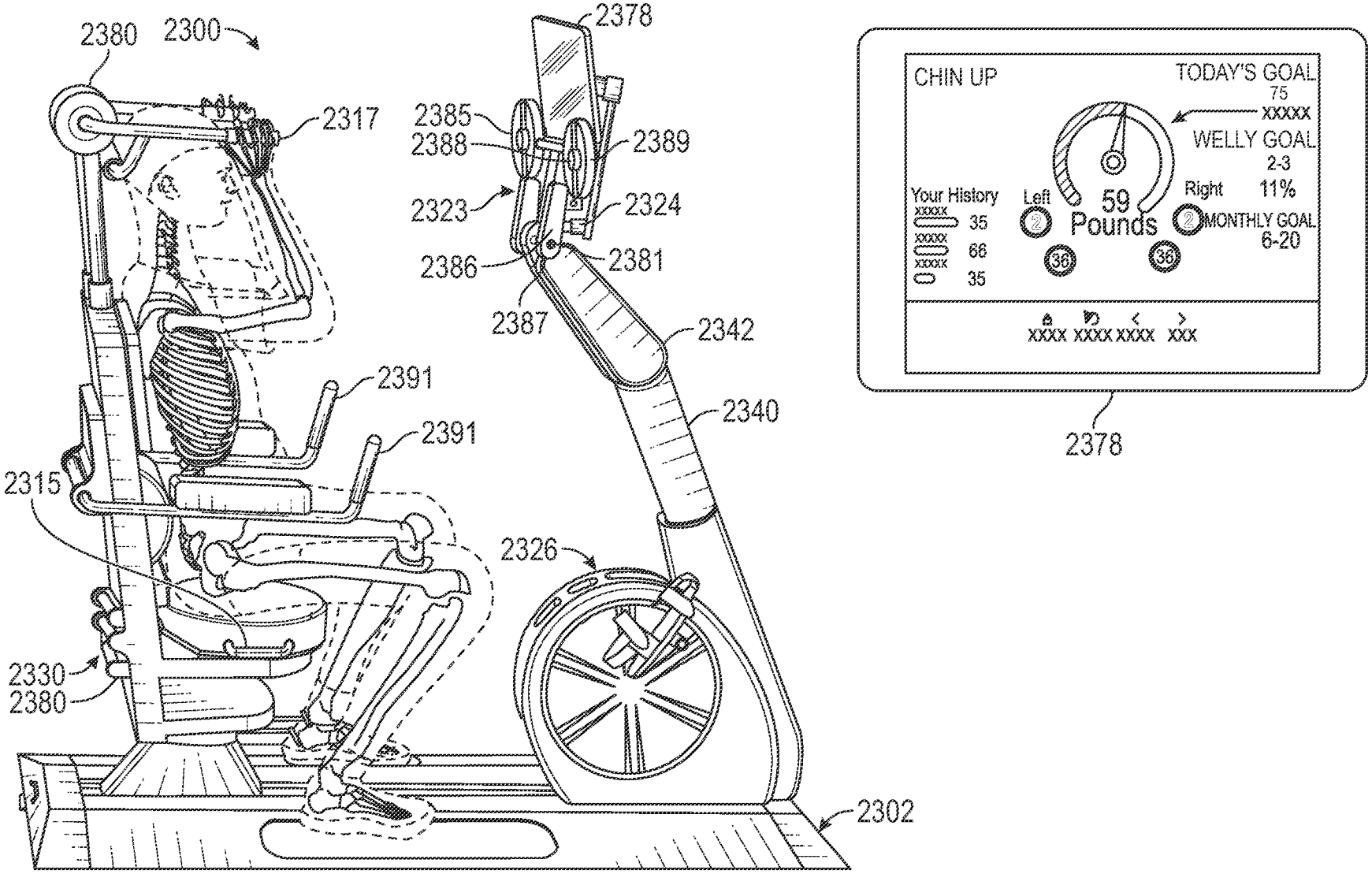

As best shown in FIG. 36, in a suitcase-lift-style exercise, the first pivoting handle 2385 and the second pivoting handle 2389 can be positioned adjacent to the seat 2330. In such a position, the user can engage the first and second pivoting handles 2385, 2389 and pull upwardly to apply a force to the first and second pivoting handles 2385, 2289 to facilitate at least one of osteogenesis and muscle hypertrophy. It should be appreciated that the first and second pivoting assemblies 2323, 2342 can be pivoted between or among a plurality of positions to allow the user to perform various other exercises with the exercise machine 2300. Such exercise can include, but is not limited to standing curls (FIG. 37), leg presses (FIG. 38), bench presses (FIG. 39), and pull downs (FIG. 40). A cycle mechanism 2326 may also be provided to enable the user to perform a cycling exercise.

Figure 41:
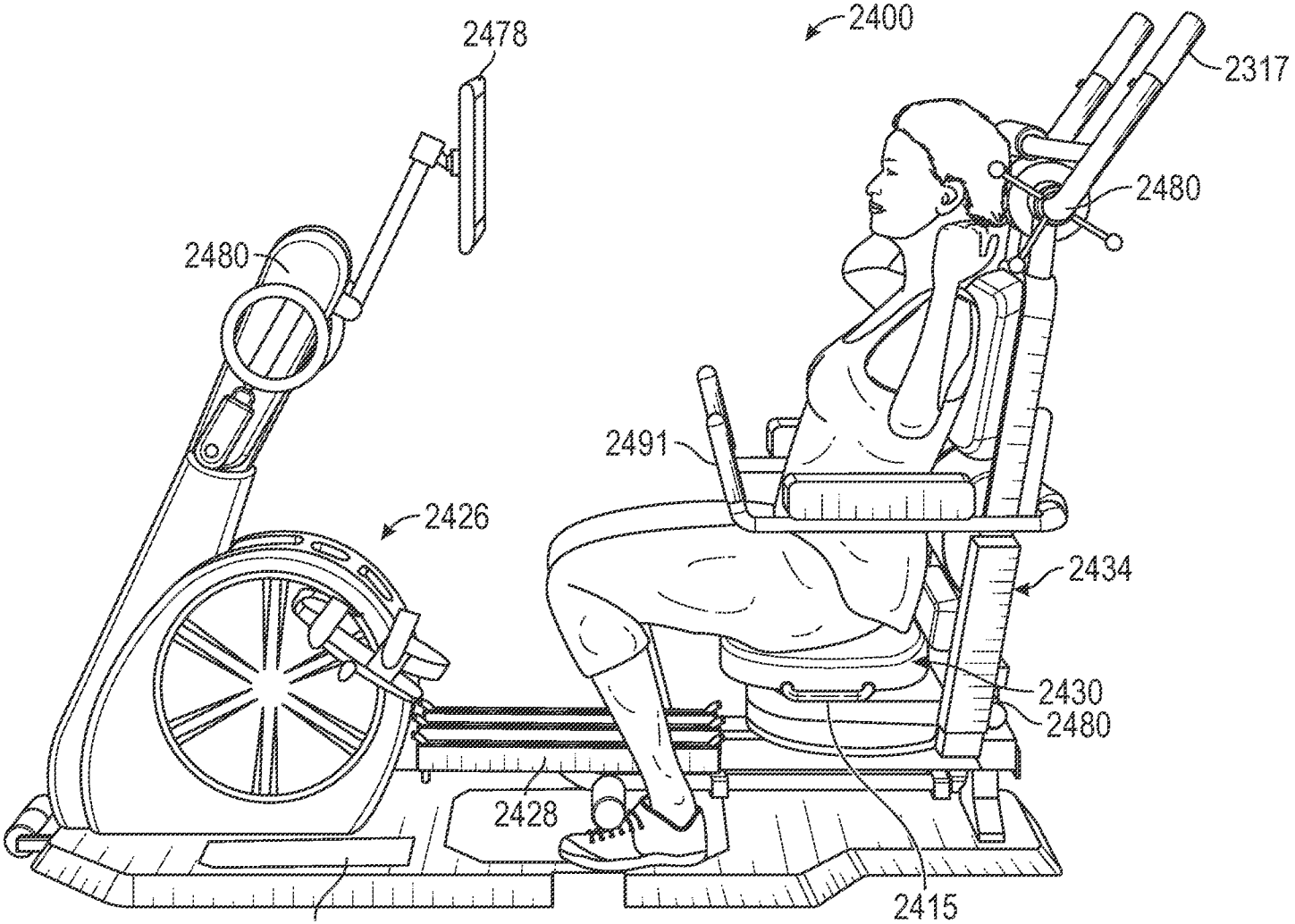
FIGS. 41-47 illustrate still another embodiment of an exercise machine, according to aspects of the disclosure.
Figure 42:
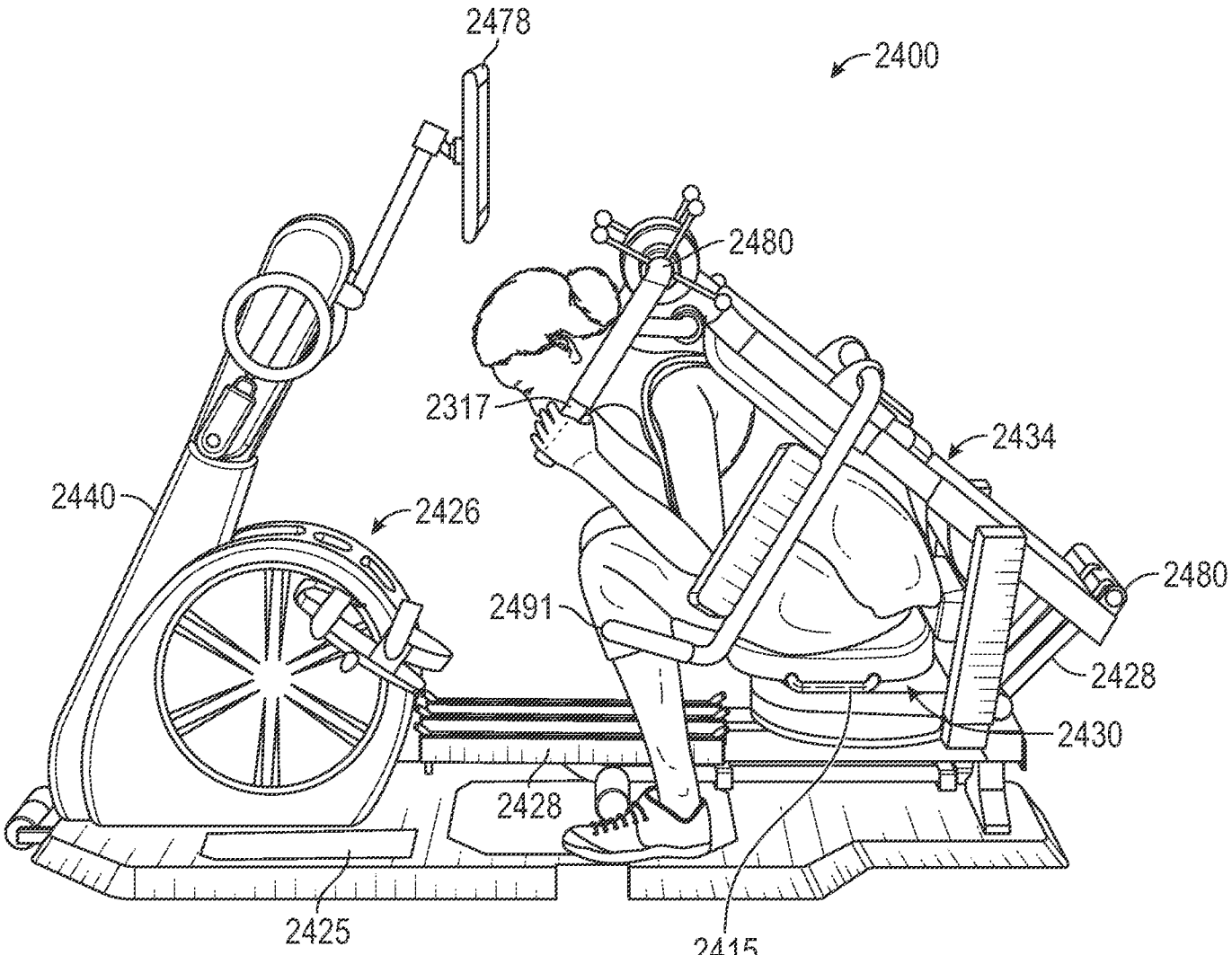
Figure 43:
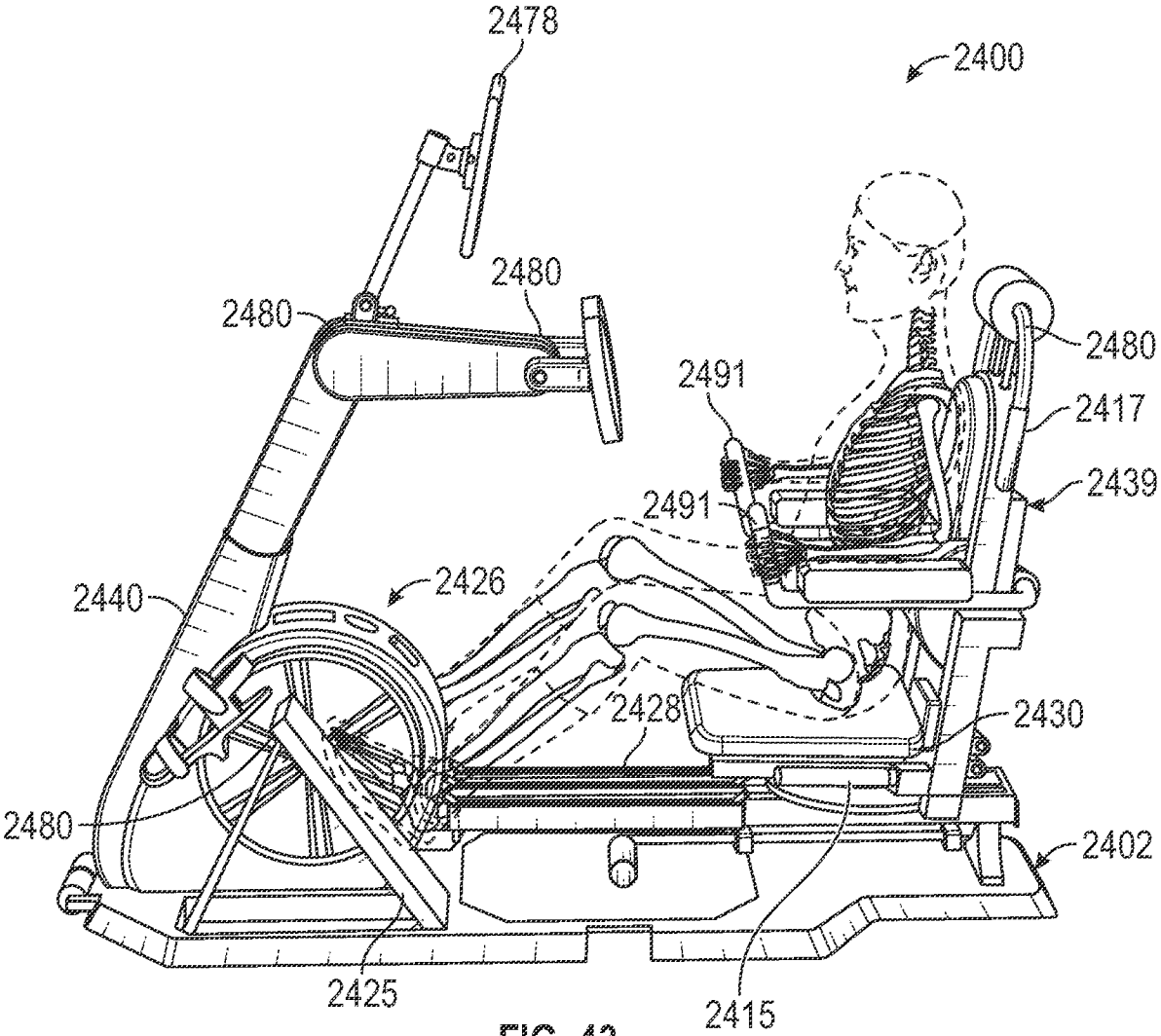

FIGS. 41-47 show a fourth exemplary embodiment of an exercise machine 2400. The exercise machine 2400 may include at least one dynamic device 2426, 2428 and at least one isometric device 2423, 2424, 2425. Specifically, the at least one dynamic device 2426, 2428 of the exercise machine 2400 can include at least one flexible band 2428. The at least one flexible band 2428 may be configured to be selectively engaged and provide resistance to the user. The at least one flexible band 2428 can, for example, stretch between the dynamic device 2426, 2428 and the seat 2430. It is also contemplated that the at least one flexible band 2428 can provide resistance to a sliding movement of the seat 2430. As best shown in FIGS. 41 and 42, the at least one flexible band 2428 can also be attached between the seat 2430 and the back portion 2434 to provide resistance for crunch-type dynamic exercises. Alternatively, or in addition to the at least one flexible band 2428, the at least one dynamic device 2428 may include an active resistance device to selectively engage and provide resistance to the user.

Figure 44:
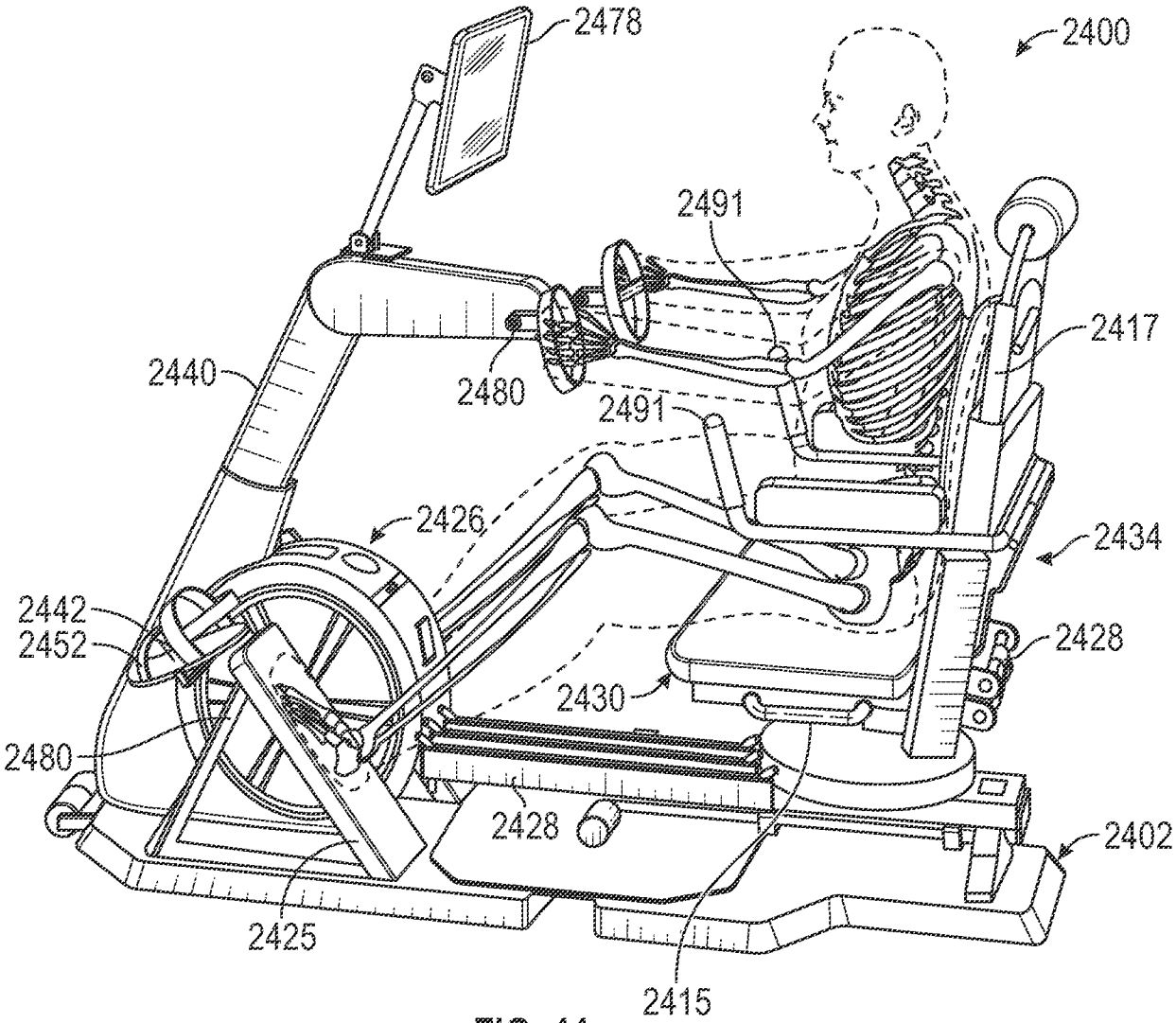
Figure 45:
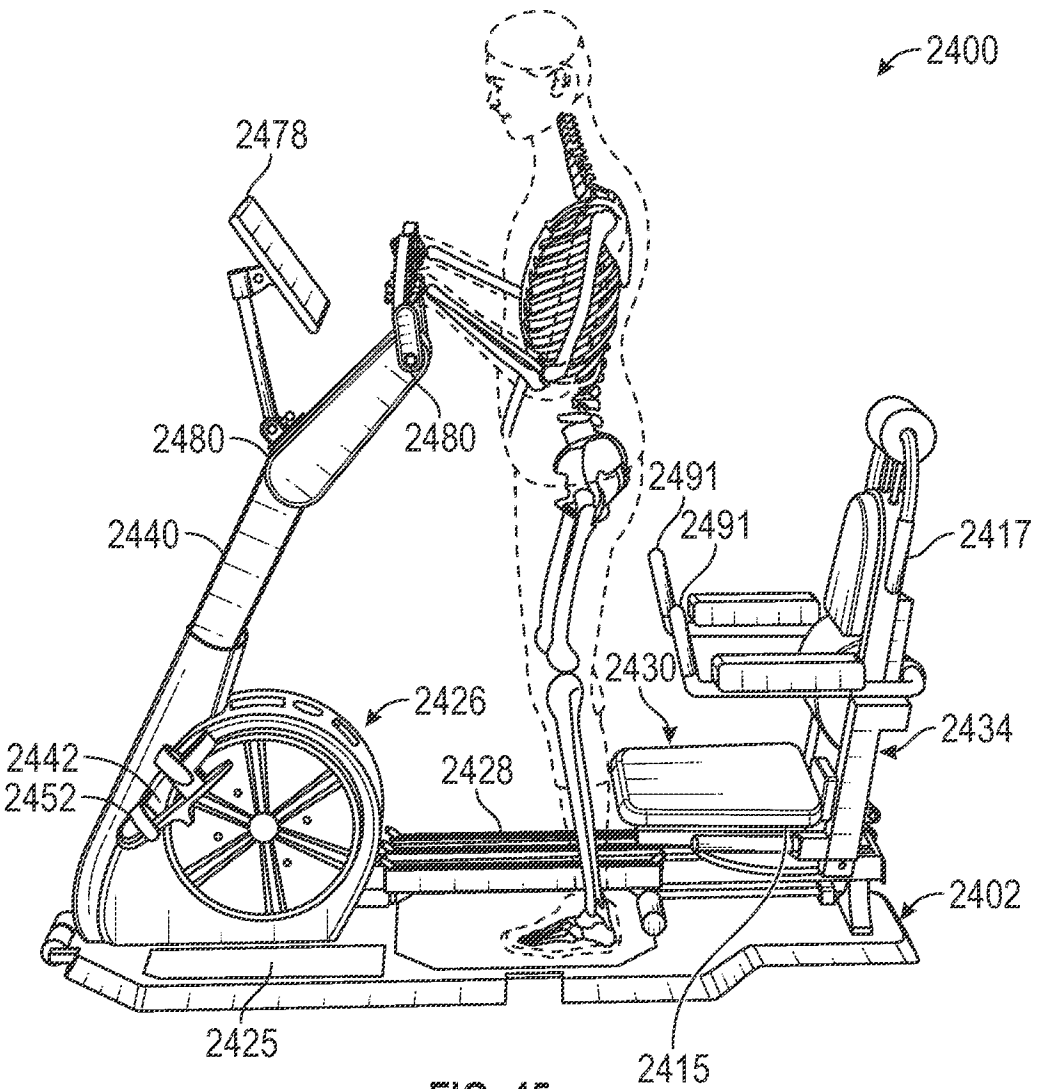
Figure 46:
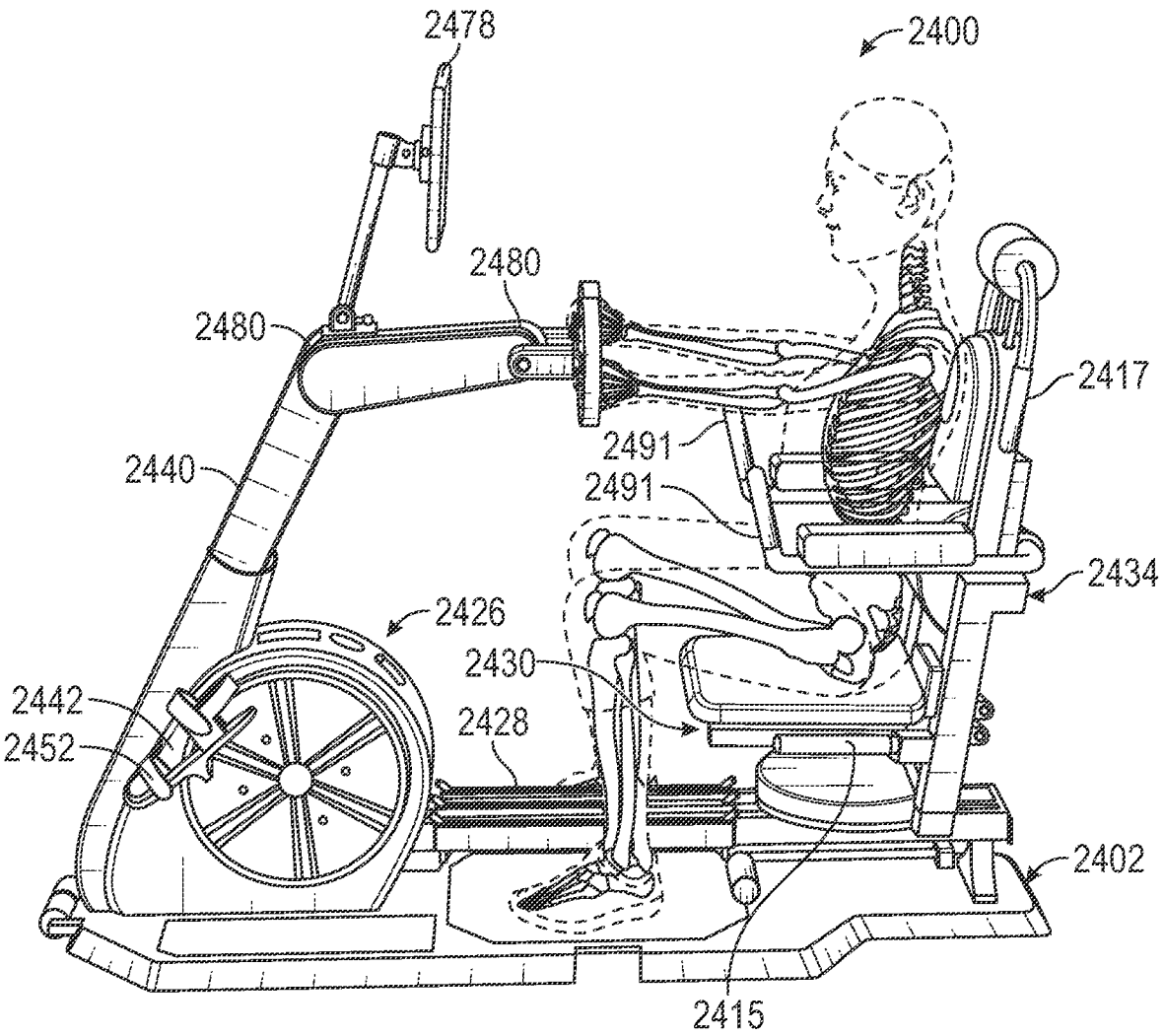
Figure 47:
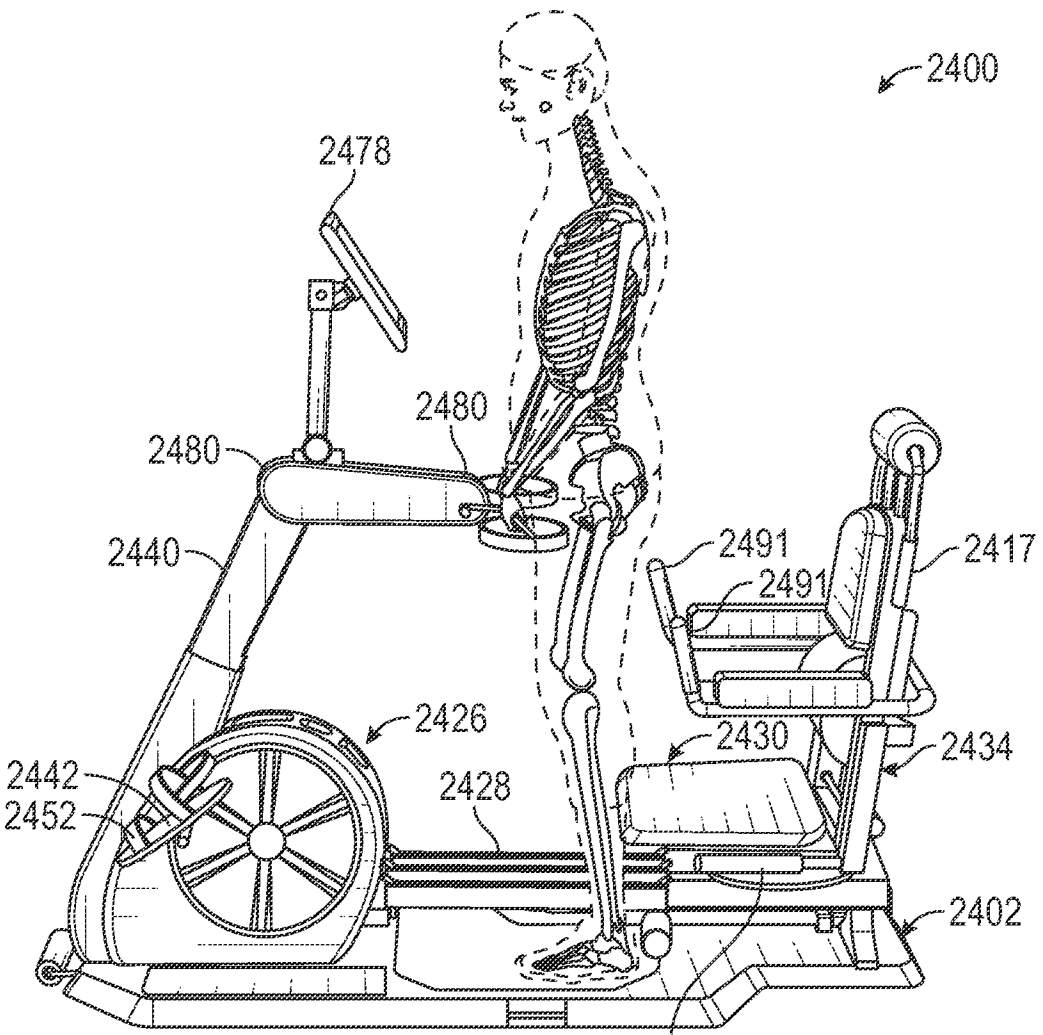
Figure 48:
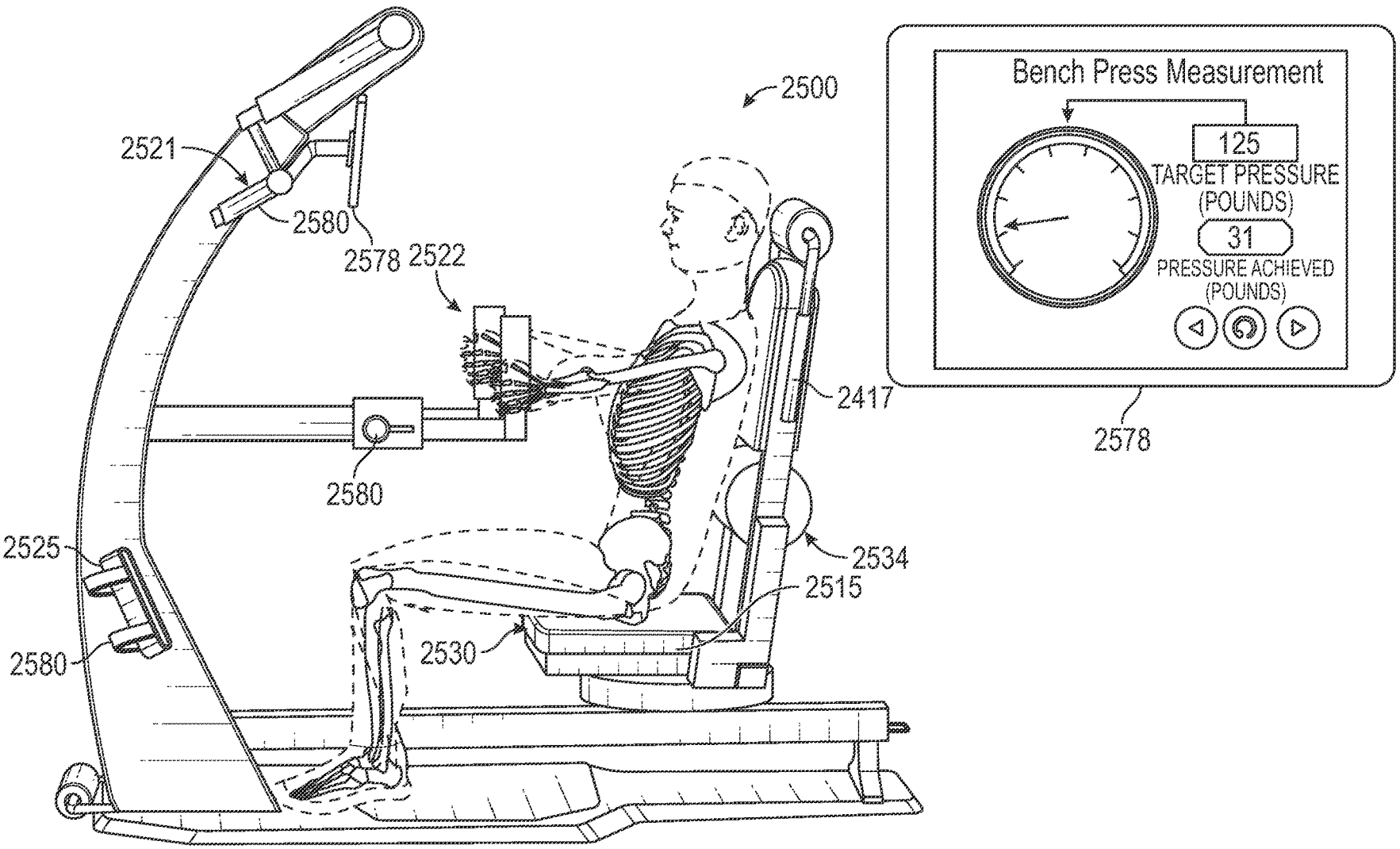
FIGS. 48-53 illustrate yet another alternate embodiment of an exercise machine, according to aspects of the disclosure.

The exercise machine 2400 can further include one or more foot plates 2425 (e.g., two shown) coupled to the base 2402, and each foot plate 2425 is configured to be selectively engaged by the user. Each foot plate 2425 can be coupled to at least one load cell 2480 (e.g., four per foot plate). Accordingly, and with reference to FIG. 43, when the user engages each foot plate 2425, each foot plate 2425 can be used for a separate and independent measurement of left and right leg forces to facilitate osteogenesis and/or hypertrophy. The foot plates 2425 may be used for different types of exercises, including but not limited to, a leg-press-type exercise (FIG. 43) and a rowing-type exercise (FIG. 44).

It is to be appreciated that adjustments can be made to the positions of the foot plates 2425. The position of the foot plates 2425 can be adjustable in a horizontal and/or vertical dimension. Also, the angle of the foot plates 2425 relative to the seat or back portion 2434 may be adjustable. Examples of how adjustments to the foot plates 2425 can be implemented include, but are not limited to, using telescoping tubes and pins, hydraulic pistons, and electric motors. In some embodiments, the foot plates are additionally retractable. Accordingly, the foot plates 2425 can fold from an engaged position (FIGS. 43 and 44) to a stored position (FIGS. 41-42, 46, and 47).

Figure 49:
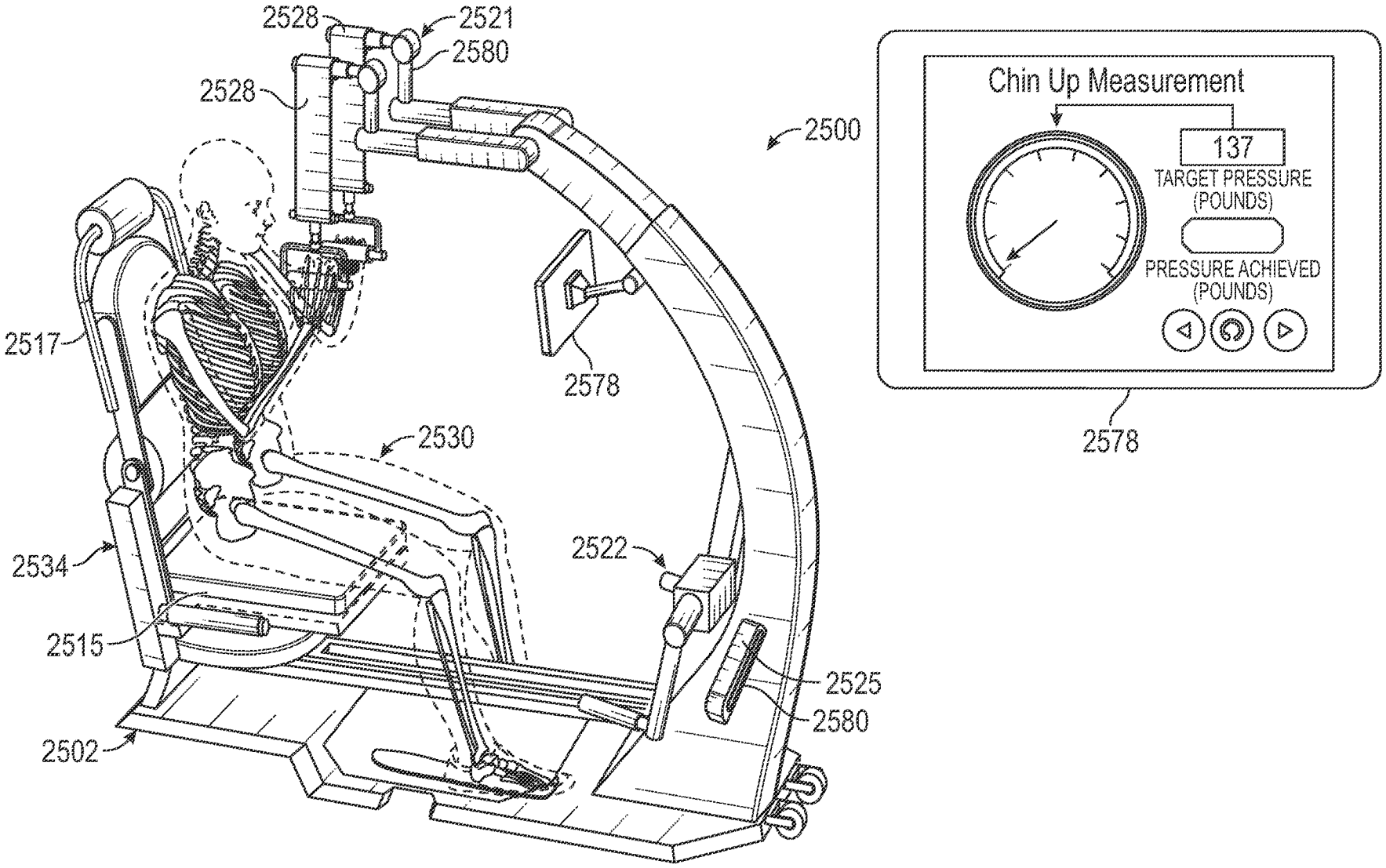
Figure 50:
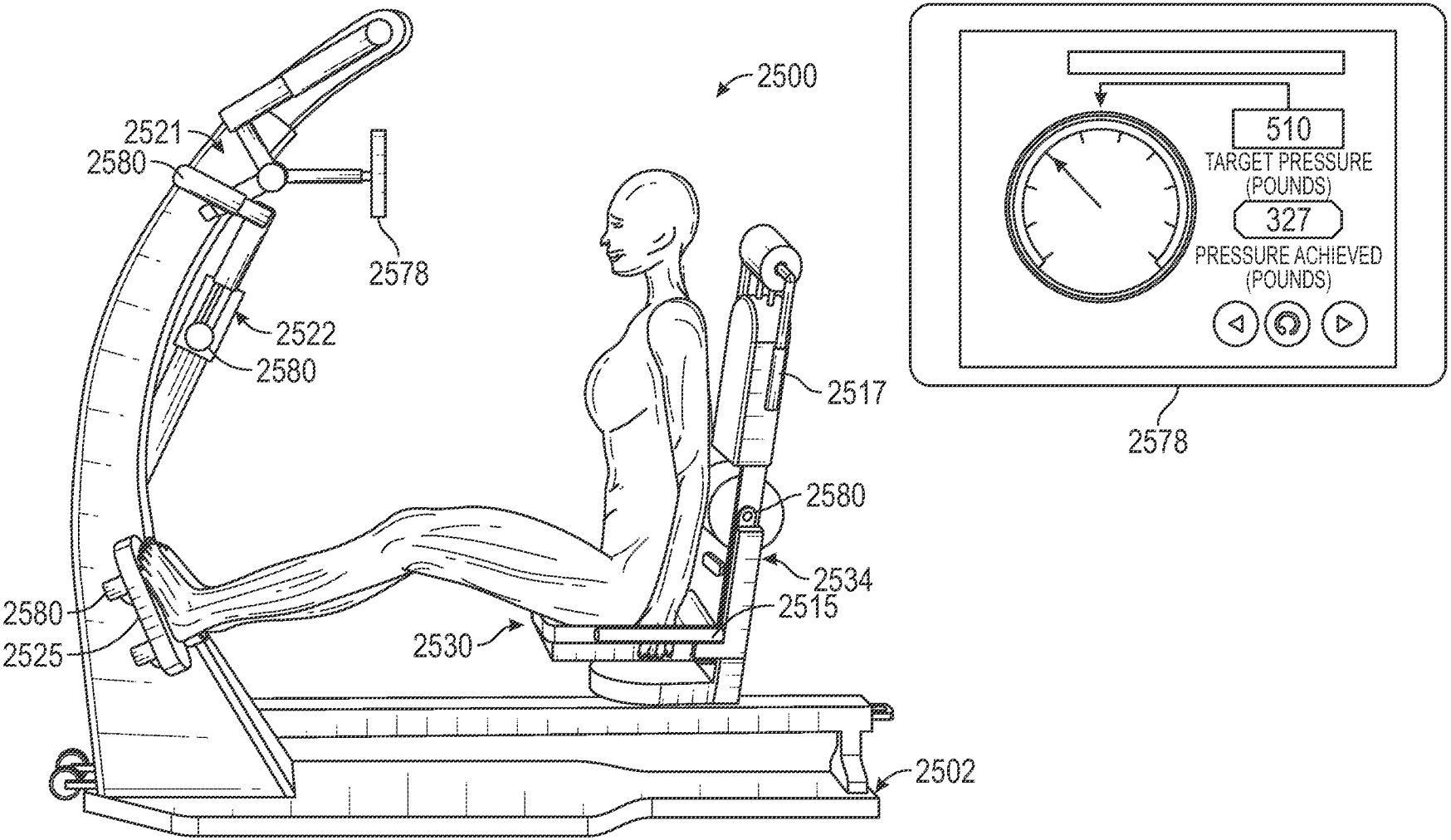
Figure 51:
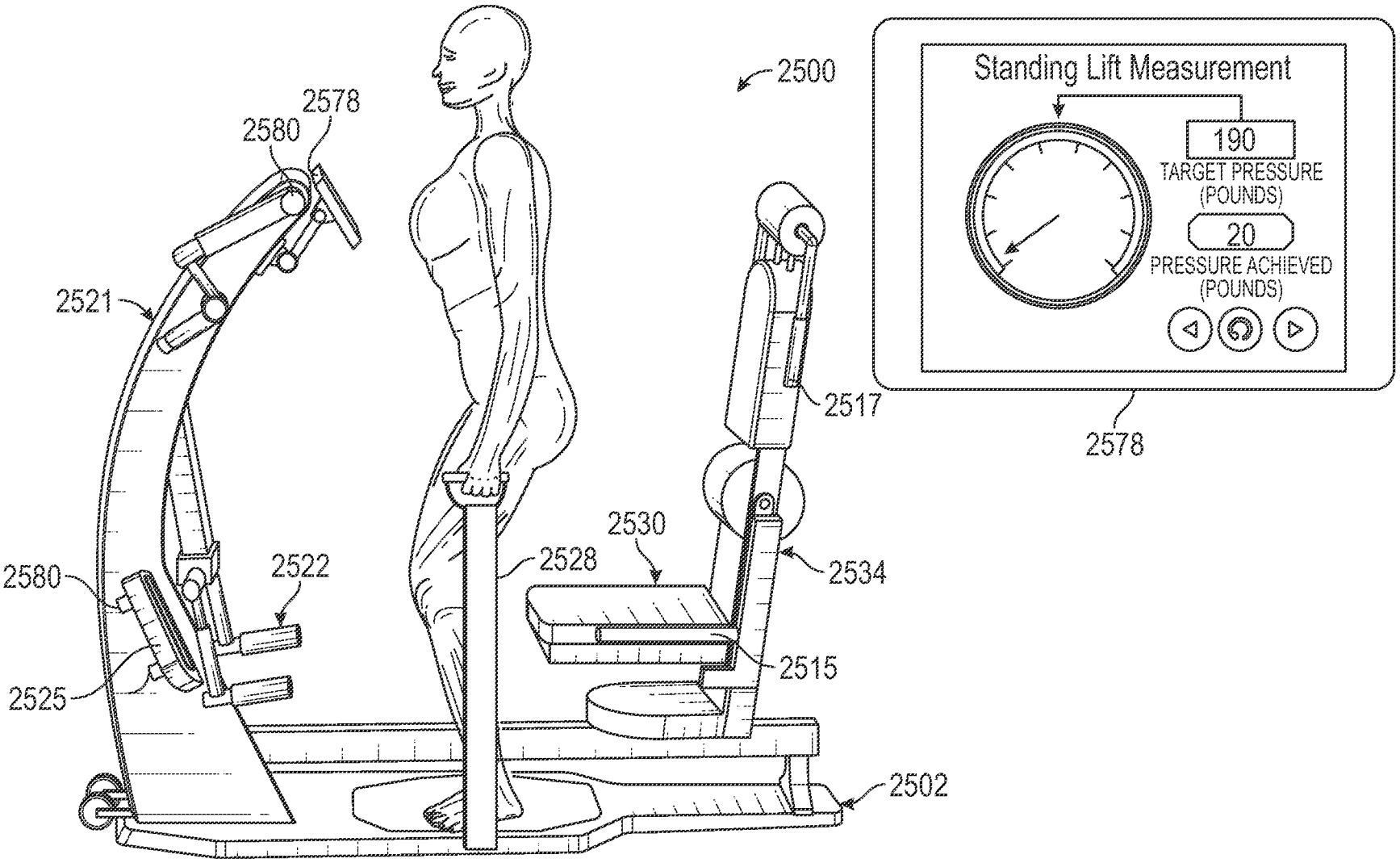
Figure 52:
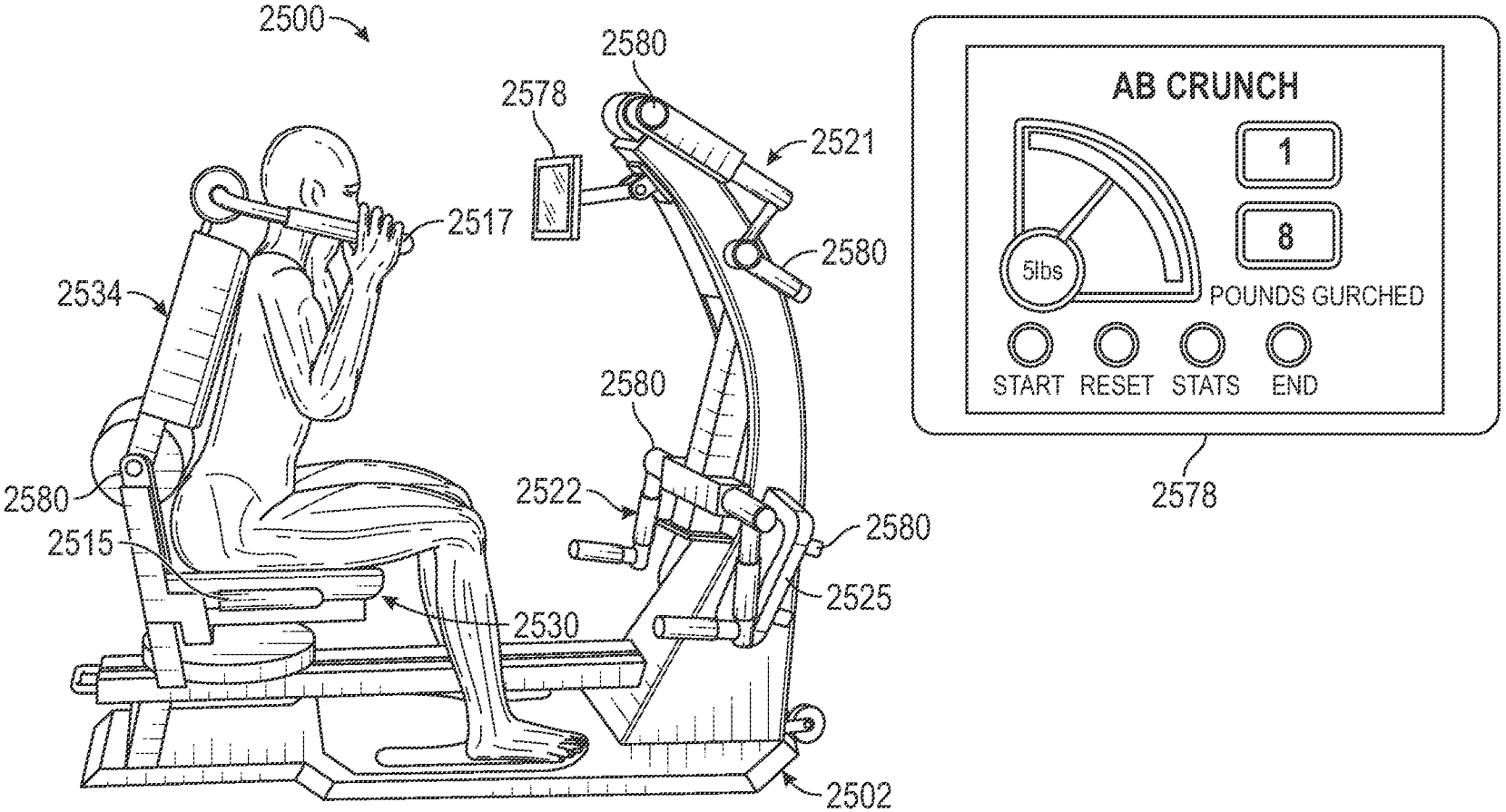
Figure 53:
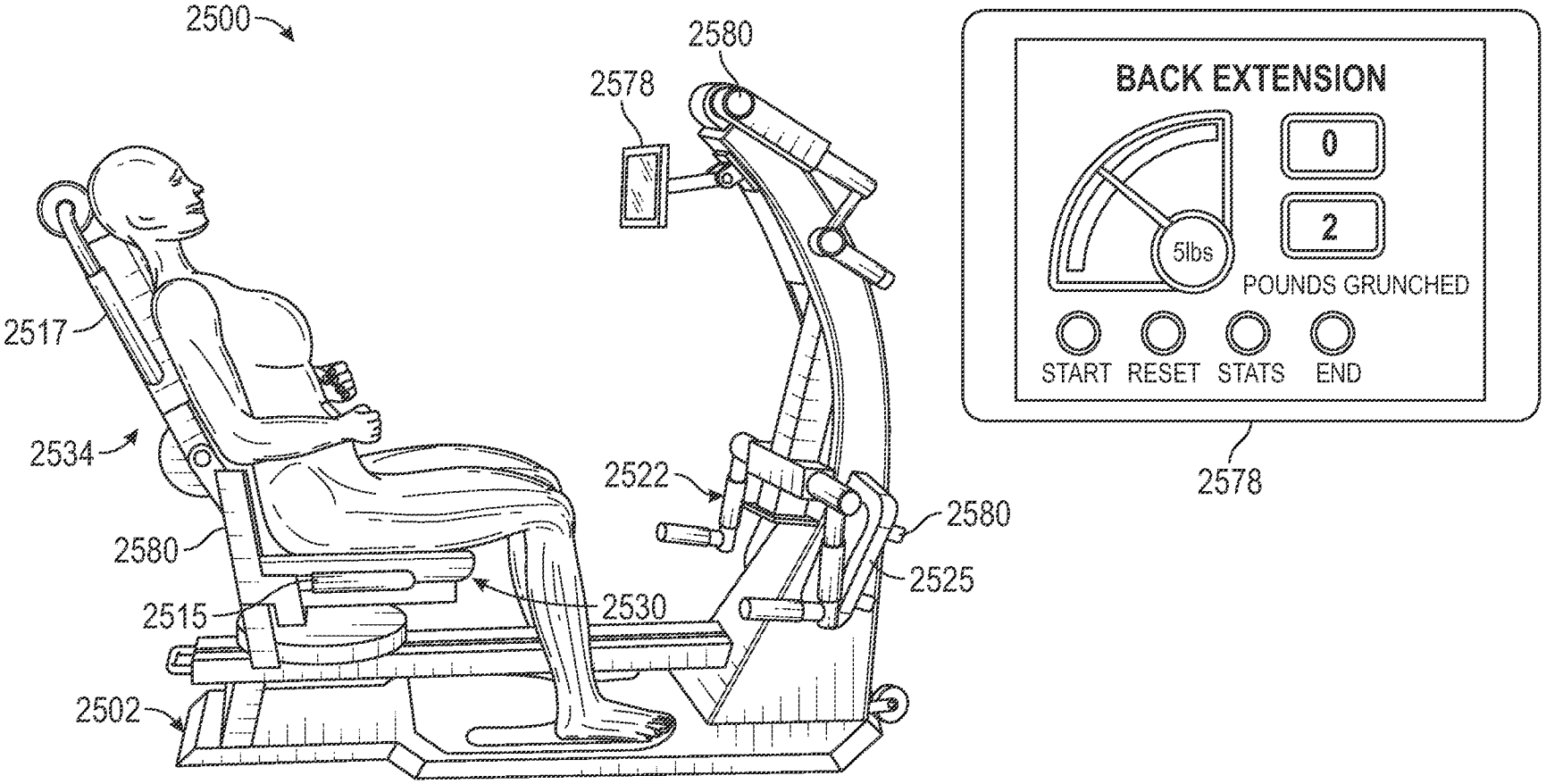

FIGS. 28-53 show a fifth exemplary embodiment of an exercise machine 2500 for exercising at least one body part of a user. The exercise machine 2500 can include at least one dynamic device 2528 (see, FIG. 49) and at least one isometric device 2521, 2525. As with some of the embodiments described above, the exercise machine 2500 can include the pair of upper load handles 2521 and the pair of middle load handles 2522. The upper load handles 2521 and middle load handles 2522 may not only be used for isometric exercises enabling bone osteogenesis, but may also be employed for various dynamic exercises enabling muscle hypertrophy. In a grip-strengthening-style exercise, the user can grasp the upper or middle load handles 2521, 2522. As best shown in FIG. 49, the at least one flexible band 2528 can engage the pair of upper load handles 2521 to provide a dynamic pull-down-type exercise. As best shown in FIG. 51, the at least one flexible band 2528 can engage the base 2502 to be used in a dynamic standing-lift-type exercise. FIGS. 52 and 53 show the at least one flexible band 2528 can be attached between the seat 2530 and the back portion 2534 to provide resistance for dynamic crunch-type and back-extension-type exercises. In each exercise, based on one or more signals from the plurality of load cells 2580, the control console 2578 can provide feedback to the user such as a target pressure and pressure achieved.

Figure 54:
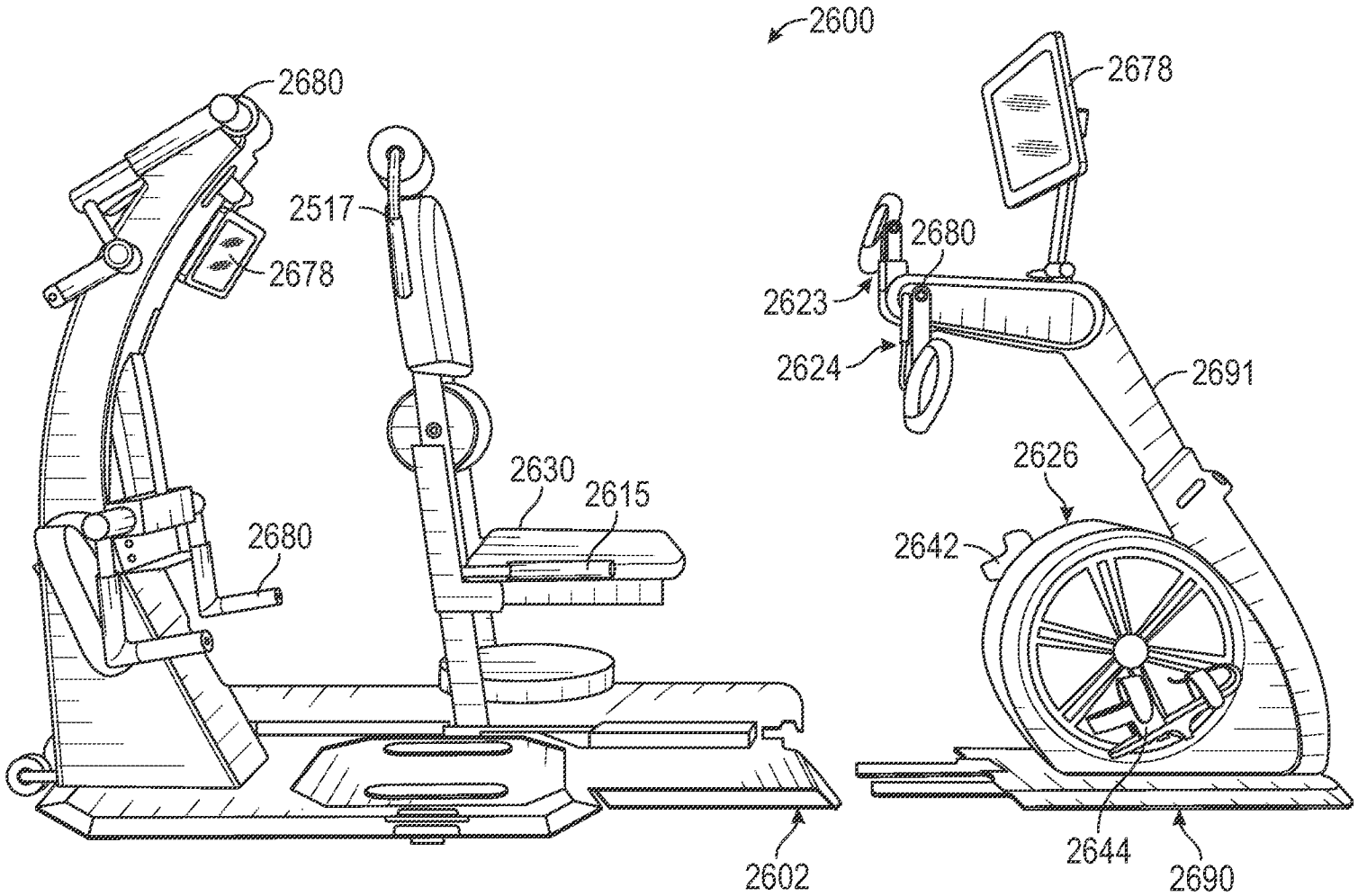
FIGS. 54-55 illustrate an embodiment of an exercise machine, according to aspects of the disclosure.
Figure 55:
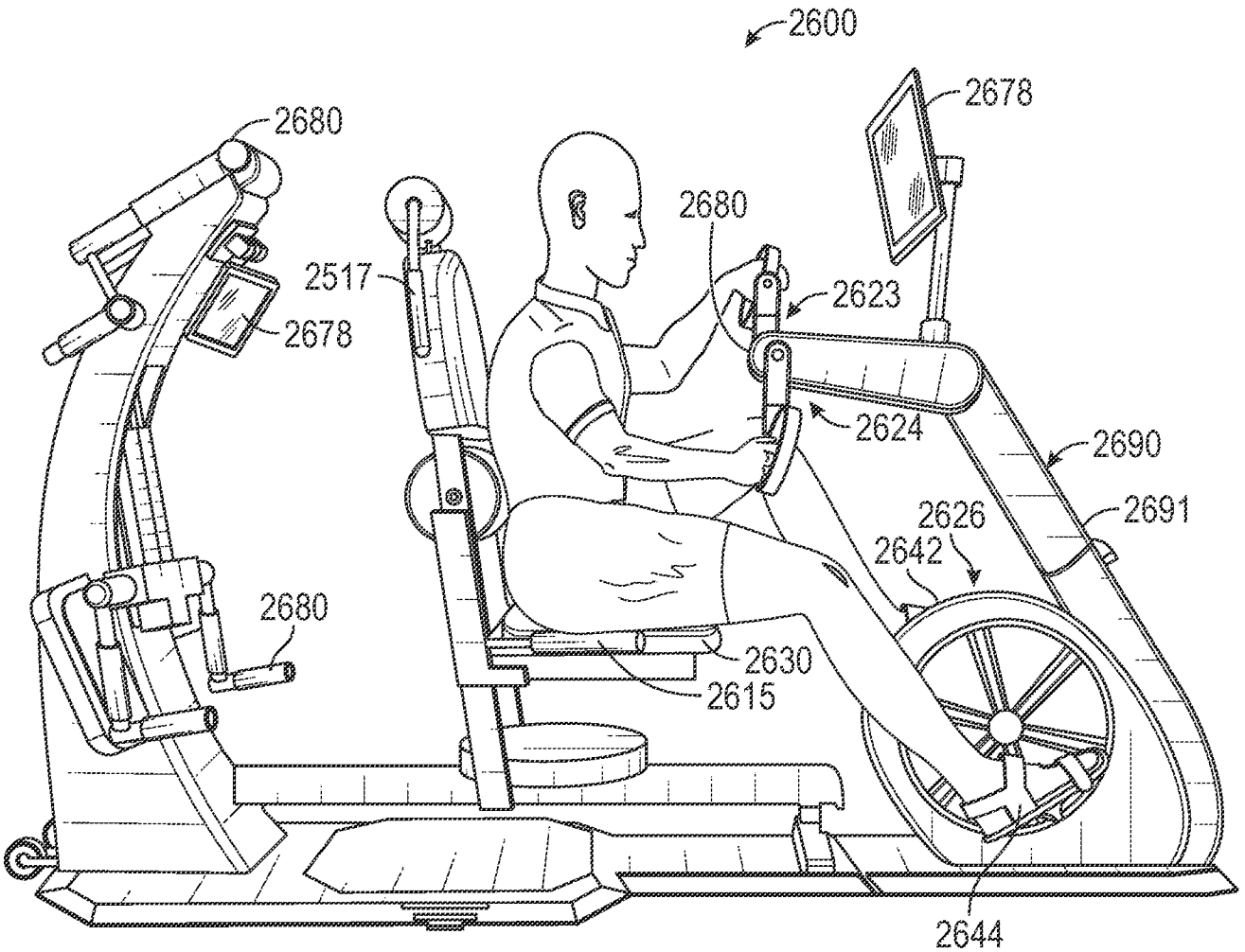

FIGS. 54-55 show a sixth exemplary embodiment of an exercise machine 2600 for exercising at least one body part of a user. The exercise machine 2600 is separable into a machine representative of the exercise machine 2500. In addition, a separable portion 2690 may be selectively coupled to the exercise machine 2500. The separable portion 2690 can include a second main post 2691 and may also include the cycle mechanism 2626 adjacent to the second main post 2691. In more detail, the cycle mechanism 2626 may include at least one pedal 2642, 2644 that can be configured to allow the user to engage and rotate the cycle mechanism 2626, as described above. The additional portion 2690 of exercise machine 2600 can also include a first pivoting assembly 2623 and a second pivoting assembly 2624 coupled to and pivotable about the second main post 2691. Such an arrangement is analogous to what is described above for exercise machine 2300. Based on one or more signals from the plurality of load cells 2680, the control console 2678 can provide feedback to the user, such as a target pressure and pressure achieved.

The present disclosure further comprises a method of using an exercise machine for enabling a user to exercise. A step of the method can be providing an exercise machine having an isometric device and a dynamic device. Such a machine can be like the machines 2100-2600 described above. Another step of the method can be selectively engaging at least one of the isometric device and dynamic device. Yet another step of the method can be receiving by at least one of the isometric and dynamic devices an application of force by the user, and the force is sufficient to facilitate at least one of osteogenesis and muscle hypertrophy.

Figure 56:
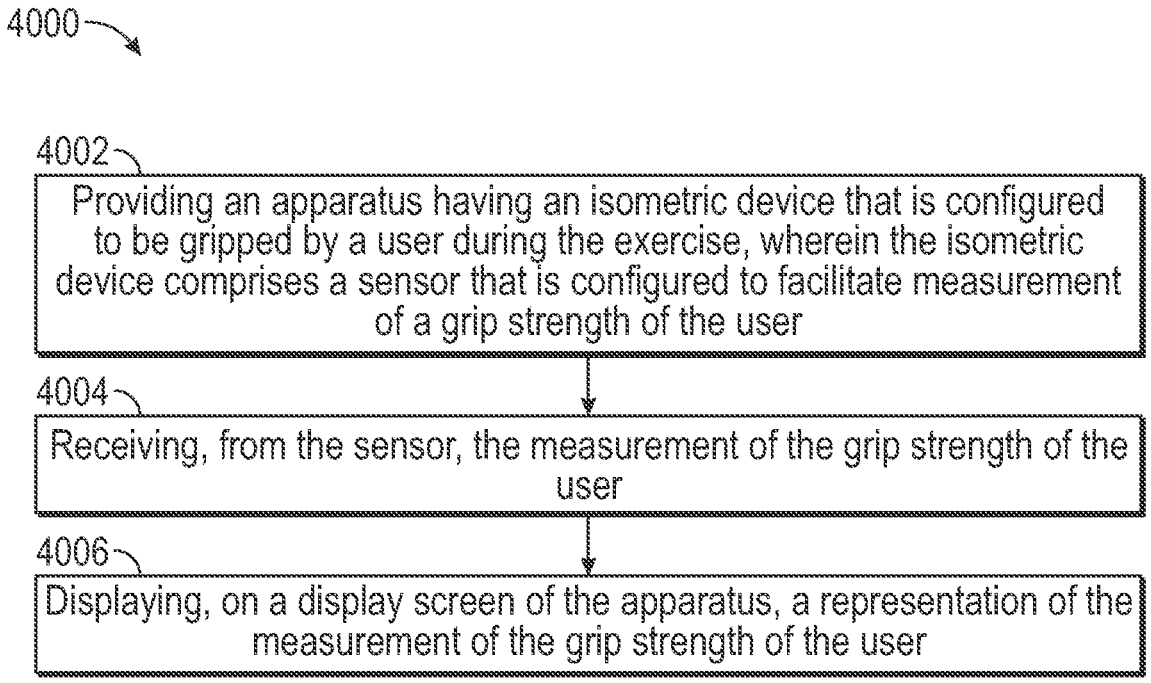
FIG. 56 illustrates a method for measuring a grip strength of a user, according to aspects of the disclosure.

With reference to FIG. 56, the present disclosure further yet includes a method 4000 for measuring the grip strength of a user. A step 4002 of the method can include providing an apparatus having an isometric device configured to be gripped by a user during the exercise. The step 4002 further provides that the isometric device include a sensor configured to facilitate measurement of a grip strength of the user. Another step 4004 of the method can include receiving, from the sensor, the measurement of the grip strength of the user. Yet, another step 4006 of the method can include displaying, on a display of the apparatus, a representation of the measurement of the grip strength of the user.

The various aspects, embodiments, implementations or features of the described embodiments can be used separately or in any combination. The embodiments disclosed herein are modular in nature and can be used in conjunction with or coupled to other embodiments, including both dynamic devices and isometric devices. In addition, the embodiments disclosed herein can employ selected equipment such that they can identify individual users and auto-calibrate threshold multiple-of-body-weight targets, as well as other individualized parameters, for individual users.

Consistent with the above disclosure, the examples of assemblies enumerated in the following clauses are specifically contemplated and are intended as a non-limiting set of examples.

1. An exercise apparatus configured to measure a grip strength of a user, the exercise apparatus comprising:

a base configured to rest on a ground surface;

an isometric device coupled to the base, wherein the isometric device is configured to be grasped by the user, and to receive an application of force by the user sufficient to facilitate at least one of osteogenesis or muscular hypertrophy in the user; and a sensor coupled to the isometric device, wherein the sensor is configured to facilitate measurement of the grip strength of the user when the isometric device is grasped by the user.

2. The exercise apparatus, wherein the sensor comprises a load cell configured to facilitate the measurement of the grip strength of the user.

3. The exercise apparatus, wherein the sensor comprises a strain gauge configured to facilitate the measurement of the grip strength of the user.

4. The exercise apparatus, wherein the sensor comprises a hydraulic load cell configured to facilitate the measurement of the grip strength of the user.

5. The exercise apparatus, wherein the sensor comprises a pressure sensitive sheet configured to facilitate the measurement of the grip strength of the user.

6. The exercise apparatus, wherein the sensor comprises a pressure sensitive sheet configured to facilitate the measurement of the grip strength of the user.

7. The exercise apparatus, wherein the isometric device is detachably coupled to the base.

8. The exercise apparatus, wherein the isometric device is a handle.

9. The exercise apparatus, further comprising a control system operatively coupled to the sensor, wherein the control system is configured to receive, from the sensor, the measurement of the grip strength of the user.

10. The exercise apparatus, wherein the control system comprises a processor, and the processor is configured to receive the measurement from the sensor.

11. The exercise apparatus, wherein the control system comprises a display, and the display is configured to display a representation of the measurement.

12. The exercise apparatus, wherein the display is configured to display the representation of the measurement over time.

13. The exercise apparatus, wherein the display is configured to display the representation of the measurement over an area.

14. The exercise apparatus, further comprising a speaker coupled to the base, wherein the speaker is configured to be activated, by the control system, to produce an audio output in response to the measurement received from the sensor.

15. The exercise apparatus, further comprising a control system operatively coupled to the sensor, wherein the control system is configured to receive, from the sensor, the measurement of the grip strength of the user.

16. A system for facilitating exercise of a user, the system comprising:

a base;

an isometric device coupled to the base, wherein the isometric device is configured to be grasped by the user; and a sensor coupled to the isometric device, wherein the sensor is configured to measure a grip strength of the user when the isometric device is grasped by the user.

17. The system, wherein the sensor comprises a load cell configured to facilitate the measurement of the grip strength of the user.

18. The system, wherein the sensor comprises a strain gauge configured to facilitate the measurement of the grip strength of the user.

19. The system, wherein the sensor comprises a hydraulic load cell configured to facilitate the measurement of the grip strength of the user.

20. The system, wherein the sensor comprises a pressure sensitive sheet configured to facilitate the measurement of the grip strength of the user.

21. A method for measuring a grip strength of a user, the method comprising:

providing an apparatus having an isometric device that is configured to be gripped by a user during the exercise, wherein the isometric device comprises a sensor that is configured to facilitate measurement of a grip strength of the user;

receiving, from the sensor, the measurement of the grip strength of the user; and displaying, on a display screen of the apparatus, a representation of the measurement of the grip strength of the user.

The various aspects, embodiments, implementations or features of the embodiments can be used separately or in any combination. Various aspects of the embodiments can be implemented by software, hardware or combinations of hardware and software. The embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the embodiments. However, it will be apparent to one skilled in the art that the specific details are not required to practice the embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An exercise system, comprising:

an osteogenic exercise machine comprising:

a first base comprising a first coupling mechanism, a first frame extending from the first base, and a first handle system coupled to the first frame;

a muscular hypertrophy machine comprising:

a second base comprising a second coupling mechanism configured to couple to the first coupling mechanism to form the exercise system, and decouple from the first coupling mechanism to form separate osteogenic exercise and muscular hypertrophy machines, a second frame extending from the second base, a cycling apparatus coupled to the second frame;

a seat assembly coupled to a rail and configured to traverse along the rail, wherein a first position comprises the seat assembly facing the osteogenic exercise machine, and a second position comprises the seat assembly rotated in an opposite direction with respect to the rail to face and interact with the muscular hypertrophy machine; and the osteogenic exercise machine further comprises foot plates positioned on the first frame, wherein in the first position, the seat assembly is moveable along the rail by a user seated on the seat assembly and engaged with the foot plates.

2. The exercise system of claim 1, wherein the seat assembly comprises:

a seat rest; and a seat back extending from the seat rest, the seat back comprising a first element rotationally coupled a second element.

3. The exercise system of claim 2, further comprising a handle system extending from the seat back, and the handle system is configured to be gripped during rotation of the first element relative to the second element.

4. The exercise system of claim 3, further comprising a second handle system coupled to the osteogenic exercise machine and the first frame, wherein the first base comprises a foot pad configured for use with the second handle system.

5. The exercise system of claim 4, wherein the osteogenic exercise machine further comprises a computing system coupled to the first frame, and the computing system comprises a display that faces the seat assembly in the first position.

6. The exercise system of claim 5, wherein the muscular hypertrophy machine is coupled to the computing system.

7. The exercise system of claim 4, wherein the second handle system is extendable relative to the first frame.

8. The exercise system of claim 4, further comprising a riser that extends from the base and couples to the rail, wherein the riser positions the rail over the foot pad.

9. The exercise system of claim 4, wherein the foot pad is positioned for use with the handle system and the second handle system.

10. The exercise system of claim 3, wherein the handle system comprises a static handle system, and the cycling apparatus comprises foot pedals.

11. The exercise system of claim 1, wherein the muscular hypertrophy machine further comprises a hand-pedaling apparatus.

12. The exercise system of claim 1, wherein the exercise system comprises a total of at least six different exercise stations.

13. A system, comprising:

a cardiovascular exercise machine configured to be operated by a user to perform an exercise;

a computing system communicatively coupled to the cardiovascular exercise machine, and the computing system comprising:

a memory storing instructions; and a processor communicatively coupled to the memory and configured to execute the instructions; and a resistance adjustment device communicatively coupled to the computing device, the resistance adjustment device is configured to:

transmit, to the computing system, information comprising a resistance provided by the cardiovascular exercise machine, wherein, based on the information, the processor executes the instructions to determine an activity level of the user, and the activity level of the user is used by the processor to adjust an intensity of an exercise function of the cardiovascular exercise machine to enhance a cardiovascular health of the user; and wherein the cardiovascular exercise machine comprises a seat assembly coupled to a rail and configured to traverse along the rail, wherein a first position comprises the seat assembly facing a second cardiovascular exercise device, and a second position comprises the seat assembly rotated with respect to the rail and facing the cardiovascular exercise device.

14. The system of claim 13, wherein the second cardiovascular exercise device comprises a first coupling mechanism, and the computing system further comprises a second coupling mechanism configured to communicate with the first coupling mechanism.

15. The system of claim 14, wherein the second coupling mechanism is configured to receive second information from the first coupling mechanism, and the second coupling mechanism is configured to decode the second information.

16. The system of claim 15, wherein the second information pertains to a type of the second cardiovascular exercise device, identification information of the second cardiovascular exercise device, one or more exercise functions of the second cardiovascular exercise device, or some combination thereof.

17. A system, comprising:

a cardiovascular exercise machine configured to be operated by a user to perform an exercise;

a computing system communicatively coupled to the cardiovascular exercise machine, and the computing system comprising:

a memory storing instructions; and a processor communicatively coupled to the memory and configured to execute the instructions; and a resistance adjustment device communicatively coupled to the computing device, the resistance adjustment device is configured to:

transmit, to the computing system, information comprising a resistance provided by the cardiovascular exercise machine, wherein, based on the information, the processor executes the instructions to determine an activity level of the user, and the activity level of the user is used by the processor to adjust an intensity of an exercise function of the cardiovascular exercise machine to enhance a cardiovascular health of the user; and wherein a second cardiovascular exercise device is coupled to the cardiovascular exercise device, and the second cardiovascular exercise device comprises foot plates positioned on a first frame, wherein in a first position, a seat assembly is moveable along a rail by the user seated on the seat assembly and engaged with the foot plates.

* * * * *